US011705099B2

(12) United States Patent
Hakuta et al.

(10) Patent No.: US 11,705,099 B2
(45) Date of Patent: Jul. 18, 2023

(54) SOUNDPROOF STRUCTURE

(71) Applicant: FUJIFILM Corporation, Tokyo (JP)

(72) Inventors: Shinya Hakuta, Ashigara-kami-gun (JP); Shogo Yamazoe, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 509 days.

(21) Appl. No.: 16/930,103

(22) Filed: Jul. 15, 2020

(65) Prior Publication Data

US 2020/0349915 A1 Nov. 5, 2020

Related U.S. Application Data

(63) Continuation of application No. PCT/JP2019/002755, filed on Jan. 28, 2019.

(30) Foreign Application Priority Data

Feb. 6, 2018 (JP) ..... 2018-019288

(51) Int. Cl.
*G10K 11/172* (2006.01)

(52) U.S. Cl.
CPC ..... *G10K 11/172* (2013.01)

(58) Field of Classification Search
CPC ..... G10K 11/172
See application file for complete search history.

(56) References Cited

U.S. PATENT DOCUMENTS 5,241,512 A * 8/1993 Argy ..... G10K 11/172 181/207
8,752,667 B2 * 6/2014 McKnight ..... G10K 11/172 181/207

(Continued)

FOREIGN PATENT DOCUMENTS

JP 62-98398 A 5/1987
JP 2005-134653 A 5/2005

(Continued)

OTHER PUBLICATIONS

European Communication pursuant to Article 94(3) EPC for corresponding European Application No. 19751469.8, dated Dec. 1, 2022.

(Continued)

*Primary Examiner* — Forrest M Phillips
(74) *Attorney, Agent, or Firm* — Birch, Stewart, Kolasch & Birch, LLP

(57) ABSTRACT

Provided is a soundproof structure that is small and light and can reduce noise with a high natural frequency of a sound source at a plurality of frequencies at the same time.

The soundproof structure according to the embodiment of the present invention includes a plurality of membrane-like members that are overlapped to be spaced from each other, a support that is made of a rigid body and supports each of the plurality of membrane-like members so as to perform membrane vibration, an inter-membrane space that is sandwiched between two adjacent membrane-like members among the plurality of membrane-like members, and a rear surface space that is formed between one membrane-like member at one end of the support in the support among the plurality of membrane-like members and the one end of the support, in which each of the plurality of membrane-like members absorbs a sound by performing the membrane vibration in a state where the one end of the support is closed.

18 Claims, 38 Drawing Sheets

(56) References Cited

U.S. PATENT DOCUMENTS

| | | | | |
|---|---|---|---|---|
| 8,857,563 | B1 * | 10/2014 | Chang | G10K 11/172 181/286 |
| 2007/0017739 | A1 | 1/2007 | Yamagiwa et al. | |
| 2013/0087407 | A1 * | 4/2013 | McKnight | G10K 11/172 181/287 |
| 2014/0060962 | A1 * | 3/2014 | Sheng | G10K 11/172 181/207 |
| 2014/0116802 | A1 | 5/2014 | Ma et al. | |
| 2015/0027807 | A1 * | 1/2015 | McKnight | E04B 1/8404 181/285 |
| 2015/0047923 | A1 * | 2/2015 | Chang | H03H 9/25 181/286 |
| 2018/0051462 | A1 | 2/2018 | Hakuta et al. | |
| 2018/0286371 | A1 * | 10/2018 | Davis | G10K 11/04 |
| 2019/0035373 | A1 * | 1/2019 | Chunren | G10K 11/162 |
| 2022/0260531 | A1 * | 8/2022 | Akkerman | G01S 15/8925 |

FOREIGN PATENT DOCUMENTS

| | | | |
|---|---|---|---|
| JP | 2009-293252 | A | 12/2009 |
| JP | 2011-39356 | A | 2/2011 |
| JP | 4832245 | B2 | 12/2011 |
| JP | 2012-73472 | A | 4/2012 |
| WO | WO 2016/208580 | A1 | 12/2016 |

OTHER PUBLICATIONS

Japanese Office Action for corresponding Japanese Application No. 2019-570685, dated Oct. 5, 2021, with English translation.

Extended European Search Report for European Application No. 19751469.8, dated Mar. 2, 2021.

Miki, "Acoustical Properties of Porous Materiais-Modification of Delany-Bazley Models", J. Acoust. Soc. Jpn., vol. 11, No. 1, 1930, pp. 19-24.

International Preliminary Report on Patentability and Written Opinion of the International Searching Authority, with an English translation (forms PCT/IB/373 and PCT/ISA/237), dated Aug. 20, 2020, for corresponding International Application No. PCT/JP2019/002755.

International Search Report (form PCT/ISA/210), dated Apr. 16, 2019, for corresponding International Application No. PCT/JP2019/002755, with an English translation.

* cited by examiner

SOUNDPROOF STRUCTURE

CROSS-REFERENCE TO RELATED APPLICATIONS

This application is a Continuation of PCT International Application No. PCT/JP2019/002755 filed on Jan. 28, 2019, which claims priority under 35 U.S.C. § 119(a) to Japanese Patent Application No. 2018-019288 filed on Feb. 6, 2018. The above application is hereby expressly incorporated by reference, in its entirety, into the present application.

BACKGROUND OF THE INVENTION

1. Field of the Invention

The present invention relates to a soundproof structure.

2. Description of the Related Art

Along with multifunctionality and high performance, it is necessary that various electronic apparatus such as a copier, electronic devices mounted on vehicles, an electronic apparatus of household appliances, home appliances, various moving objects such as robots are driven at a high voltage and current, and thus electric output has increased. In addition, with an increase in output and reduction in size, the necessity of controlling heat or air for cooling has increased, and fans and the like have become important.

The electronic apparatus or the like has an electronic circuit, a power electronics device, or an electric motor that are noise sources, and each of the electronic circuit, the power electronics device, and the electric motor (hereinafter, also referred to as a sound source) generates a sound with a great volume with a natural frequency. In a case where the output of the electric system increases, a volume with this frequency further increases which causes a problem as a noise.

For example, in a case of an electric motor, a noise (electromagnetic noise) with a frequency corresponding to a rotation speed is generated. In a case of an inverter, a noise (switching noise) is generated according to a carrier frequency. In a case of a fan, a noise with a frequency corresponding to a rotation speed is generated. The volume of these noises is greater than that of a similar frequency sound.

Generally, a porous sound absorbing body such as urethane foam or felt is often used as a sound reduction unit. In a case where a porous sound absorbing body is used, a sound reduction effect is obtained in a wide frequency range. Therefore, in a case of the noise having no frequency dependency such as a white noise, a suitable sound reduction effect is obtained.

However, sound sources such as various electronic apparatus generate loud sounds at their natural frequencies. Particularly, as various electronic apparatus operate at higher speeds and with higher output, a natural frequency sound becomes extremely high and large.

An ordinary porous sound absorbing body such as urethane foam or felt reduces the sound with a wide frequency range, and accordingly, a noise with a natural frequency of the sound source may not be sufficiently reduced, and not only the noise with the natural frequency, but also sounds at other frequencies are reduced. Accordingly, the situation where the sound with the natural frequency is more audible prominently than the sounds at other frequencies does not change. Therefore, only a specific frequency width exists for a loud sound with respect to a noise that is broad in frequency such as a white noise and a pink noise, and there is a problem in that noise in a narrow frequency band such as a single frequency sound is easily sensed by human. Therefore, in a case of such noise generated by the electronic apparatus or the like as described above, there has been a problem that even after the countermeasure is taken by using the porous sound absorbing body, the sound at a specific frequency becomes relatively more audible than sounds at other frequencies.

Further, in order to reduce a louder sound using the porous sound absorbing body, it is necessary to use a large amount of the porous sound absorbing body. An electronic apparatus and the like are often required to be reduced in size and weight, and it is difficult to ensure a space for disposing a large amount of porous sound absorbing body in the periphery of an electronic circuit, an electric motor, and the like of the electronic apparatus.

As a unit for reducing a specific frequency sound more significantly, a sound reduction unit using membrane vibration is known. The sound reduction unit using the membrane vibration is small and light and can appropriately reduce at a specific frequency sound.

For example, JP4832245B discloses a sound absorbing body having a frame in which a through hole is formed, and a sound absorbing material covering one opening of the through hole, in which a first storage elastic modulus E1 of the sound absorbing material is $9.7\times10^6$ or more, and a second storage elastic modulus E2 is 346 or less. The sound absorbing body absorbs a sound by generating resonance (membrane vibration) in a case where a sound wave is incident on the sound absorbing body (see paragraph [0009], FIG. 1 and the like of JP4832245B).

In addition, since a plurality of sounds having different frequencies may be generated in the electric apparatus or the like, there is a need to reduce each frequency sound at the same time. As a unit for reducing a sound in a plurality of frequency bands at the same time, the sound reduction unit using a plurality of vibration bodies is known.

For example, JP1987-098398A (JP-S62-098398A) discloses a sound absorbing device comprising a first sound absorbing portion including a diaphragm and a second sound absorbing portion using the first sound absorbing portion as a diaphragm element. According to the sound absorbing device described in JP1987-098398A (JP-S62-098398A), since each of the first sound absorbing portion and the second sound absorbing portion has a specific resonance frequency, it is possible to absorb sound in a wide frequency band (claim 1 of JP1987-098398A (JP-S62-098398A), the second to seventh lines of the left column of page 2 of the specification, and the like).

SUMMARY OF THE INVENTION

With a further increase in speed and output of various electronic apparatus, a frequency of noise generated by the above-described electronic circuits and electric motors has become higher. In a case of reducing a high frequency sound by the sound reduction unit using membrane vibration, it is considered to increase a natural frequency of the membrane vibration by adjusting a hardness and a size of the membrane.

However, according to the study of the inventors, it is found that, in the sound reduction unit using the membrane vibration, in a case where the natural frequency of the membrane vibration is increased by adjusting the hardness and size of the membrane, a sound absorption coefficient is low at a high frequency.

More specifically, in a case where sound absorption using the membrane vibration is performed by adjusting the hardness and size of the membrane, the membrane vibration of a fundamental vibration mode mainly contributes to the sound absorption. At this time, it is found that the higher the frequency in the fundamental vibration mode, the lower the sound absorption coefficient due to the membrane vibration since the sound is reflected on a membrane surface.

For this reason, in a case where the sound absorption is performed using the membrane vibration in the fundamental vibration mode as in the sound absorbing body described in JP4832245B, it is considered that simply increasing the natural frequency of the membrane vibration by simply adjusting parameters such as a thickness of the membrane does not obtain a sufficient sound absorbing effect for a relatively high frequency sound.

In addition, according to further studies by the present inventors, it is found that the sound absorption due to the membrane vibration in both the fundamental vibration mode and a high-order vibration mode is performed by providing a space on the rear surface side of the membrane, and there is no need to make the membrane hard (or thick), and as a result, a good sound absorbing effect can be obtained even at a high frequency while suppressing sound reflection at the membrane by adjusting a shape of the membrane and a size of a rear surface space to increase the sound absorption coefficient at frequency in the high-order vibration mode.

Accordingly, in a case where the sound is absorbed by the membrane vibration in the fundamental vibration mode and the high-order vibration mode by appropriately setting the shape of the membrane, the size of the rear surface space, and the like, it is possible to efficiently absorb even a high frequency sound.

On the other hand, as described above, in electronic apparatus such as an electric motor and an inverter, a plurality of sounds having different frequencies may be generated. In such a case, in a case where each frequency sound is absorbed by the membrane vibration in the fundamental vibration mode and the high-order vibration mode, and each frequency does not coincide with the frequency (peak frequency) in the vibration mode of the membrane vibration, it becomes difficult to absorb the sound having a plurality of frequencies at the same time. However, it has been difficult for the vibration mode (high-order vibration mode) and the frequency of noise of target noise sources to coincide with the vibration frequency in the vibration mode of the membrane vibration in a plurality of frequencies.

In addition, in electronic apparatus and the like, an installation space of the sound reduction unit is often limited. For this reason, as a structure for absorbing the sound having the plurality of frequencies, a structure capable of absorbing each frequency sound while maintaining the same installation space is required instead of disposing a sound reduction unit for each frequency.

Although the sound absorbing device described in JP1987-098398A (JP-S62-098398A) described above can absorb the sound having the plurality of frequencies at the same time, the sound absorbing device has a structure in which the second sound absorbing portion has the first sound absorbing portion as the diaphragm element and performs the sound absorption mainly by the membrane vibration in the fundamental vibration mode. Accordingly, it is considered that a sound in a relatively low frequency is absorbed. In addition, the mass of the second sound absorbing portion (diaphragm element) is increased by incorporating the first sound absorbing portion into the diaphragm element. In a case where the mass of the second sound absorbing portion increases, the sound absorption frequency shifts to a low frequency side. That is, in the sound absorbing device described in JP1987-098398A (JP-S62-098398A), it is considered that the sound is absorbed by combining the first sound absorbing portion having a normal sound absorbing structure using the fundamental vibration mode, and the second sound absorbing portion shifted to a lower frequency side than the sound absorption frequency of the fundamental vibration mode. For this reason, even in a case where the sound absorbing device described in JP1987-098398A (JP-S62-098398A) is simply used, it is considered that the need for absorbing a high frequency sound cannot be met.

An object of the invention is to provide a soundproof structure that solves the above-mentioned problems of the related art, is small and light, and can reduce a noise with a high natural frequency of a sound source at a plurality of frequencies at the same time.

The inventors have conducted intensive studies to achieve the above object, and as a result, the inventors have found that the above problems can be solved by having a soundproof structure having: a plurality of membrane-like members that are overlapped to be spaced from each other, a support that is made of a rigid body and supports each of the plurality of membrane-like members so as to perform membrane vibration, an inter-membrane space that is sandwiched between two adjacent membrane-like members among the plurality of membrane-like members; and a rear surface space that is formed between one membrane-like member at one end of the support in the support among the plurality of membrane-like members and the one end of the support, in which each of the plurality of membrane-like members absorbs a sound by performing the membrane vibration in a state where the one end of the support is closed, and completed the invention.

In addition, it is preferable that a sound absorption coefficient of the vibration of one membrane-like member at a frequency in at least one high-order vibration mode existing at frequencies of 1 kHz or more is higher than a sound absorption coefficient at a frequency in a fundamental vibration mode.

In addition, it is preferable that in a case where a Young's modulus of the one membrane-like member is denoted by E, a thickness of the one membrane-like member is denoted by t, a thickness of the rear surface space is denoted by d, and an equivalent circle diameter of a region where the one membrane-like member vibrates is denoted by Φ, a hardness $E \times t^3$ of the one membrane-like member is $21.6 \times d^{-1.25} \times \Phi^{4.15}$ or less. Here, the unit of the Young's modulus E is Pa, the unit of the thickness t is m (meters), the unit of the thickness d of the rear surface space is m (meters), the unit of the equivalent circle diameter Φ is m (meters), and the unit of the hardness $E \times t^3$ of the membrane-like member is $Pa \cdot m^3$.

In addition, it is preferable that the hardness $E \times t^3$ ($Pa \cdot m^3$) of one membrane-like member is $2.49 \times 10^{-7}$ or more.

In addition, it is preferable that the support comprises an inner frame having an opening, the one membrane-like member is fixed to an opening surface surrounding the opening at an end position of the inner frame, and the rear surface space is surrounded by the one membrane-like member and the inner frame.

In addition, it is preferable that there are a plurality of frequency bands where the soundproof structure is capable of absorbing the sound, and the plurality of frequency bands where the soundproof structure is capable of absorbing the sound include a first sound absorption frequency band in a case where the one membrane-like member performs the membrane vibration in a high-order vibration mode and a second sound absorption frequency band in a case where the two adjacent membrane-like members are in opposite phases to each other while sandwiching the inter-membrane space and perform the membrane vibration.

In addition, it is preferable that the support has a bottom wall that covers the opening of the inner frame on a side opposite to the opening surface in which the one membrane-like member is fixed.

In addition, it is preferable that the rear surface space is a closed space.

In addition, it is preferable that a through hole is provided in at least one of the support or the bottom wall.

In addition, it is preferable that a thickness of each of the inter-membrane space and the rear surface space is 10 mm or less.

In addition, it is preferable that a total length of the soundproof structure in the direction in which the membrane-like member are arranged is 10 mm or less.

In addition, it is preferable that a total thickness of the rear surface space and the inter-membrane space is 10 mm or less.

In addition, it is preferable that a thickness of the membrane-like member is 100 μm or less.

In addition, it is preferable that average areal densities of membrane portions are different from each other between at least two or more membrane-like members among the plurality of membrane-like members, and the membrane-like member having a larger average areal density of the membrane portion is disposed on one end side of the support close to the rear surface space, and the membrane-like member having a smaller average areal density of the membrane portion is disposed on the other end side of the support farther from the rear surface space.

In addition, it is preferable that a through hole is formed in at least one of the plurality of membrane-like members.

In addition, it is preferable that the through hole is formed in the membrane-like member at a position farthest from one end of the support close to the rear surface space among the plurality of membrane-like members.

In addition, it is preferable that a porous sound absorbing body disposed in at least a portion of at least one space of the rear surface space or the inter-membrane space.

In addition, it is preferable that the membrane-like member at a position farthest from one end of the support close to the rear surface space among the plurality of membrane-like members forms an end farther from the rear surface space of the soundproof structure.

In addition, it is preferable that the support comprises a tubular outer frame, and the two adjacent membrane-like members face each other via the outer frame.

According to the present invention, it is possible to provide the soundproof structure that is reduced in size and weight and can reduce a noise with a high natural frequency of a sound source at a plurality of frequencies at the same time.

DESCRIPTION OF THE PREFERRED EMBODIMENTS

Figure 1:
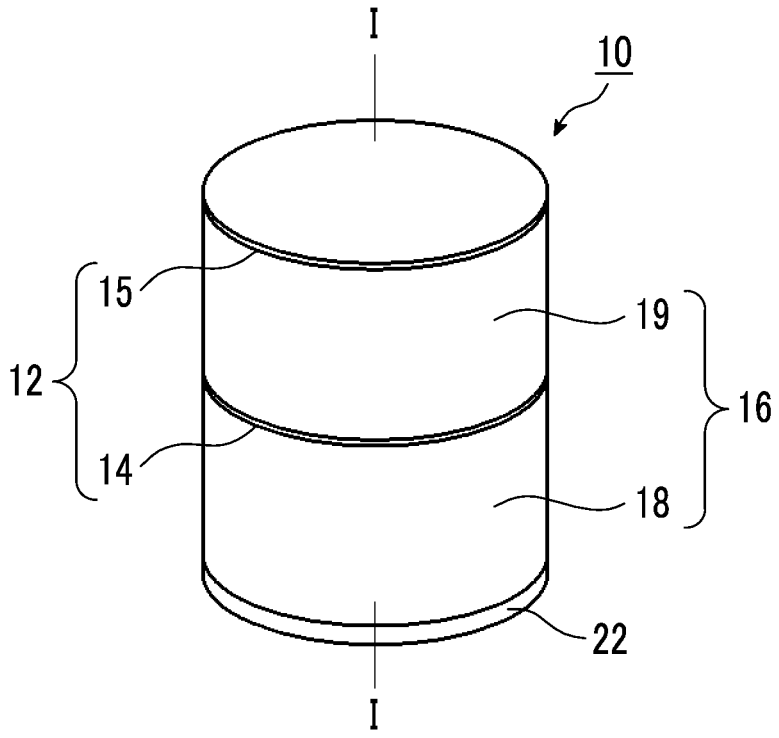
FIG. 1 is a perspective view schematically showing an example of a soundproof structure of the invention.

Hereinafter, a soundproof structure of the present invention will be described in detail.

The description of the constituent elements described below may be made on the basis of typical embodiments of the invention, but the invention is not limited to such embodiments. That is, in the following, the soundproof structure according to the embodiment of the present invention has been described with various embodiments, but the invention is not limited to these embodiments, and various modifications or changes may be made without departing from a gist of the invention.

In this specification, a numerical range expressed using "to" means a range including numerical values described before and after "to" as a lower limit value and an upper limit value.

Further, in this specification, for example, angles such as "45°", "parallel", "vertical", and "orthogonal" mean that a difference from an exact angle is within a range of less than 5 degrees, unless otherwise specified. The difference from the exact angle is preferably less than 4 degrees and more preferably less than 3 degrees.

In this specification, "the same", "identical" and "coincidence" include an error range generally accepted in the technical field to which the present invention belongs.

In this specification, "entire part", "all", and "entire surface" may be 100%, and may include an error range generally accepted in the technical field to which the present invention belongs, for example, 99% or more, 95% or more, or 90% or more.

In the following description, "thickness" means a length in a direction in which a plurality of membrane-like members described later are arranged (hereinafter, a thickness direction). In addition, "outer" and "inner" in the following description mean directions opposite to each other in the thickness direction, and the "outer" means a side close to a sound source, that is, a side through which a sound emitted from the sound source enters the soundproof structure. On the other hand, "inner" means a side farther from the sound source, that is, a side towards which the sound that has entered the soundproof structure goes.

Further, an inner end of a support described later corresponds to "one end of the support" of the present invention, and an outer end corresponds to "the other end of the support" of the present invention.

<<Soundproof Structure>>

The soundproof structure according to the embodiment of the present invention has a plurality of membrane-like members and the support that supports each of the plurality of membrane-like members. In addition, the soundproof structure according to the embodiment of the present invention has an inter-membrane space sandwiched between two adjacent membrane-like members among the plurality of membrane-like members, and a rear surface space formed between one membrane-like member at the inner end of the support and the inner end of the support in the support among the plurality of membrane-like members. The soundproof structure according to the embodiment of the present invention absorbs a sound by membrane vibration of each of the plurality of membrane-like members in a state where the inner end of the support is closed.

The soundproof structure according to the embodiment of the present invention can be suitably used as a sound reduction unit for reducing sounds generated by various kinds of electronic apparatus, transportation apparatus, and the like.

The electronic apparatus includes household appliance such as an air conditioner, an air conditioner outdoor unit, a water heater, a ventilation fan, a refrigerator, a vacuum cleaner, an air purifier, an electric fan, a dishwasher, a microwave oven, a washing machine, a television, a mobile phone, a smartphone, and a printer, office equipment such as a copier, a projector, a desktop PC (personal computer), a notebook PC, a monitor, and a shredder, computer apparatus that uses high power such as a server and a supercomputer, scientific laboratory equipment such as a constant-temperature tank, an environmental tester, a dryer, an ultrasonic cleaner, a centrifugal separator, a cleaner, a spin coater, a bar coater, and a transporter.

Transportation apparatus includes vehicles, motorcycles, trains, airplanes, ships, bicycles (especially electric bicycles), personal mobility, and the like.

Examples of a moving object include a consumer robot (a cleaning use, a communication use such as a pet use or a guidance use, and a movement assisting use such as an automatic wheelchair) and an industrial robot.

In addition, the structure can also be used for an apparatus set to emit at least one or more specific single frequency sounds as a notification sound or a warning sound in order to send notification or warning to a user.

In addition, in a case where the metal body and the machine resonate and vibrate at a frequency according to the size, as a result, at least one or more single frequency sounds emitted at a relatively large volume cause a problem as noise, but the soundproof structure according to the embodiment of the present invention can be applied to such noise.

Further, the soundproof structure according to the embodiment of the present invention can also be applied to a room, a factory, a garage, and the like in which the above-described apparatus are housed.

An example of a sound source of a sound which is to be reduced by the soundproof structure of the invention is an electronic part or a power electronics device part including an electric control device such as an inverter, a power supply, a booster, a large-capacity condenser, a ceramic condenser, an inductor, a coil, a switching power supply, and a transformer, a rotary part such as an electric motor or a fan, a mechanical part such as a moving mechanism using a gear and an actuator, and a metal body such as a metal rod, which are included in the various apparatus described above.

In a case where the sound source is an electronic part such as an inverter, the sound source generates a sound (switching noise) according to a carrier frequency.

In a case where the sound source is an electric motor, the sound source generates a frequency sound (electromagnetic noise) according to a rotation speed.

In a case where the sound source is the metal body, a frequency sound (single frequency noise) according to a resonant vibration mode (primary resonance mode) is generated.

That is, each of the sound sources generates a natural frequency sound to the sound source.

The sound source having a natural frequency often has a physical or electrical mechanism that oscillates a specific frequency. For example, rotation speed and its multiples of a rotating system (such as a fan and a motor) are directly emitted as a sound. Specifically, for example, in the case of an axial fan, a strong peak sound is generated at a fundamental frequency determined according to the number of blades and its rotation velocity, and at a frequency that is an integral multiple of the fundamental frequency. The motor also generates the strong peak sound in a mode according to the rotation velocity and in a high-order mode.

In addition, a portion receiving an alternating electrical signal of an inverter often oscillates a sound corresponding to an alternating frequency. In addition, in the metal body such as the metal rod, a resonance vibration according to the size of the metal body occurs, and as a result, the single frequency sound is strongly emitted. Therefore, the rotating system, an alternating circuit system, and the metal body is a sound source having a natural frequency of the sound source.

More generally, the following experiment can be performed to determine whether a sound source has a natural frequency.

The sound source is placed in an anechoic room or a semi-anechoic room, or in a situation surrounded by a sound absorbing body such as urethane. By setting a sound absorbing body in the periphery, the influence of reflection interference of a room or a measurement system is eliminated. Then, the sound source is allowed to generate a sound and measurement is performed with a microphone from a separated position to acquire frequency information. A distance between the sound source and the microphone can be appropriately selected depending on the size of the measurement system, and it is desirable to perform the measurement at a distance of appropriately 30 cm or more.

In the frequency information of the sound source, a maximum value is referred to as a peak, and a frequency thereof is referred to as a peak frequency. In a case where the maximum value is higher than that of a peripheral frequency sound by 3 dB or more, the peak frequency sound can be sufficiently recognized by human beings, and accordingly, it can be referred to as a sound source having a natural frequency. In a case where the maximum value is higher by 5 dB or more, it can be more recognized, and in a case where the maximum value is higher by 10 dB or more, it can be even more recognized. The comparison with the peripheral frequencies is made by evaluating a difference between a minimum value of the closest frequency at which the frequency is minimum excluding signal noise and fluctuation, and the maximum value.

In addition, in contrast to a white noise and a pink noise that frequently exist as environmental sounds in the natural world, since a noise in a narrow frequency band in which only a specific frequency component is more strongly emitted is easily detected by a human and gives an unpleasant impression, it is important to remove such noise.

In addition, in a case where the sound emitted from the sound source resonates in a housing of various apparatus, a volume of a resonance frequency or the frequency of an overtone may increase. Alternatively, in a case where the sound emitted from the sound source in a room, a factory, a garage, and the like in which the above-described apparatus are housed is resonated, the volume of the resonance frequency or the frequency of the overtone may increase.

In addition, due to resonance occurring due to a space inside a tire and a cavity inside a sport ball, in a case where vibration is applied, a sound corresponding to the cavity resonance or a high-order mode thereof may also greatly oscillate.

In addition, the sound emitted from the sound source is oscillated with a resonance frequency of a mechanical structure of a housing of various apparatus, or a member disposed in the housing, and the volume of the resonance frequency or the frequency of the overtone thereof may increase. For example, even in a case where the sound source is a fan, a resonance sound may be generated at a rotation speed much higher than the rotation speed of the fan due to the resonance of the mechanical structure.

The structure of the invention can be used by directly attaching to a noise-generating electronic part or a motor. In addition, it can be disposed in a ventilation section such as a duct portion and a sleeve and used for sound reduction of a transmitted sound. Further, it can also be attached to a wall of a box having an opening (a box or a room containing various electronic apparatus) to be used as a sound reduction structure for noise emitted from the box. Furthermore, it can also be attached to a wall of a room to suppress a noise inside the room. It can also be used without limitation thereto.

<<Configuration Example of Soundproof Structure>>

An example of the soundproof structure according to the embodiment of the present invention will be described with reference to FIGS. 1, 2, and 3.

FIG. 1 is a schematic perspective view showing an example (hereinafter, a soundproof structure 10) of the soundproof structure according to the embodiment of the present invention. FIG. 2 is an exploded perspective view of the soundproof structure 10. FIG. 3 is a cross-sectional view taken along line I-I of the soundproof structure 10 shown in FIG. 1.

The soundproof structure 10 exhibits a sound absorbing function by using membrane vibration and selectively reduces a specific frequency sound.

Figure 2:
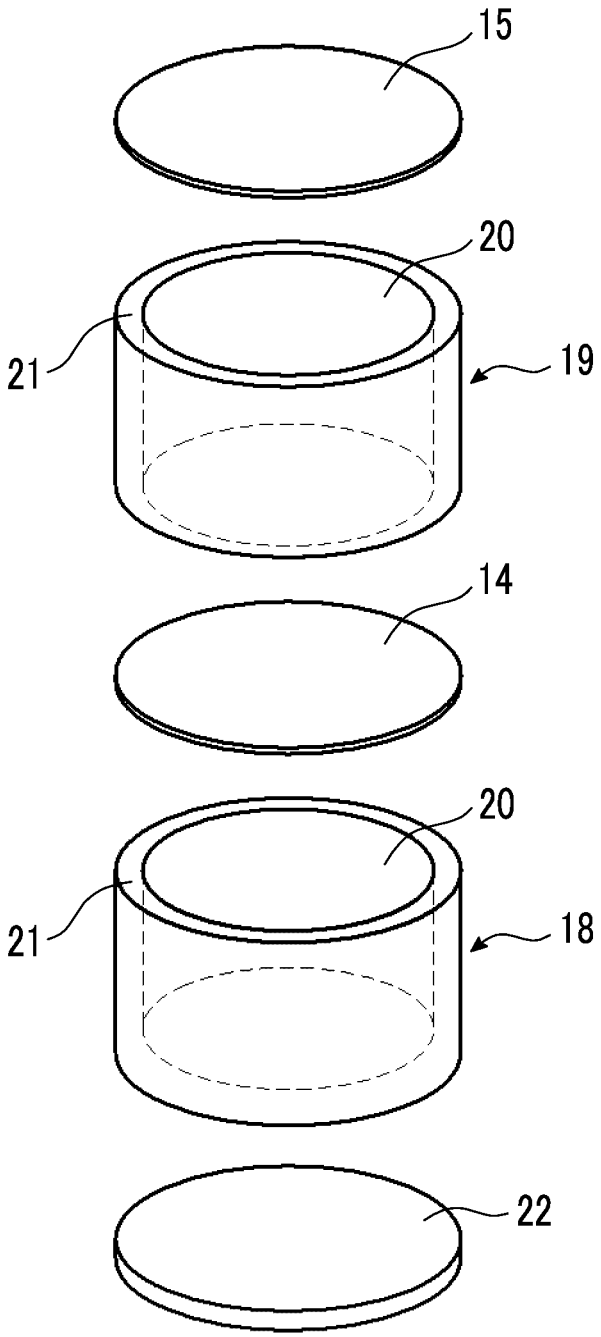
FIG. 2 is an exploded perspective view showing an example of the soundproof structure of the invention.
Figure 3:
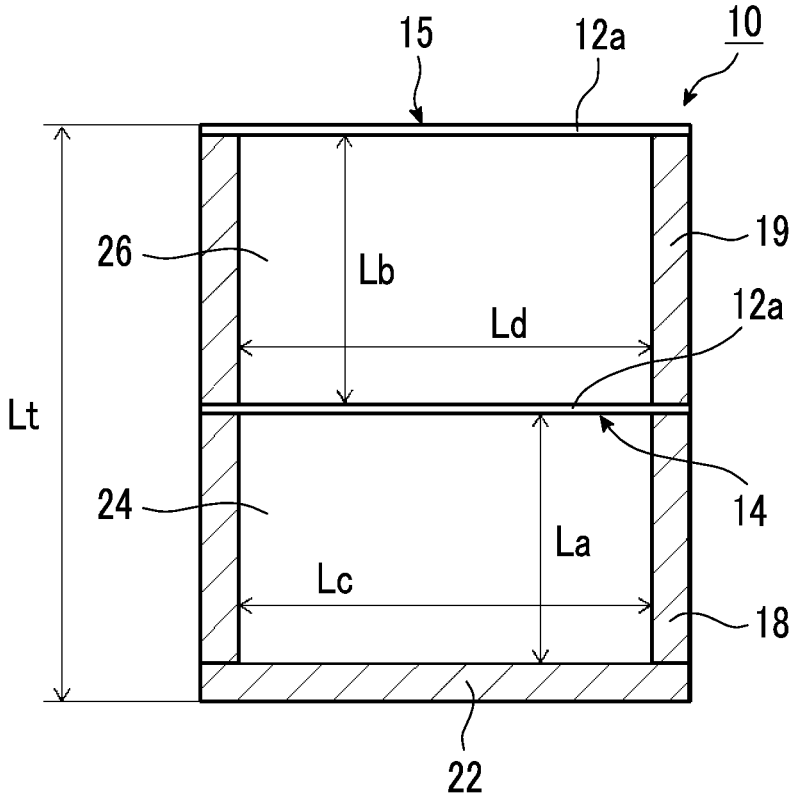
FIG. 3 is a cross-sectional view taken along line I-I of FIG. 1.

The soundproof structure 10 has a plurality of membrane-like members 12 and a support 16 as shown in FIGS. 1 to 3. The plurality of membrane-like members 12 are overlapped such that the normal direction of surfaces of each membrane-like member is aligned in a state where adjacent membrane-like members are separated from each other. Here, "overlap" means a state in which, in a case where the plurality of membrane-like members 12 are viewed from the normal direction of each surface, an overlapping region exists between one of the plurality of membrane-like members 12 and remaining membrane-like members. In other words, in a case where each of the plurality of laminated membrane-like members 12 is projected on a certain plane (virtual plane), the plurality of membrane-like members 12 overlap with each other in a case where each membrane-like member partially or entirely coincides with each other on the plane.

In addition, in the soundproof structure 10 shown in FIGS. 1 to 3, the plurality of membrane-like members 12 consist of two membrane-like members. Hereinafter, a membrane-like member located further inward is referred to as an inner membrane 14, and a membrane-like member located further outside is referred to as an outer membrane 15. Here, the inner membrane 14 corresponds to "one membrane-like member" of the present invention. In addition, the inner membrane 14 and the outer membrane 15 correspond to "two adjacent membrane-like members" of the present invention.

Each of the inner membrane 14 and the outer membrane 15 is formed of a thin membrane body having a circular outer shape as shown in FIG. 2.

The number of members constituting the plurality of membrane-like members 12 is not limited to two, but may be three or more. In addition, a shape of the membrane-like member (specifically, a shape of a membrane portion 12*a* in which the membrane vibrates among the membrane-like portions) is not particularly limited and may be, for example, a polygonal shape including a square such as a square, a rectangle, a rhombus, or a parallelogram, a triangle such as a regular triangle, an isosceles triangle, or a right triangle, a regular polygon such as a regular pentagon or a regular hexagon, an ellipse, or an indeterminate shape.

The support 16 supports each of the inner membrane 14 and the outer membrane 15 so as to perform the membrane vibration. The support 16 consists of a hollow body. An inner end of the support 16 is closed, and an outer end of the support 16 is an open end. The support 16 is divided into a plurality of cylindrical frames, and in the soundproof structure 10 shown in FIGS. 1 to 3, the support is configured with an inner frame 18 and an outer frame 19. The inner frame 18 and the outer frame 19 are overlapped in the thickness direction as shown in FIGS. 1 and 3. The inner frame 18 is made of a rigid body, and supports the inner membrane 14 by fixing an edge portion of the inner membrane 14 so as to perform the membrane vibration. The outer frame 19 is also made of a rigid body, and supports the outer membrane 15 by fixing an edge portion of the outer membrane 15 so as to perform the membrane vibration. Here, the "rigid body" is a substance which is stationary without vibrating while each of the inner membrane 14 and the outer membrane 15 is vibrating, and a substance which has a large bending stiffness (hardness) with respect to the inner membrane 14 and the outer membrane 15.

The rigid body includes a stiffness body similar to a stiffness body. That is, since the rigid body having a sufficiently large hardness with respect to the inner membrane 14 and the outer membrane 15, the stiffness body having a smaller swing width than the membrane vibration of each of the inner membrane 14 and the outer membrane 15 during sound absorption and capable of substantially ignoring the swing may be used as the frame. Specifically, in a case where an amount of displacement of the frame during sound absorption is less than about 1/100 of an amplitude of each of the inner membrane 14 and the outer membrane 15 during vibration, the frame is regarded as substantially rigid body. Here, the amount of displacement is in inverse proportion to the product of a Young's modulus (modulus of longitudinal elasticity) and a secondary moment of a cross section of a target member, and the secondary moment of the cross section is in proportion to the product of the third power of a thickness of the target member and the width of the target member. That is, assuming that the Young's modulus (unit is GPa) is denoted by E, the thickness (unit is m) is denoted by h, the width (unit is m) is denoted by w, and the value I is calculated by the following equation (1), in a case where the value I calculated for the frame exceeds about 100 times the value I calculated for each of the inner membrane 14 and the outer membrane 15, the frame can be regarded as substantially rigid body.

$$I=E\times w\times h^3 \quad (1)$$

Since the edge portions of the inner membrane 14 and the outer membrane 15 are fixed end portions and are fixed to the frame which is a rigid body, the edge portions do not vibrate. Whether or not the edge portions do not vibrate (stationary) can be confirmed by measurement using laser interference, or can be visually confirmed by observing that salt or fine particle stand still at the edge portions of the inner membrane 14 and the outer membrane 15 in a case where the inner membrane 14 and the outer membrane 15 are vibrated by scattering the white salt or fine particle on the membrane surface.

The inner frame 18 has a tubular shape, more specifically, a cylindrical shape as shown in FIG. 2, and an opening 20 consisting of a circular cavity is provided in a radial direction center portion thereof. An opening surface 21 surrounding the opening 20 is formed at an end position of the inner frame 18. The edge portion of the inner membrane 14 is fixed to the opening surface 21. Thus, the inner membrane 14 is supported by the inner frame 18 in a state where the membrane portion 12*a* can vibrate. Here, the membrane portion 12*a* is a portion of the membrane-like members that faces the opening 20 inside the fixed edge portion and vibrates for the sound absorption.

In addition, the support 16 comprises a bottom wall 22 that covers the opening 20 of the inner frame 18 on the side opposite to the opening surface 21 to which the inner membrane 14 is fixed. The inner frame 18 and the bottom wall 22 are separate bodies, and may be joined for integration, or may be constituted by the same parts and integrated from the beginning. In addition, the bottom wall 22 may be formed of a plate-like member, or may be formed of a thin member such as a film.

The outer frame 19 has a tubular shape, and more specifically, a cylindrical shape as shown in FIG. 2, and an opening 20 consisting of a circular cavity is provided in a radial direction center portion thereof. An inner diameter and outer diameter of the outer frame 19 are the same length as an inner diameter and outer diameter of the inner frame 18, respectively.

The edge portion (outer edge portion) of the outer membrane 15 is fixed to the opening surface 21 of the outer frame 19 located on the opposite side to the inner frame 18. Thereby, the outer membrane 15 is supported by the outer frame 19 in a state where the membrane portion 12*a* can vibrate. In addition, as shown in FIG. 1, the outer membrane 15 forms an outer end of the soundproof structure 10 (in other words, an end farther from a rear surface space 24 described later), and is exposed to a sound source. In a case where the outer membrane 15 forms the outer end of the soundproof structure 10 in this manner, it is possible to further reduce a size of the soundproof structure 10 in the thickness direction while exhibiting the effects of the present invention.

As shown in FIGS. 2 and 3, the soundproof structure 10 is configured by overlapping the bottom wall 22, the inner frame 18, the inner membrane 14, the outer frame 19, and the outer membrane 15 in order from the inside in the thickness direction. That is, the inner membrane 14 is at the inner end of the support 16 within the support 16. The outer membrane 15 is located at a position farthest from the inner end of the support 16 in the soundproof structure 10. Further, as shown in FIG. 3, the inner membrane 14 and the outer membrane 15 are opposed to each other via the outer frame 19 in the thickness direction.

In addition, as shown in FIG. 3, an inter-membrane space 26 is formed between the inner membrane 14 and the outer membrane 15. The inter-membrane space 26 is sandwiched between the inner membrane 14 and the outer membrane 15 in the thickness direction, and the surroundings thereof are surrounded by the outer frame 19.

Further, as shown in FIG. 3, a rear surface space 24 is formed between the inner membrane 14 and the bottom wall 22 (in other words, between the inner membrane 14 and the inner end of the support 16). The rear surface space 24 is a space surrounded by the inner membrane 14, the inner frame 18, and the bottom wall 22, and is a closed space in the example shown in FIG. 3.

In a case where a positional relationship between an end of the support 16 and the rear surface space 24 is described, as can be seen from FIG. 3, the inner end of the support 16 corresponds to an end (one end) close to the rear surface space 24 in the thickness direction, and the outer end of the support 16 corresponds to an end (the other end) farther from the rear surface space.

As shown in FIG. 1, the outer membrane 15 is fixed to the opening surface 21 at an outer end position in the outer frame 19, and covers the opening 20 of the outer frame 19. The inner membrane 14 is sandwiched between the inner frame 18 and the outer frame 19, is adjacent to the opening surface 21 at an inner end position in the outer frame 19 and covers the opening 20 of the outer frame 19. That is, the inter-membrane space 26 is the same closed space as the rear surface space 24.

In the soundproof structure 10 configured as described above, there are a plurality of sound absorbing portions, and each of the sound absorbing portions absorbs a natural frequency sound. There are a plurality of frequency bands in which the soundproof structure 10 according to the embodiment of the present invention can absorb a sound, and the frequency bands include a first sound absorption frequency band of the sound absorption mainly contributed by a first sound absorbing portion and a second sound absorption frequency band in which the second sound absorbing portion can absorb a sound.

Here, the first sound absorbing portion is a sound absorbing portion configured by the inner membrane 14, the inner frame 18, and the rear surface space 24. The first sound absorbing portion absorbs a sound of a relatively high frequency (for example, 3 kHz to 5 kHz) by the inner membrane 14 vibrating in the high-order vibration mode under a configuration in which the rear surface space 24 is a closed space (that is, a configuration in which the inner end of the support 16 is closed). That is, the first sound absorption frequency band corresponds to a sound absorption frequency band mainly caused by the membrane vibration of the inner membrane 14 in the high-order vibration mode.

In addition, the first sound absorption frequency band coincides with the sound absorption frequency band in a case where the inner membrane 14 and the outer membrane 15 (that is, two membrane-like members adjacent to each other) vibrate in the identical direction. The vibration direction of each of the inner membrane 14 and the outer membrane 15 can be directly observed by imaging the state of the membrane vibration with a high-speed camera, or the direction of the membrane vibration can be calculated and visualized by simulation.

The second sound absorbing portion is a sound absorbing portion configured by the inner membrane 14, the outer membrane 15, the outer frame 19, and the inter-membrane space 26. The second sound absorbing portion absorbs a sound in a frequency band (for example, 8 kHz to 9 kHz) higher than the first sound absorption frequency band by an interaction between an inter-membrane sound field and membrane vibration obtained by both the inner membrane 14 and the outer membrane 15 being in opposite phases to each other and performing the membrane vibration. That is, the second sound absorption frequency band is a sound absorption frequency band in a case where both the inner membrane 14 and the outer membrane 15 are in opposite phases to each other while sandwiching the inter-membrane space 26 and perform the membrane vibration.

Hereinafter, each sound absorbing portion will be described in detail.

(About First Sound Absorbing Portion)

The first sound absorbing portion selectively absorbs a sound in the first sound absorption frequency band (for example, around 3 kHz to 5 kHz). In the first sound absorbing portion, the inner membrane 14 is to vibrate under the configuration in which the rear surface space 24 is the closed space. In order to absorb a sound at a relatively high frequency side, it is desirable that a sound absorption coefficient at the frequencies in at least one high-order vibration modes existing at 1 kHz or more of the membrane vibration at that time is higher than a sound absorption coefficient at the frequency in the fundamental vibration mode. How such a configuration has been achieved will be described in detail below.

Various electronic apparatus such as copiers have sound sources such as electronic circuits and electric motors, which are noise sources, and these sound sources generate loud sounds with natural frequencies.

A porous sound absorbing body that is generally used as a sound reduction unit reduces a sound at a wide frequency. On the other hand, the sound reduction unit using the porous sound absorbing body has a problem that the noise with a natural frequency of the sound source is difficult to be sufficiently reduced, and accordingly, the noise may be audible relatively more than sounds at other frequencies. In addition, in order to reduce a louder sound using the porous sound absorbing body, it is necessary to use a large amount of the porous sound absorbing body, and it is difficult to reduce the size and weight.

In addition, as a unit for reducing a specific frequency sound more significantly, a sound reduction unit using membrane vibration is known.

Here, with a further increase in speed and output of various electronic apparatus, a frequency of noise generated by the above-described electronic circuits and electric motors has become higher. In a case of reducing a high frequency sound by the sound reduction unit using membrane vibration, it is considered to increase a natural frequency of the membrane vibration by adjusting a hardness and a size of the membrane-like member.

However, according to the study of the inventors, it is found that, in the sound reduction unit using the membrane vibration, in a case where the natural frequency of the membrane vibration is increased by adjusting the hardness and the size of the membrane, a sound absorption coefficient for a high frequency sound becomes low.

Specifically, in order to absorb a high frequency sound, it is necessary to increase the natural frequency of the membrane vibration. Here, in the sound reduction unit using a membrane vibration in the related art, a sound is absorbed mainly by using the membrane vibration in the fundamental vibration mode. In a case where using the membrane vibration in the fundamental vibration mode, it is necessary to increase a frequency (primary natural frequency) in the fundamental vibration mode by making the membrane-like member harder.

However, according to the study of the inventors, in a case where the membrane-like member is excessively hard, a sound tends to be reflected by the membrane surface. Therefore, as shown in FIG. 4, as the frequency in the fundamental vibration mode increases, the absorption of sound (sound absorption coefficient) due to the membrane vibration decreases.

As described above, as the frequency of the sound becomes higher, the force that interacts with the membrane vibration becomes smaller, but it is necessary to harden the membrane-like member itself. However, hardening the membrane-like member leads to greater reflection at the membrane surface. The sound at a high frequency needs a harder membrane-like member for resonance. Accordingly, it is considered that most of the sound is reflected by the membrane surface instead of being absorbed by the resonance vibration, so that the absorption is reduced.

Therefore, it has been clear that a large sound absorption at a high frequency is difficult with the sound reduction unit using the membrane vibration using the fundamental vibration mode based on the sound absorbing body described in JP4832245B and the design theory of the related art. These properties are not suitably used in the sound reduction of a specific sound with a high frequency.

Figure 4:
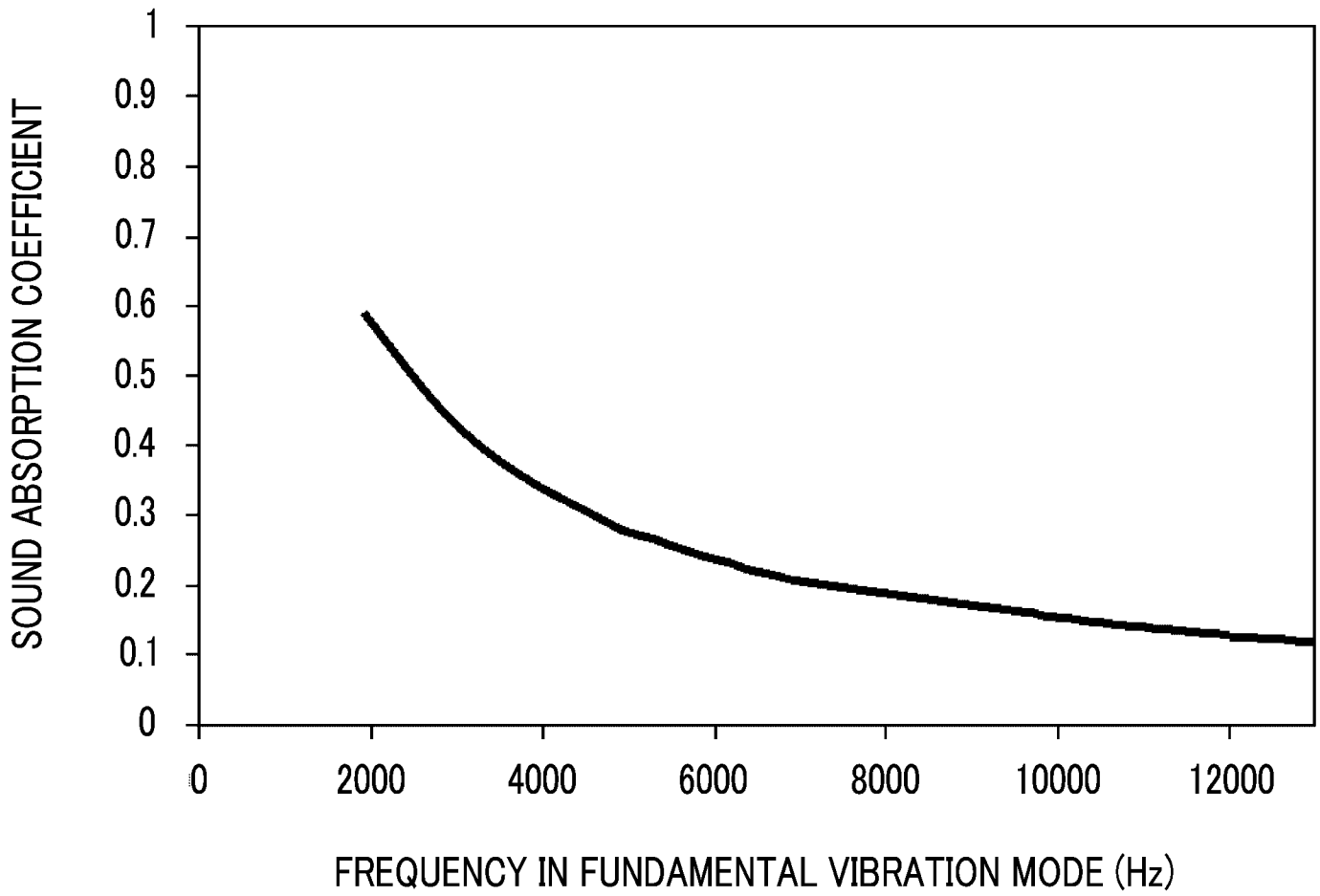
FIG. 4 is a graph showing a relationship between a frequency in a fundamental vibration mode and a sound absorption coefficient.

A graph shown in FIG. 4 is a result of a simulation performed using finite element method calculation software COMSOL ver.5.3 (COMSOL Inc.). A calculation model is a two-dimensional axially symmetric structure calculation model, a frame is set to a cylindrical shape, a diameter of an opening is set to 10 mm, and a thickness of a rear surface space is set to 20 mm. In addition, a thickness of a membrane-like member is set to 250 and a Young's modulus, which is a parameter indicating a hardness of the membrane-like member, is variously changed in a range of 0.2 GPa to 10 GPa. The evaluation is performed by employing a normal incidence sound absorption coefficient arrangement, and a maximum value of a sound absorption coefficient and a frequency at that time are calculated.

On the other hand, in the first sound absorbing portion of the soundproof structure 10 according to the embodiment of the present invention, the inner membrane 14 vibrates in the high-order vibration mode under the configuration in which the rear surface space 24 is the closed space. Then, the first sound absorbing portion has a configuration that a sound absorption coefficient of the membrane vibration of the inner membrane 14 at a frequency in at least one high-order vibration mode existing at frequencies of 1 kHz or more is higher than a sound absorption coefficient at a frequency in a fundamental vibration mode.

In other words, the first sound absorbing portion is configured to increase a sound absorption coefficient at a frequency in a high-order vibration mode, that is, a high-order natural frequency such as a second-order natural frequency and a tertiary natural frequency, and to absorb a sound by the membrane vibration in the high-order vibration mode. Accordingly, in the first sound absorbing portion, it is not necessary to make the inner membrane 14 harder (or thicker), and it is possible to suppress a sound from being reflected by the membrane surface and to obtain a high sound absorbing effect even with respect to a high frequency sound.

In addition, since the first sound absorbing portion having a single-layer membrane structure absorbs a sound using the membrane vibration, it can appropriately reduce a specific frequency sound while being small and light.

The inventors have surmised a mechanism of exciting the high-order vibration mode as follows.

There are frequency bands in a fundamental vibration mode and a high-order vibration mode determined by a thickness, a hardness, a size, a fixing method, and the like of a membrane-like member corresponding to the inner membrane 14 (hereinafter, also simply referred to as "membrane-like member"), and a thickness of the rear surface space determines which mode in which the frequency is strongly excited to contribute to the sound absorption. This will be described below.

In a case where resonance of a sound absorbing structure using the membrane-like member is considered separately, there are a portion where the membrane-like member is involved and a portion where the rear surface space is involved. Accordingly, the sound absorption occurs by an interaction between these.

In a case where an acoustic impedance of the membrane-like member is denoted by Zm and an acoustic impedance of the rear surface space is denoted by Zb in terms of mathematical expressions, a total acoustic impedance is expressed as Zt=Zm+Zb. A resonance phenomenon occurs in a case where the total acoustic impedance coincides with an acoustic impedance of a fluid (such as air). Here, the acoustic impedance Zm of the membrane-like member is determined by specification of the membrane-like member. For example, the resonance in the fundamental vibration mode occurs, in a case where a component (mass law) according to the equation of motion due to a mass of the membrane-like member, and a component (stiffness law) under the control of tension such as a spring due to the fixation of the membrane-like member coincide with each other. In the same manner as described above, in the high-order vibration mode, the resonance also occurs due to a more complicated form of the membrane vibration than the fundamental vibration.

In a case where a high-order vibration mode is less likely to occur in the membrane-like member, such as in a case where the membrane-like member has a large thickness, the band in the fundamental vibration mode becomes wider. However, as described above, the sound absorption is reduced since the membrane-like member is hard and easily reflects. Under conditions where the high-order vibration mode is likely to occur in the membrane-like member, such as by reducing the thickness of the membrane-like member, the frequency bandwidth in which the fundamental vibration mode occurs becomes smaller, and the high-order vibration mode is in a high frequency range.

On the other hand, in a case where the rear surface space is a closed space (that is, in a case where an inner end of a tubular frame surrounding the rear surface space is closed), the acoustic impedance Zb of one rear surface space is different from the impedance of the open space because the flow of the airborne sound is restricted by the closed space or the through hole portion. For example, an effect of hardening of the rear surface space is obtained, as the thickness of the rear surface space (hereinafter, it is also referred to as a rear surface distance) becomes smaller. Qualitatively, as the rear surface distance becomes shorter, it becomes a distance suitable for a sound with a shorter wavelength, that is, a high frequency sound. In this case, a sound at a lower frequency has a smaller resonance since the rear surface distance is too small with respect to the wavelength. That is, a change in rear surface distance determines which frequency sound can be resonated.

Summarizing these, it is determined in which frequency band the fundamental vibration occurs depending on the specification of the membrane-like member, and in another band, the high-order vibration occurs. The rear surface space determines which frequency band of sound is easily excited, and accordingly, by setting this to a frequency corresponding to high-order vibration, it is possible to increase the sound absorption coefficient caused by the high-order vibration mode. This is a sound absorbing mechanism of the first sound absorbing portion.

Therefore, it is necessary to determine both the membrane-like member and the rear surface space so as to excite the high-order vibration mode.

In regard to this point, a simulation is performed using an acoustic module of the finite element method calculation software COMSOL ver.5.3 (COMSOL Inc.).

The calculation model of the soundproof structure 10 will be described. A frame is set to a cylindrical shape, a diameter of an opening is set to 20 mm, a thickness of a membrane-like member is set to 50 μm, and a Young's modulus of the membrane-like member is set to 4.5 GPa which is a Young's modulus of a polyethylene terephthalate film (PET). The calculation model is a two-dimensional axially symmetric structure calculation model.

In the above calculation model, the coupled calculation of the sound and the structure is performed by changing a thickness of the rear surface space from 10 mm to 0.5 mm in increments of 0.5 mm. More specifically, the simulation is performed by calculating the structure of the membrane-like member and calculating the airborne sound in the rear surface space. The evaluation is performed in a normal incidence sound absorption coefficient arrangement, and a maximum value of a sound absorption coefficient and a frequency at that time are calculated.

Figure 5:
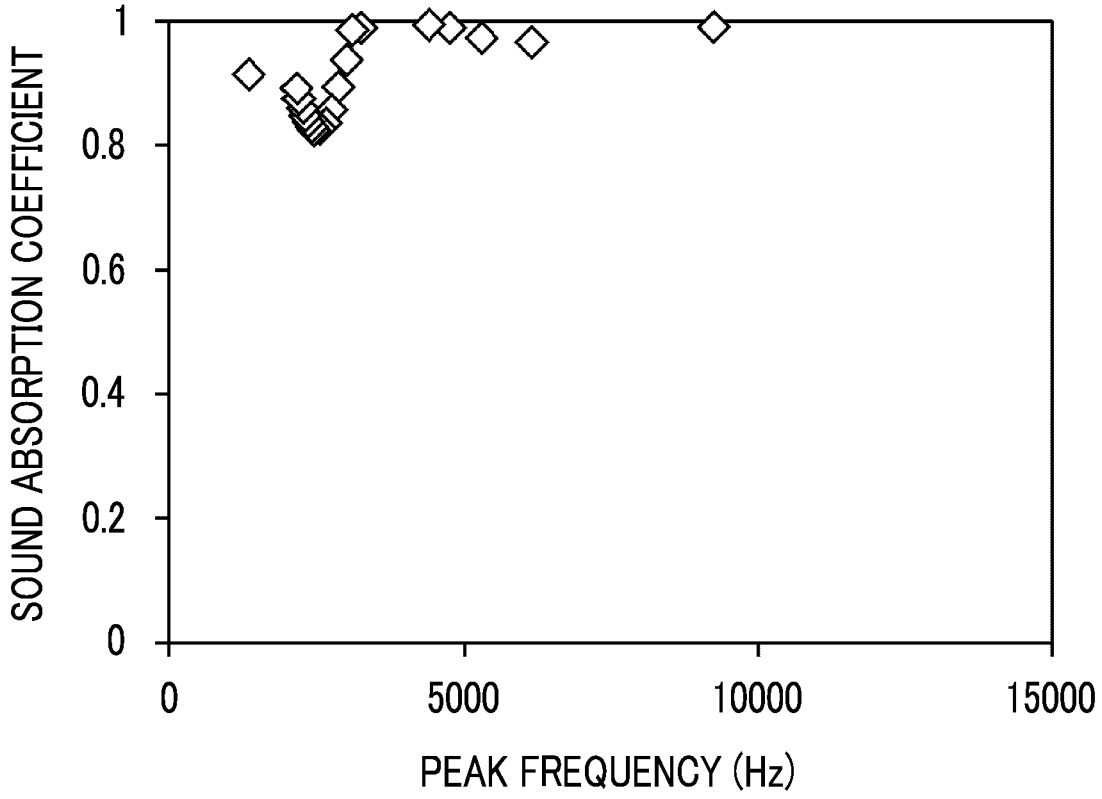
FIG. 5 is a graph showing a relationship between a peak frequency and a sound absorption coefficient.

The results thereof are shown in FIG. 5. FIG. 5 is a graph in which a frequency at which a sound absorption coefficient is maximum in each calculation model (hereinafter, referred to as a peak frequency) and a sound absorption coefficient at this peak frequency are plotted. In the drawing, the leftmost plot shows a calculated value in a case where the thickness of the rear surface space is 10 mm, as the plot goes to the right, the thickness of the rear surface space decreases by 0.5 mm. Then, the rightmost plot shows a calculated value in a case where the thickness of the rear surface space is 0.5 mm.

As shown in FIG. 5, it is found that a high absorption coefficient can be obtained even for a high frequency sound.

In addition, the order of the vibration mode of the peak frequency in each calculation model is analyzed.

Figure 6:
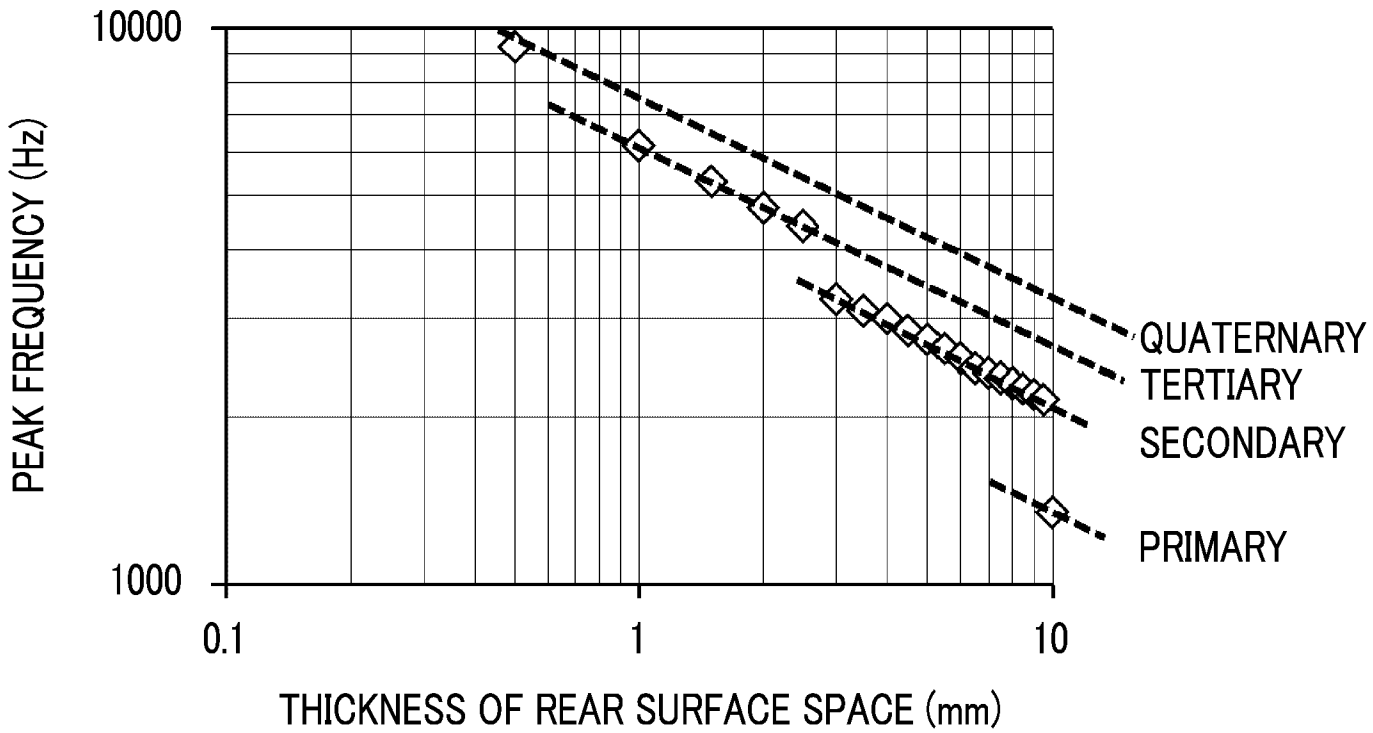
FIG. 6 is a graph showing a relationship between a thickness of a rear surface space and a peak frequency.
Figure 7:
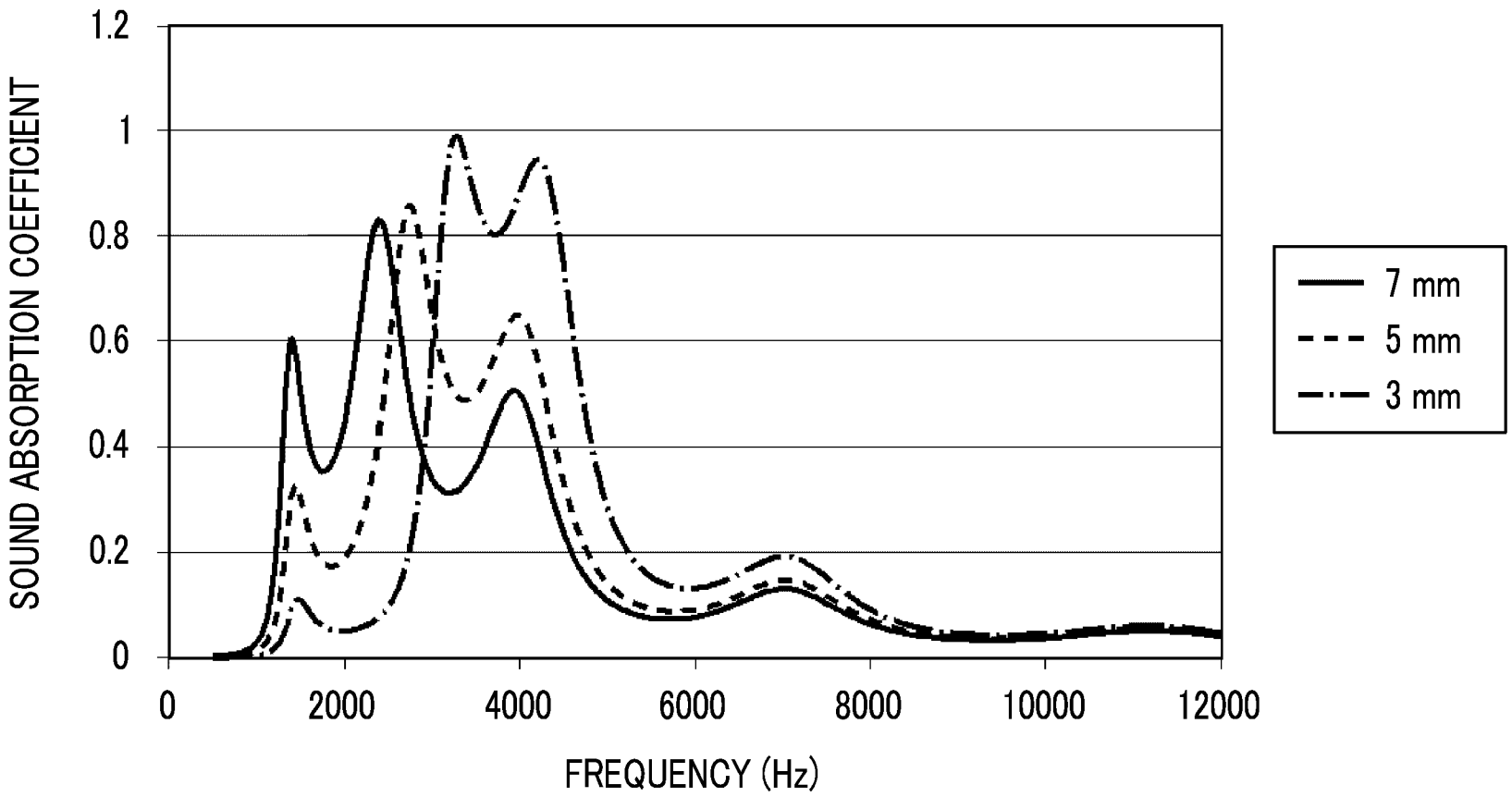
FIG. 7 is a graph showing a relationship between a frequency and a sound absorption coefficient in a calculation model (1).
Figure 8:
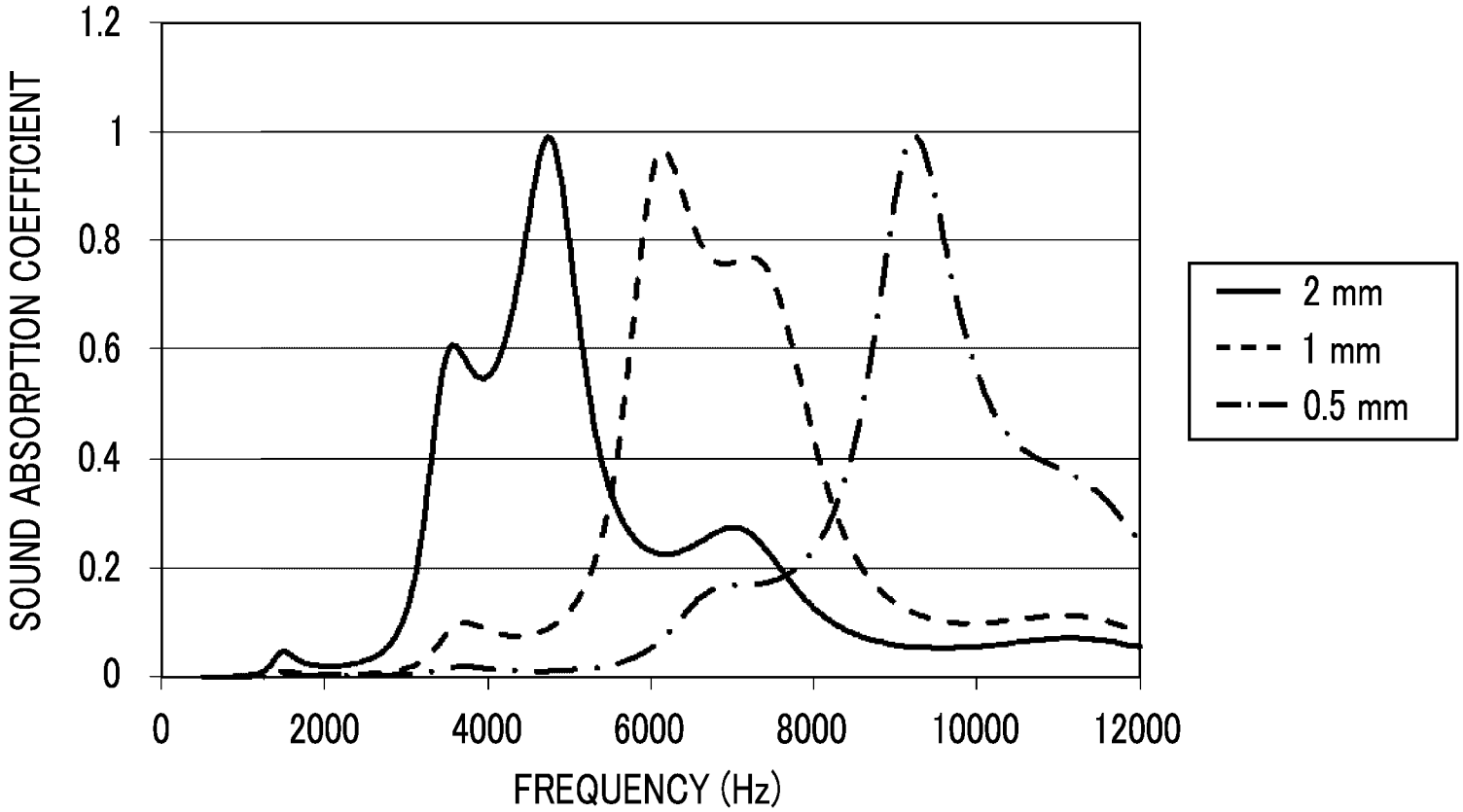
FIG. 8 is a graph showing a relationship between a frequency and a sound absorption coefficient in a calculation model (2).

FIG. 6 shows a graph in which a relationship between a peak frequency of each calculation model and a thickness of a rear surface space is plotted in a log-log graph, and a line is drawn for each order of the vibration mode. FIGS. 7 and 8 are graphs showing a relationship between a frequency and a sound absorption coefficient in each calculation model in a case where the thickness of the rear surface space is 7 mm, 5 mm, 3 mm, 2 mm, 1 mm, and 0.5 mm.

As clearly seen from FIG. 6, in a case where the thickness of the rear surface space is reduced, a peak frequency of the sound absorption coefficient is increased. Here, it is found that as the thickness of the rear surface space is reduced, the peak frequency is not continuously increased on the log-log axes, but a plurality of discontinuous changes are generated on the log-log axes. These properties indicate that the vibration mode in which the sound absorption coefficient becomes maximum shifts from the fundamental vibration mode to the high-order vibration mode or a higher-order mode of the high-order vibration mode. That is, it is found that in a state where the high-order vibration mode is easily excited by making the membrane-like member thinner and therefore softer, in a case where the thickness of the rear surface space is reduced, the effect of sound absorption by not the fundamental vibration mode but the high-order vibration mode appears greatly. Therefore, a large sound absorption coefficient in a high frequency range is not caused by the fundamental vibration mode, but is caused by resonance in the high-order vibration mode. In addition, as can be seen from a line drawn for each order of the vibration mode shown in FIG. 6, as the thickness of the rear surface space becomes thinner, the frequency in the higher-order vibration mode becomes a peak frequency, that is, a frequency in which the sound absorption coefficient is maximum.

Here, the reason why the high-order vibration mode has appeared is particularly important in that the membrane thickness of the membrane-like member is reduced to 50 The high-order vibration mode has a complicated vibration pattern on the membrane as compared with the fundamental vibration mode. That is, it has antinodes of a plurality of amplitudes on the membrane. Accordingly, in the higher-order vibration mode, it is necessary to bend in a smaller plane size as compared with the fundamental vibration mode, and there are many modes that need to bend around a membrane fixing portion (edge portion of the membrane-like member). At this time, the smaller the thickness of the membrane is, the more easily it bends. From the above, it is important to reduce the thickness (membrane thickness) of the membrane-like member in order to use the higher-order vibration mode. In addition, by reducing the rear surface distance to several mm, a system is obtained in which the sound absorption can be efficiently excited in the high-order vibration mode than in the fundamental vibration mode, which is the important point.

In addition, a configuration in which the membrane thickness is thin is a system in which the hardness of the membrane-like member is thin. In such a system, it is considered that the reflection for a sound at a high frequency is reduced, so that a large sound absorption coefficient can be obtained.

It is found from FIGS. 7 and 8 that, in each calculation model, the sound absorption coefficient has maximum values (peaks) at a plurality of frequencies. The frequency at which the sound absorption coefficient has a maximum value is a frequency in a certain vibration mode. Among these, the lowest frequency of approximately 1,500 Hz is a frequency in the fundamental vibration mode. That is, all of the calculation models have the frequency in the fundamental vibration mode as approximately 1,500 Hz. In addition, a frequency having the maximum value existing at a frequency higher than the fundamental vibration mode of 1,500 Hz is the frequency in the high-order vibration mode. In all of the calculation models, the sound absorption coefficient at the frequency in the high-order vibration mode is higher than the sound absorption coefficient at the frequency in the fundamental vibration mode.

It is found from FIGS. 7 and 8 that the thinner the thickness of the rear surface space, the lower the sound absorption coefficient at the frequency in the fundamental vibration mode, and the higher the sound absorption coefficient at the frequency in the high-order vibration mode.

In addition, it is found that in a case where the thickness of the rear surface space of FIG. 8 is 0.5 mm, a large sound absorption coefficient of almost 100% can be obtained in an extremely high frequency band of 9 kHz or higher.

It is found from FIGS. 7 and 8 that there are a plurality of high-order vibration modes, each of which has a high sound absorption peak (maximum value of the sound absorption coefficient) at each frequency. Further, in the cases shown in FIGS. 7 and 8, as a result of overlapping of the high sound absorption peaks, a sound absorbing effect can be obtained over a relatively wide band.

From the above, a higher sound absorbing effect can be obtained for a high frequency sound by adopting a configuration in which the sound absorption coefficient at the frequency in the high-order vibration mode is higher than the sound absorption coefficient at the frequency in the fundamental vibration mode.

As is well known, the fundamental vibration mode is a vibration mode that appears on the lowest frequency side, and the high-order vibration mode is a vibration mode other than the fundamental vibration mode.

Whether the vibration mode is the fundamental vibration mode or the high-order vibration mode can be determined from the state of the membrane-like member. In the membrane vibration in the fundamental vibration mode, the center of gravity of the membrane-like member has the largest amplitude, and the amplitude around a fixed end portion (edge portion) in the periphery is small. In addition, the membrane-like member has a velocity in the same direction in all regions. On the other hand, in the membrane vibration in the high-order vibration mode, the membrane-like member has a portion having a velocity in a direction opposite depending on a position.

In addition, in the fundamental vibration mode, the edge portion of the fixed membrane-like member becomes a node of vibration, and no node exists on the membrane portion 12*a*. On the other hand, in the high-order vibration mode, since there is a portion that becomes a node of vibration on the membrane portion 12*a* in addition to the edge portion (fixed end portion) according to the above definition, it can be actually measured by the method described below.

In the analysis of the vibration mode, direct observation of the vibration mode is possible by measuring the membrane vibration using laser interference. Alternatively, the position of the node is visualized by scattering white salt or fine particle on the membrane surface and vibrating the membrane surface, so that direct observation is possible even by using this method. This visualization of mode is known as the Chladni figure.

in addition, in a case of a circular membrane or a rectangular membrane, the frequency in each vibration mode can be obtained analytically. Further, in a case of using a numerical calculation method such as a finite element method calculation, the frequency in each vibration mode for any membrane shape can be obtained.

The sound absorption coefficient can be obtained by sound absorption coefficient evaluation using an acoustic tube. Specifically, the evaluation is performed by producing a measurement system for the normal incidence sound absorption coefficient based on JIS A 1405-2. The same measurement can be performed using WinZacMTX manufactured by Japan Acoustic Engineering. An inner diameter of the acoustic tube is set to 20 mm, and a soundproof structure (specifically, the soundproof structure of Examples 1 to 6, Reference Example 1, and Reference Example 2 described later) to be measured is arranged at an end portion of the acoustic tube in a state where the membrane surface faces a front side (acoustic incident side) to measure a reflectivity, and (1—reflectivity) is obtained to evaluate the sound absorption coefficient.

The smaller the diameter of the acoustic tube, the higher the frequency can be measured. In this case, the acoustic tube having a diameter of 20 mm is selected because it is necessary to measure the sound absorbing properties up to high frequencies.

In order to achieve a configuration in which the sound absorption coefficient of the vibration of the inner membrane 14 at a frequency in at least one high-order vibration mode is higher than the sound absorption coefficient at a frequency in a fundamental vibration mode, for example, the thickness of the rear surface space 24 and the thickness, hardness, density, and the like of the inner membrane 14 may be adjusted.

Specifically, the thickness of the rear surface space 24 (La in FIG. 3) is preferably 10 mm or less, more preferably 5 mm or less, even more preferably 2 mm or less, and particularly preferably 1 mm or less.

In a case where the thickness of the rear surface space 24 is not uniform, an average value may be within the above range.

The thickness of the inner membrane 14 is preferably less than 100 μm, more preferably 70 μm or less, and even more preferably 50 μm or less. In a case where the thickness of the inner membrane 14 is not uniform, an average value may be within the above range.

The Young's modulus of the inner membrane 14 is preferably from 1,000 Pa to 1,000 GPa, more preferably from 10,000 Pa to 500 GPa, and most preferably from 1 MPa to 300 GPa.

The density of the inner membrane 14 is preferably 10 $kg/m^3$ to 30,000 $kg/m^3$, more preferably 100 $kg/m^3$ to 20,000 $kg/m^3$, and most preferably 500 $kg/m^3$ to 10,000 $kg/m^3$.

The size of the membrane portion 12*a* of the inner membrane 14 (the size of the region where the membrane vibrates), in other words, the size of an opening cross section of the frame is preferably 1 mm to 100 mm, more preferably 3 mm to 70 mm, and even more preferably 5 mm to 50 mm, in terms of an equivalent circle diameter (Lc in FIG. 3).

In addition, the sound absorption coefficient at the frequency in at least one high-order vibration mode, which has a higher sound absorption coefficient than the sound absorption coefficient at the frequency in the fundamental vibration mode, is preferably 20% or more, and more preferably 30% or more, even more preferably 50% or more, particularly preferably 70% or more, and most preferably 90% or more.

In the following description, a high-order vibration mode having a higher sound absorption coefficient than the sound absorption coefficient at the frequency in the fundamental vibration mode is simply referred to as a "high-order vibration mode", and the frequency thereof is simply referred to as a "frequency in the high-order vibration mode".

In addition, it is preferable that each of sound absorption coefficients at frequencies in two or more high-order vibration modes is 20% or more.

By setting the sound absorption coefficient to be 20% or more at frequencies in a plurality of high-order vibration mode, a sound can be absorbed at a plurality of frequencies.

In addition, a vibration mode in which high-order vibration modes having sound absorption coefficients of 20% or more continuously exist is preferable. That is, for example, it is preferable that the sound absorption coefficient at the frequency in the secondary vibration mode and the sound absorption coefficient at the frequency in the tertiary vibration mode are respectively 20% or more.

Furthermore, in a case where there are continuous high-order vibration modes in which the sound absorption coefficient is 20% or more, it is preferable that the sound absorption coefficient is 20% or more in the entire band between the frequencies in these high-order vibration modes.

Accordingly, a sound absorbing effect in a wide band can be obtained.

(About Second Sound Absorbing Portion)

The second sound absorbing portion absorbs a sound in a frequency band higher than the first sound absorption frequency band as a result of obtaining an interaction between the inter-membrane space 26 (inter-membrane sound field) and the membrane vibration by the inner membrane 14 and the outer membrane 15 being in opposite phases to each other while sandwiching the inter-membrane space 26 and performing the membrane vibration.

Figure 9:
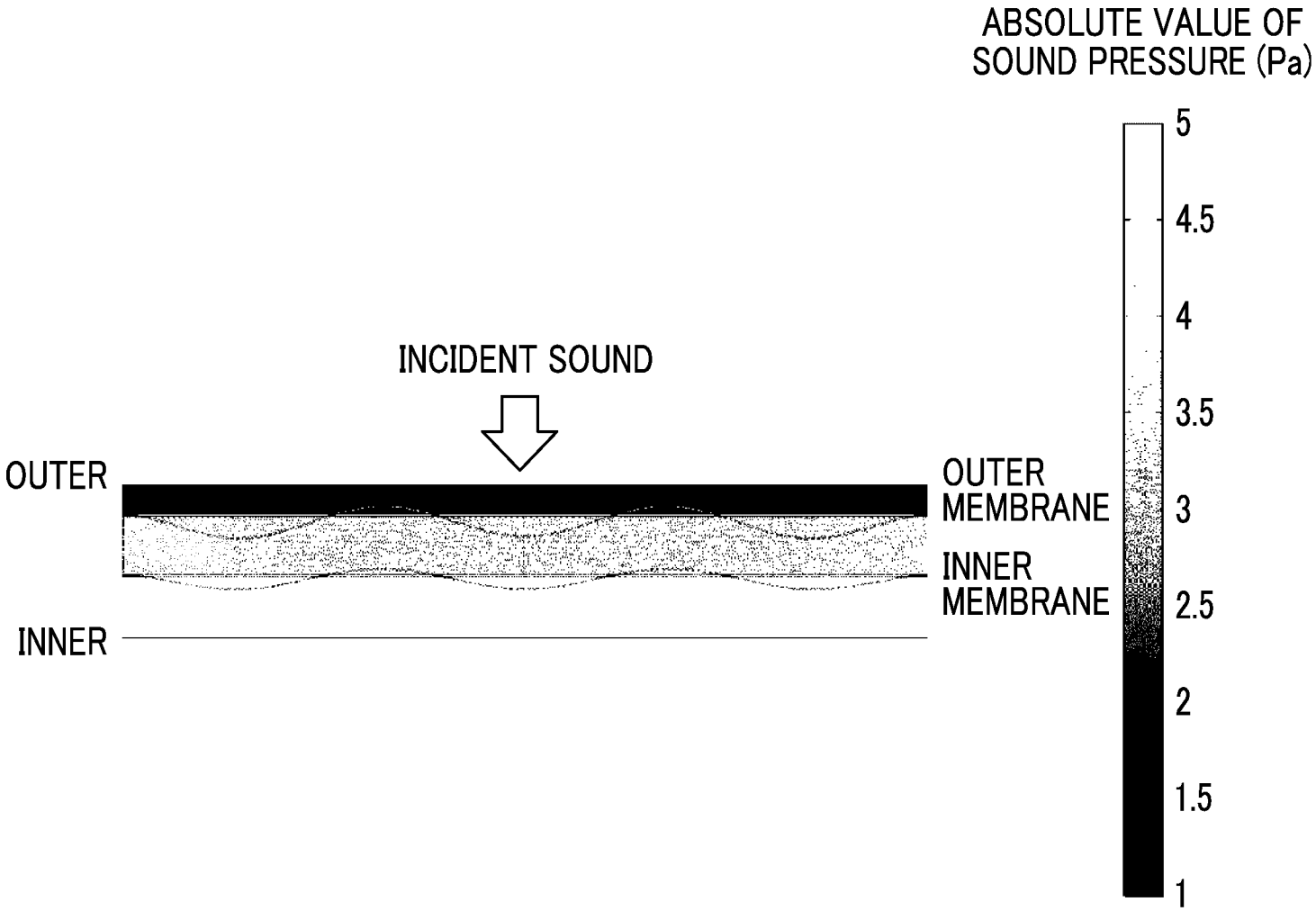
FIG. 9 is a diagram showing a relationship between a size of sound pressure and membrane vibration inside the soundproof structure of the present invention (1).

More specifically, in a case where a sound in the first sound absorption frequency band (for example, a sound around 4 kHz) is incident on the soundproof structure 10, in the second sound absorbing portion, as shown in FIG. 9, the membrane portion 12*a* of each of the inner membrane 14 and the outer membrane 15 vibrate so as to be in the same phases to each other. At this time, the soundproof structure 10 as a whole absorbs a sound by a sound absorbing mechanism (for example, a single-layer membrane resonance) similar to the first sound absorbing portion. It is found that the first sound absorption frequency band coincides with the sound absorption frequency band in a case where the inner membrane 14 and the outer membrane 15 vibrate in the same direction.

In addition, in a case where a sound in the first sound absorption frequency band is incident, the sound is absorbed as described above, and as a result, as shown in FIG. 9, the sound pressure becomes maximum in the innermost (rear surface side) region inside the soundproof structure 10.

Figure 10:
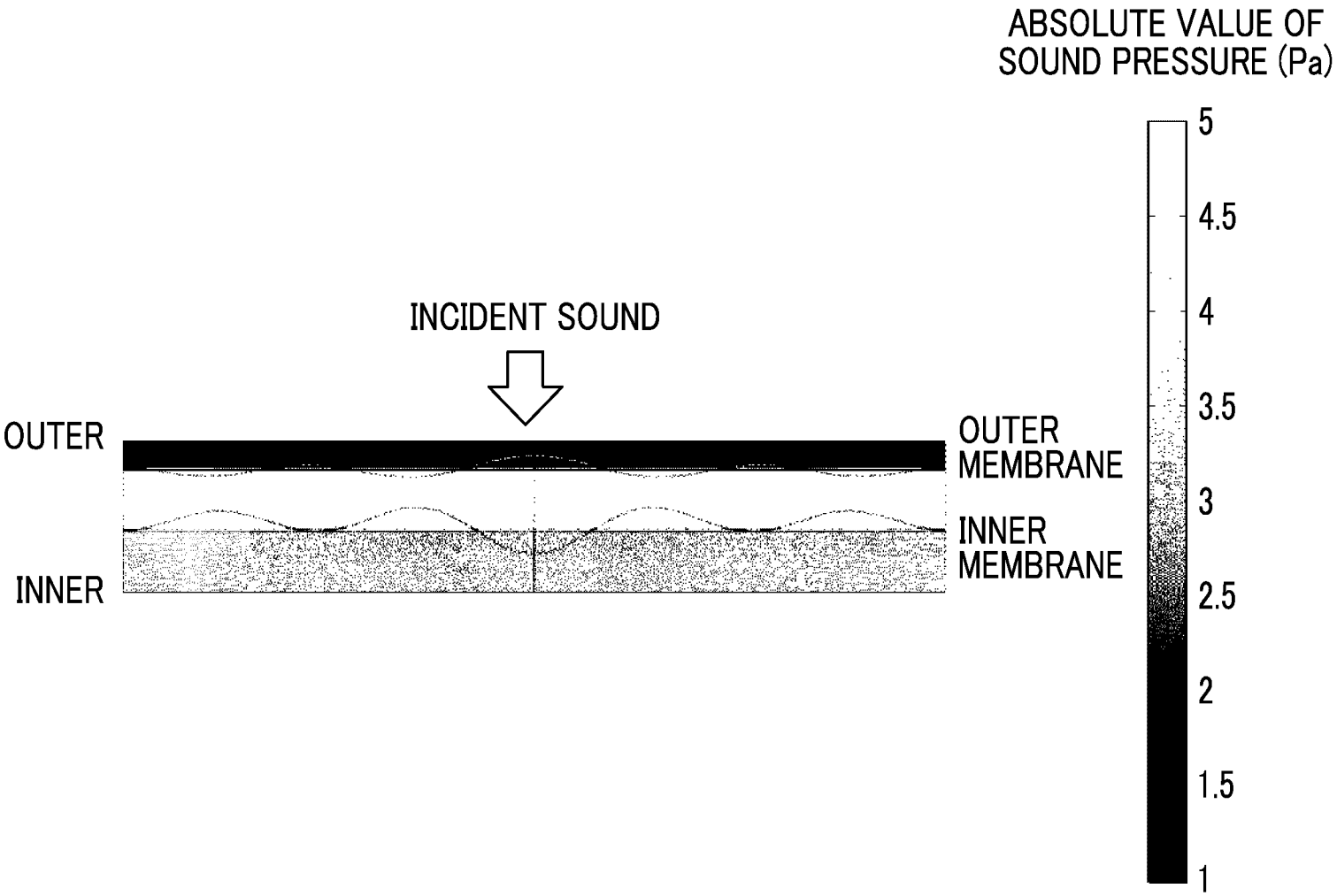
FIG. 10 is a diagram showing a relationship between a size of sound pressure and membrane vibration inside the soundproof structure of the present invention (2).

On the other hand, in a case where a higher frequency sound (for example, a sound around 9 kHz) is incident on the soundproof structure 10, in the second sound absorbing portion, as shown in FIG. 10, the respective membrane portions 12*a* of the inner membrane 14 and the outer membrane 15 vibrate so as to be in opposite phases to each other. That is, the inner membrane 14 and the outer membrane 15 vibrate in a symmetrical vibration direction at the middle position in the thickness direction of the inter-membrane space 26. The vibration direction behaves equivalent to the arrangement of the partition wall at the middle position in the thickness direction of the inter-membrane space 26, and each membrane vibrates. This is also confirmed by the local velocity distribution. According to the local velocity vector shown in FIG. 11, in the center portion of the intermediate position, the direction of the local velocity vector is only the horizontal direction in the drawing, and there is no the local velocity component in the vertical direction to the membrane. This is the same distribution as in a case where there is a rigid wall in the center portion. As a result, since the interaction can be regarded as an interaction equivalent to a membrane type resonance structure composed of each of the inner membrane 14 and the outer membrane 15 and the rear surface space having a half volume of the inter-membrane space 26, and both the inner membrane 14 and the outer membrane 15 are in opposite phases to each other and perform the membrane vibration in a high-order vibration mode. As a result, for example, in a case where the rear surface space 24 and the inter-membrane space 26 are configured with substantially the same thickness, the second sound absorbing portion behaves substantially equivalent to the membrane type resonance structure in the half rear surface space of the inter-membrane space 26. Therefore, considering that the first sound absorbing portion depends on the volume of the rear surface space 24, the second sound absorbing portion absorbs a sound at a higher frequency side than the first sound absorbing portion.

Figure 11:
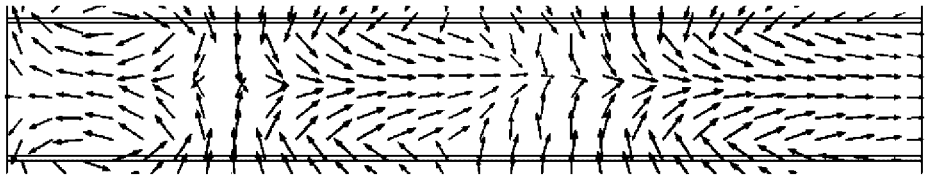
FIG. 11 is a diagram showing a distribution of a velocity vector of a sound in an inter-membrane space.

Due to the occurrence of the above-described membrane vibration, as shown in FIG. 11, the components in the thickness direction of a velocity vector of an airborne sound flowing in the inter-membrane space 26 cancel each other, and only the component in the direction orthogonal to the thickness direction remains. Thereby, the airborne sound stays in the inter-membrane space 26, and as a result, as shown in FIG. 10, the sound pressure becomes maximum in the inter-membrane space 26 in the internal space of the soundproof structure 10.

The membrane vibration shown in FIG. 10 first appears in a case where the inner membrane 14 and the outer membrane 15 are laminated and the inter-membrane space 26 is provided together with the rear surface space 24.

Incidentally, FIG. 9 visualizes a size of sound pressure in the soundproof structure 10 on which the sound around 4 kHz is incident, and FIG. 10 visualizes a size of sound pressure in the soundproof structure 10 on which the sound around 9 kHz is incident. In FIGS. 9 and 10, a size of sound pressure at each position in the soundproof structure 10 in a case where a plane wave having sound pressure of 1 Pa is incident from the upper side of the drawing is shown by black and white gradation, and the sound pressure is smaller as the color is close to black and is larger as the color is close to white. FIG. 11 visualizes the distribution of the velocity vector of the airborne sound in the inter-membrane space 26 in a case where the sound around 9 kHz is incident on the soundproof structure 10.

FIGS. 9, 10, and 11 all show the results of simulations performed using the acoustic module of the finite element method calculation software COMSOL ver. 5.3 (COMSOLInc.). Specifically, on the assumption of a drum-shaped structure in which both the inner membrane 14 and the outer membrane 15 are circular shapes and the rear surface space 24 is a closed space, a coupled analysis calculation of sound and structure is performed. At this time, a structural mechanics calculation is performed for the inner membrane 14 and the outer membrane 15, and the airborne sound is calculated for the rear surface space 24 and the inter-membrane space 26. Then, the simulation is performed in such a way that these acoustic and structural calculations are strongly coupled. The calculation model is a two-dimensional axially symmetric structure calculation model. Incidentally, FIGS. 9 and 10 show cross-sectional views of the entire structure, but FIG. 11 shows a cross-sectional view in which a left end is a side wall and a right end is an axis of symmetry of a cylindrical symmetry, that is, corresponding to half size of the entire structure.

In addition, regarding the calculation model of the soundproof structure 10, the inner frame 18 and the outer frame 19 are set as a cylindrical shape, and a diameter of the opening 20 is set to 20 mm. The thickness of each of the inner membrane 14 and the outer membrane 15 is set to 50 μm, a Young's modulus thereof is set to 4.5 GPa which is a Young's modulus of a polyethylene terephthalate (PET) film. Further, the thickness of each of the rear surface space 24 and the inter-membrane space 26 is set to 2 mm.

The evaluation is performed using a normal incidence sound absorption coefficient measurement arrangement, and the maximum value of the sound absorption coefficient and the frequency at that time are obtained by calculation.

As described above, the soundproof structure 10 according to the embodiment of the present invention can absorb a high frequency sound (for example, a sound around 4 kHz) by the inner membrane 14 vibrating in the high-order vibration mode in the first sound absorbing portion having a single-layer membrane structure.

Furthermore, in the soundproof structure 10 according to the embodiment of the present invention, the inner membrane 14 and the outer membrane 15 in the second sound absorbing portion overlapped on the first sound absorbing portion are in opposite phase to each other and perform the membrane vibration to confine the airborne sound in the inter-membrane space 26. As a result, it is possible to absorb a higher frequency sound (for example, 9 kHz). As a result, the soundproof structure 10 according to the embodiment of the present invention can absorb a sound in both the first sound absorption frequency band which is a high frequency at the same time, and the second frequency band which is a higher frequency and thus can absorb a sound over a wider band. In consideration of this point, the effectiveness of the soundproof structure 10 according to the embodiment of the present invention will be described in detail below with reference to FIGS. 12 to 14.

Figure 12:
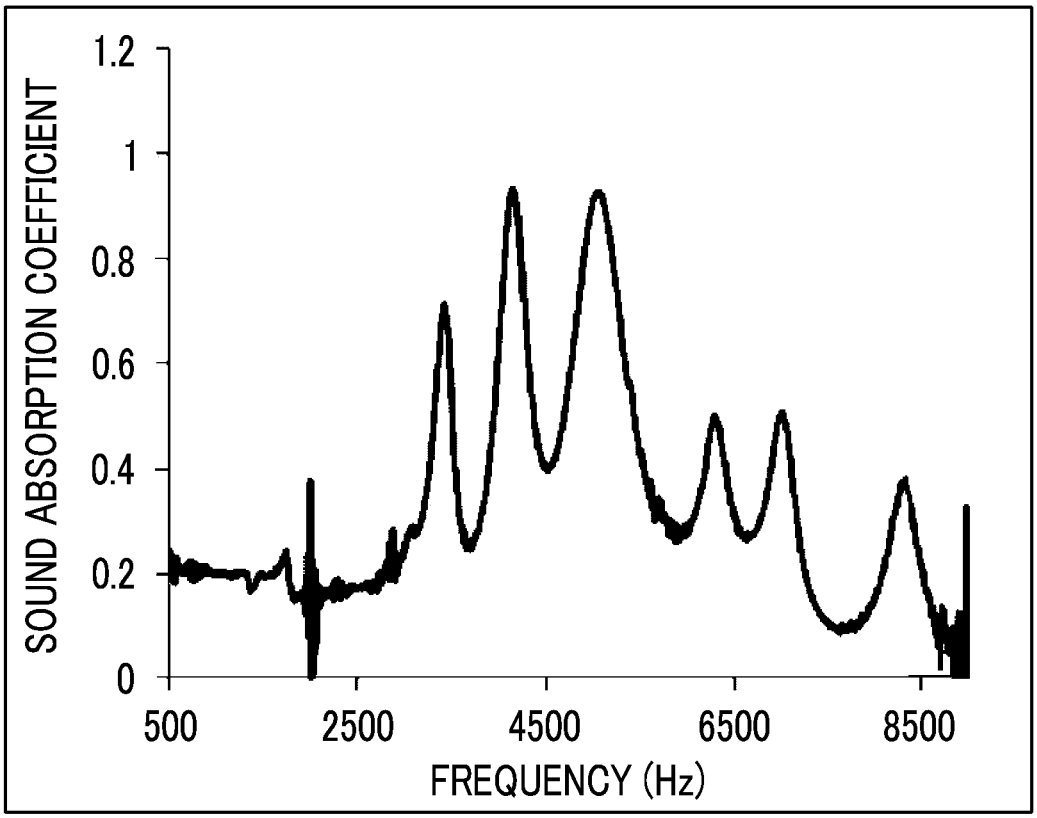
FIG. 12 is a graph showing a relationship between a frequency and a sound absorption coefficient in the soundproof structure according to Reference Example (1).
Figure 13:
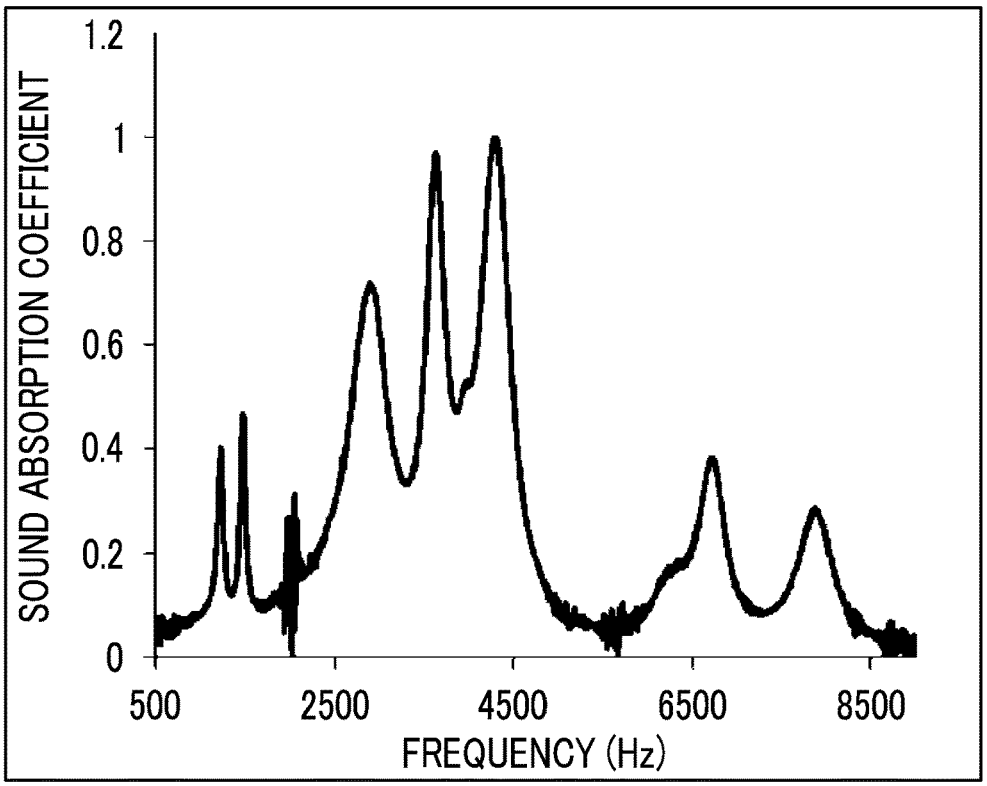
FIG. 13 is a graph showing a relationship between a frequency and a sound absorption coefficient in the soundproof structure according to Reference Example (2).
Figure 14:
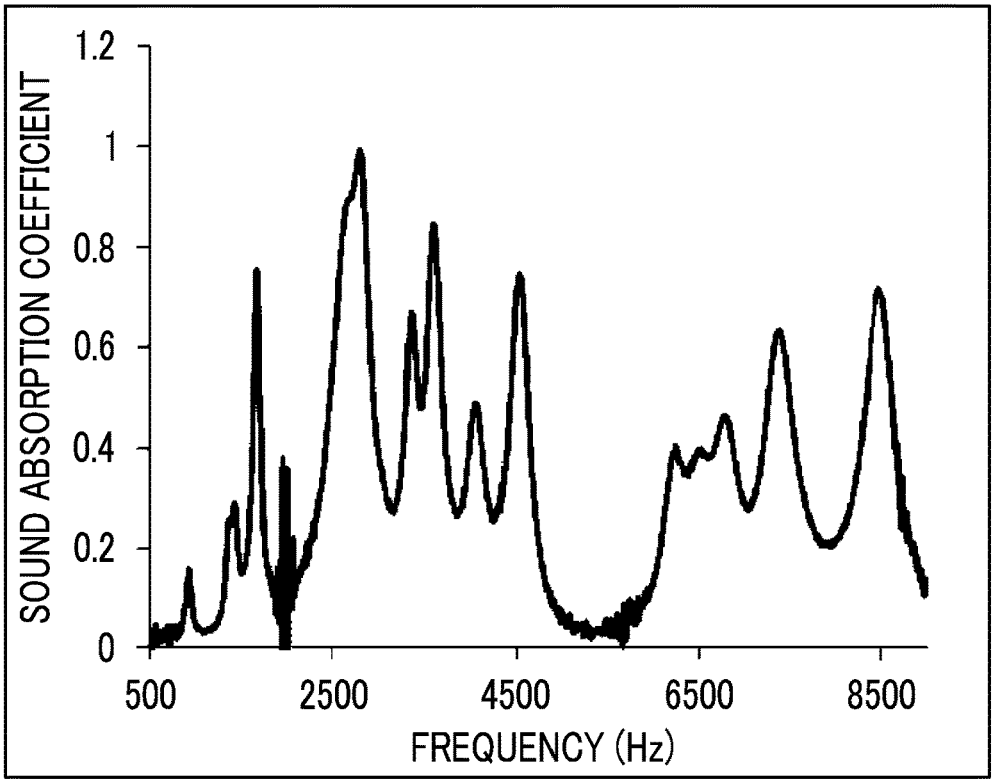
FIG. 14 is a graph showing a relationship between a frequency and a sound absorption coefficient in the soundproof structure according to an example of the present invention.

FIGS. 12 and 13 are graphs showing a relationship between the frequency and the sound absorption coefficient in a soundproof structure comprising only the first sound absorbing portion (that is, a soundproof structure consisting of only a single-layer membrane structure without the inter-membrane space 26, and hereinafter referred to as a "soundproof structure according to Reference Example"). FIG. 14 is a graph showing the relationship between the frequency and the sound absorption coefficient in the soundproof structure 10 according to an example of the present invention.

The graphs shown in each of FIGS. 12 to 14 are obtained by arranging the soundproof structure at the end portion of the acoustic tube in a state in which the membrane surface faces the front side (acoustic incident side) and measuring the normal incidence sound absorption coefficient and the frequency thereof in accordance with the acoustic tube measurement method described above.

The soundproof structure according to Reference Example has a single-layer membrane structure, and is configured with a frame and a membrane-like member. The frame is a cylindrical acrylic plate, and a diameter of an opening thereof is 20 mm. A membrane-like member consisting of a polyethylene terephthalate (PET) film having a thickness of 50 μm is fixed to an outer end (opening surface) of the frame. A rear surface space surrounded by the membrane-like member and the frame is formed on the rear surface of the membrane-like member. A rigid body, more specifically, a rear surface plate consisting of an aluminum plate having a thickness of 100 mm is pressed against a bottom (inner end) of the rear surface space. That is, in the soundproof structure according to Reference Example, the rear surface space is a closed space. In addition, the thickness of the rear surface space is 2 mm in the case shown in FIG. 12 and 4 mm in the case shown in FIG. 13.

The soundproof structure 10 according to an example of the present invention has a double-layer membrane structure, and a bottom wall 22, an inner frame 18, an inner membrane 14, an outer frame 19, and an outer membrane 15 are disposed in order from the inner side in the thickness direction. The inner frame 18 and the outer frame 19 consist of a cylindrical acrylic plate, the diameter of each opening 20 is 20 mm, and the inner membrane 14 and the outer membrane 15 are polyethylene terephthalate (PET) films having a thickness of 50 μm. The bottom wall 22 is configured with a plate member that covers the inner end of the opening 20 of the inner frame 18. That is, in the soundproof structure 10 according to an example of the present invention, the rear surface space 24 is a closed space. In addition, in the soundproof structure 10 according to an example of the present invention, the thickness of each of the rear surface space 24 and the inter-membrane space 26 is 2 mm.

The soundproof structure according to Reference Example having a single-layer membrane structure has a structure in which a sound is absorbed by vibration in a high vibration mode of the membrane-like member, and as shown in FIGS. 12 and 13, a plurality of sound absorption peaks appear in a band of 3 kHz to 5 kHz, and each peak shows a high sound absorption coefficient. On the other hand, at the sound absorption peak that appears around 8 kHz which is a higher frequency, the sound absorption coefficient is less than 50%. That is, in the soundproof structure according to Reference Example having the single-layer membrane structure, the high sound absorption coefficient is obtained by the membrane vibration in the fundamental vibration mode or the high-order vibration mode of the membrane in a specific frequency band, but the sound absorption coefficient tends to be low in the other vibration modes.

On the other hand, in the soundproof structure 10 according to an example of the present invention, as shown in FIG. 14, each of the plurality of sound absorption peaks appearing in the band of 3 kHz to 5 kHz shows a high sound absorption coefficient, and even the sound absorption peak appearing around 8.5 kHz shows a sound absorption coefficient of 70% or more. As described above, the soundproof structure 10 according to an example of the present invention can absorb a sound in a plurality of frequency bands by employing a multi-layer membrane structure at the same time.

Here, among the frequency bands that can be absorbed by the soundproof structure 10 according to an example of the present invention, the first sound absorption frequency band is, for example, 3 kHz to 5 kHz, and the second sound absorption frequency band is, for example, 8 kHz to 9 kHz. Therefore, the soundproof structure 10 according to an example of the present invention can absorb a plurality of sounds having relatively high peak frequencies such as motor sounds or inverter sounds at the same time. Since these noises often appear at a specific peak sound and an integral multiple thereof, for example, reducing a sound at 4 kHz and 8 kHz in the same time is required.

On the other hand, the sound absorbing device of JP1987-098398A (JP-S62-098398A) described above (particularly, the sound absorbing device shown in FIG. 3 of JP1987-098398A (JP-S62-098398A)) comprises the first sound absorbing portion having a first elastic body supporting a diaphragm at its rear surface, the second sound absorbing portion having the diaphragm supporting a second elastic body at its front surface, and a second elastic body supporting the diaphragm from its rear surface. In the first sound absorbing portion, the diaphragm vibrates in the fundamental vibration mode. In addition, the mass of the second sound absorbing portion (diaphragm element) is increased by incorporating the first sound absorbing portion into the diaphragm element. In a case where the mass of the second sound absorbing portion increases, the sound absorption frequency shifts to a low frequency side. That is, in the sound absorbing device described in JP1987-098398A (JP-S62-098398A), the sound absorption is performed by combining the first sound absorbing portion which is a normal sound absorbing structure using the fundamental vibration mode, and the second sound absorbing portion, which is shifted to a lower frequency side than the sound absorption frequency of the fundamental vibration mode, and a relatively low frequency sound is absorbed.

On the other hand, in the soundproof structure 10 according to the embodiment of the present invention, the frame supporting the inner membrane 14 and the outer membrane 15 is a rigid body, and as described above, it is possible to effectively absorb the higher frequency sound. In this respect, the soundproof structure 10 according to the embodiment of the present invention is superior to the sound absorbing device of JP1987-098398A (JP-S62-098398A).

The reason for the superiority of the soundproof structure 10 according to the embodiment of the present invention in comparison with the sound absorbing device of JP1987-098398A (JP-S62-098398A) will be described again in the section of "simulation 2" described later, but the simulation has revealed that the sound absorption coefficient in the high frequency band is lower in a case where the frame is configured with an elastic body such as rubber than in a case where the frame is configured with a rigid body. This also indicates that the soundproof structure 10 according to the embodiment of the present invention can effectively absorb the high frequency sound that cannot be sufficiently absorbed by the sound absorbing device of JP1987-098398A (JP-S62-098398A).

Hereinafter, the sound absorption peak appearing in the first sound absorption frequency band is referred to as a "first sound absorption peak", and the sound absorption peak appearing in the second sound absorption frequency band is referred to as a "second sound absorption peak".

In the soundproof structure 10 according to the embodiment of the present invention, the first sound absorption peak frequency can be changed by adjusting the thickness of the rear surface space 24, the thickness of the inner membrane 14, and the like. On the other hand, the second sound absorption peak frequency can be changed by adjusting the thickness of the inter-membrane space 26, the thickness of each of the inner membrane 14 and the outer membrane 15, and the like. Thus, in the soundproof structure 10 according to the embodiment of the present invention, the frequencies of the first sound absorption peak and the second sound absorption peak can be controlled independently. This makes it possible to appropriately control each sound absorption peak frequency according to a frequency of noise to be absorbed, and as a result, the sound absorption is performed efficiently.

In addition, the fact that each frequency of the first sound absorption peak and the second sound absorption peak can be independently changed is also effective for simple noise caused by vibration of a metal rod or the like. That is, in the sound absorbing device in the related art using the membrane vibration, since a frequency interval for each order is a different between the vibration mode of the membrane (resonance based on the two-dimensional vibration) and the vibration mode of the metal rod or the like (resonance based on the one-dimensional vibration), it is difficult to match the resonance peak of the membrane vibration with a plurality of frequencies with respect to the simple noise derived from the metal rod, and it is difficult to suitably absorb such simple noise. In addition, the same problem occurs in a motor, an inverter, and fan noises in which a peak noise appears for each integral multiple.

On the other hand, in a case of the soundproof structure 10 according to the embodiment of the present invention, since the sound absorption peak frequency can be appropriately changed in each sound absorption frequency band as described above, it is possible to appropriately absorb the peak noise that appears at the integral multiple even in the membrane type resonance body by setting a peak frequency suitable for absorbing the simple noise derived from the metal rod.

By the way, in order for the second sound absorbing portion to absorb a sound in a higher frequency band than the first sound absorbing portion, the thickness of the inter-membrane space 26 or the conditions (thickness, hardness, density, size of the membrane portion 12*a*, and the like) of each of the inner membrane 14 and the outer membrane 15 may be adjusted.

Specifically, the thickness (Lb in FIG. 3) of the inter-membrane space 26 is preferably 10 mm or less, more preferably 5 mm or less, even more preferably 2 mm or less, and particularly preferably 1 mm or less.

In a case where the thickness of the inter-membrane space 26 is not uniform, an average value may be within the above range.

Since the thickness, hardness, and density of the outer membrane 15 and the size (Ld in FIG. 3) of the membrane portion 12*a* are the same as those of the inner membrane 14 described above, they are set in the same numerical ranges as those of the inner membrane 14.

In addition, in a case where an average areal density of the membrane portion 12*a* is different between the inner membrane 14 and the outer membrane 15, it is desirable that an average areal density of the membrane portion 12*a* of the inner membrane 14 is larger and an average areal density of the membrane portion 12*a* of the outer membrane 15 is lower.

In addition, in a case where a reflectivity of a sound at the outer membrane 15 is increased, the sound does not reach the inner membrane 14 and is reflected at the outer membrane 15 (that is, the inner membrane 14 cannot vibrate). Therefore, in a case where properties are different between the inner membrane 14 and the outer membrane 15, it is desirable to use a membrane-like member having properties that sound is more easily transmitted as the outer membrane 15. That is, it is preferable that as for the membrane-like member used as the outer membrane 15, compared to the membrane-like member used as the inner membrane 14, a membrane having a thinner thickness, a smaller Young's modulus and a lower density, or a membrane having a larger size of the membrane portion 12*a* is used.

In addition, from a viewpoint of obtaining a sound absorbing effect in an audible range, as the frequency band in which the soundproof structure 10 can absorb a sound, the frequency band in which the sound absorption coefficient is 20% or more is preferably in a range of 0.2 kHz to 20 kHz, more preferably in a range of 0.5 kHz to 15 kHz, even more preferably in a range of 1 kHz to 12 kHz, and particularly preferably in a range of 1 kHz to 10 kHz.

In the invention, the audible range is from 20 Hz to 20000 Hz.

In addition, as described above, the sound absorption is maximized at least at the first sound absorption peak and the second sound absorption peak, but in the audible range, there is preferably at least one frequency at which the sound absorption coefficient is maximized at 2 kHz or more, more preferably at least one frequency at 4 kHz or more, even more preferably at least one frequency at 6 kHz or more, and particularly preferably at least one frequency at 8 kHz or more.

In addition, from the viewpoint of device miniaturization, a total length of the soundproof structure 10 (that is, a thickness of the thickest portion in the soundproof structure 10, and Lt in FIG. 3) is preferably 10 mm or less, more preferably 7 mm or less, and even more preferably 5 mm or less. As the total length (that is, a size in the thickness direction) of the soundproof structure 10 becomes smaller, for example, an opening ratio in a case where the soundproof structure 10 is disposed in a duct is improved, and the soundproof structure 10 can be more effectively used.

A lower limit value of the total length of the soundproof structure 10 is not particularly limited as long as the inner membrane 14 and the outer membrane 15 can be appropriately supported, but is preferably 0.1 mm or more, and more preferably 0.3 mm or more.

In addition, the inventors have studied in more detail about the mechanism by which a high-order vibration mode is excited in the soundproof structure 10.

As a result, in a case where the Young's modulus of one membrane-like member (for example, the inner membrane 14) is denoted by E (Pa), the thickness of the one membrane-like member is denoted by t (m), the thickness of the rear surface space (rear surface distance) is denoted by d (m), and the equivalent circle diameter of the region where the one membrane-like member vibrates, that is, a total circle length diameter of the opening of the frame in a case where the membrane-like member is fixed to the frame (for example, the inner frame 18) is denoted by Φ (m), the hardness of the one membrane-like member $E\times t^3$ ($Pa\cdot m^3$) is preferably denoted by $21.6\times d^{-1.25}\times\Phi^{4.15}$ or less. In addition, in a case where the coefficient a is represented as $a\times d^{-1.25}\times\Phi^{4.15}$, it is found that a smaller coefficient a is preferable, as the coefficient a is 11.1 or less, 8.4 or less, 7.4 or less, 6.3 or less, 5.0 or less, 4.2 or less, and 3.2 or less.

It is found that the hardness $E\times t^3$ ($Pa\cdot m^3$) of the one membrane-like member is preferably $2.49\times10^{-7}$ or more, more preferably $7.03\times10^{-7}$ or more, even more preferably $4.98\times10^{-6}$ or more, still more preferably $1.11\times10^{-5}$ or more, particularly preferably $3.52\times10^{-5}$ or more, and most preferably $1.40\times10^{-4}$ or more.

By setting the hardness of the one membrane-like member (hereinafter simply referred to as membrane-like member) in the above range, the high-order vibration mode can be suitably excited in the soundproof structure 10. This will be described in detail below.

First, as physical properties of the membrane-like member, in a case where the hardness of the membrane-like members and the weight of the membrane-like members coincides, it is considered that the properties of the membrane vibration are the same, even in a case where the materials, the Young's modulus, the thicknesses, and the densities are different.

The hardness of the membrane-like member is a physical property represented by (Young's modulus of the membrane-like member)×(thickness of the membrane-like member)$^3$. In addition, the weight of the membrane-like member is a physical property proportional to (density of the membrane-like member)×(thickness of the membrane-like member).

Here, the hardness of the membrane-like member corresponds to a hardness in a case where tension is set to zero, that is, a case where the membrane-like member is attached to the frame without being stretched, for example, just being placed on a base. In a case where the membrane-like member is attached to the frame while applying tension, the same properties can be obtained by correcting the Young's modulus of the membrane-like member to include the tension.

Figure 32:
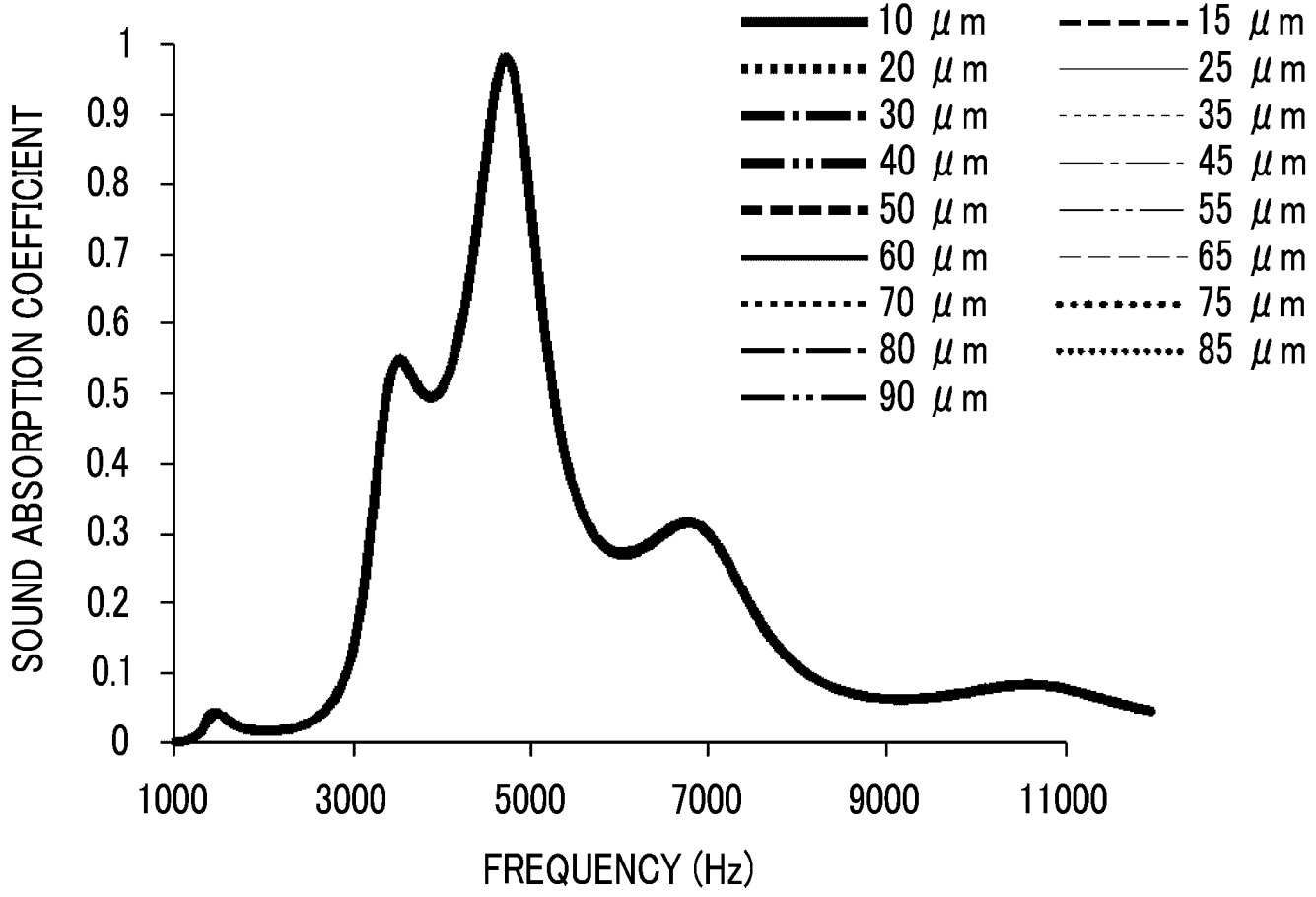
FIG. 32 is a graph showing a relationship between a frequency and a sound absorption coefficient.
Figure 33:
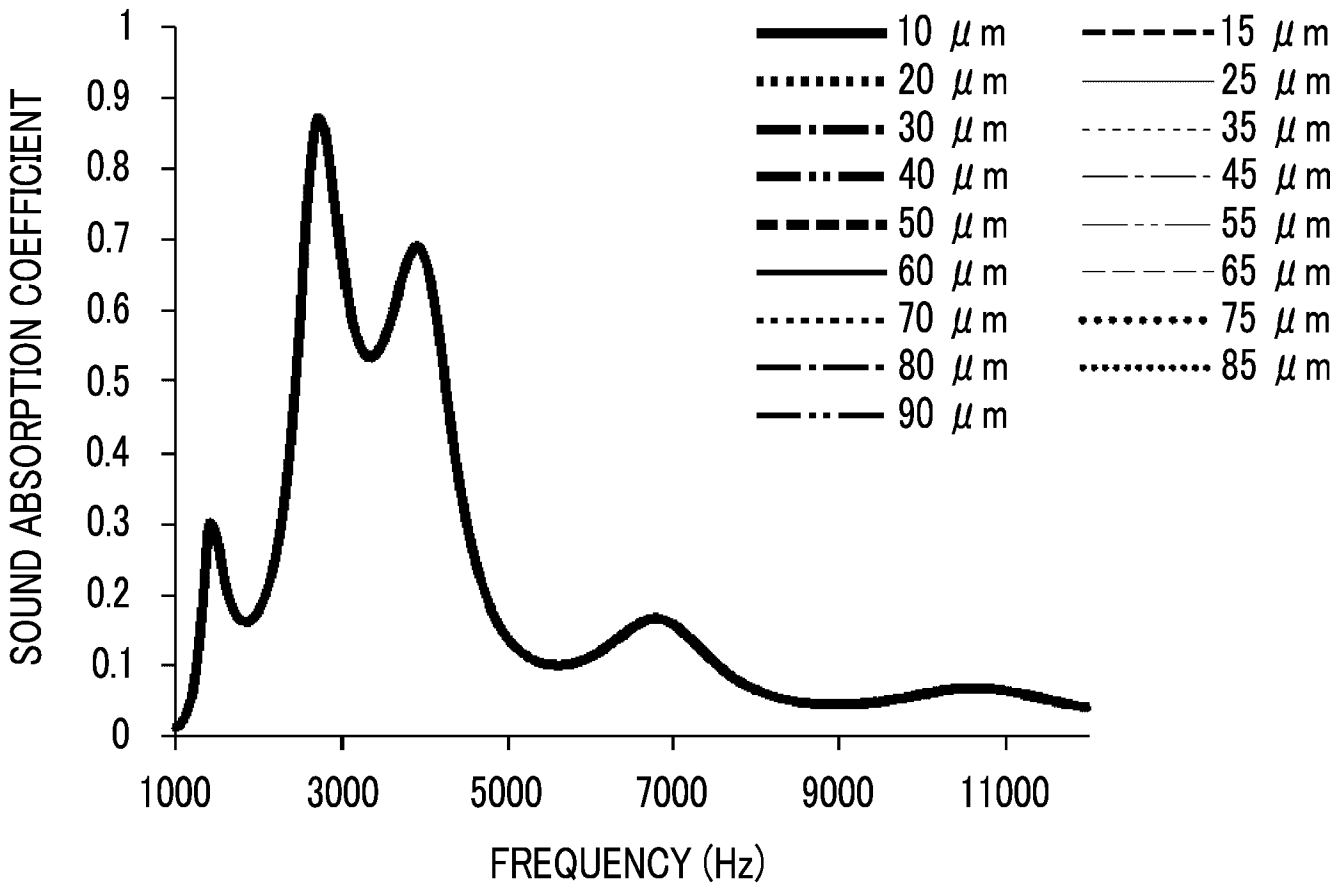
FIG. 33 is a graph showing a relationship between a frequency and a sound absorption coefficient.

FIGS. 32 and 33 show graphs showing results in which sound absorption coefficients by the soundproof structure are obtained by the simulation, in a case where the thickness of the membrane-like member is changed from 10 μm to 90 μm in increments of 5 μm, while keeping the hardness of the membrane-like member=(Young's modulus of the membrane-like member)×(thickness of the membrane-like member)$^3$ and the weight of the membrane-like member (density of the membrane-like member)×(thickness of the membrane-like member) constant. The simulation is performed using an acoustic module of the finite element method calculation software COMSOL ver.5.3 (COMSOL Inc.).

The thickness, the Young's modulus, and density of the membrane-like member are changed according to the thickness of the membrane-like member by setting the thickness of 50 μm, the Young's modulus of 4.5 GPa, and the density of 1.4 g/cm$^3$ (corresponding to a PET membrane) as references. The diameter of the opening of the frame is set to 20 mm.

FIG. 32 shows a result in a case where the rear surface distance is set to 2 mm, and FIG. 33 shows a result in a case where the rear surface distance is set to 5 mm.

As shown in FIGS. 32 and 33, it is found that the same sound absorbing performance is obtained, although the thickness of the membrane-like member is changed from 10 μm to 90 μm. That is, it is found that assuming that the hardness of the membrane-like members and the weight of the membrane-like members coincide, even in a case where the thicknesses, the Young's modulus, and the densities are different, the same properties are exhibited.

Figure 34:
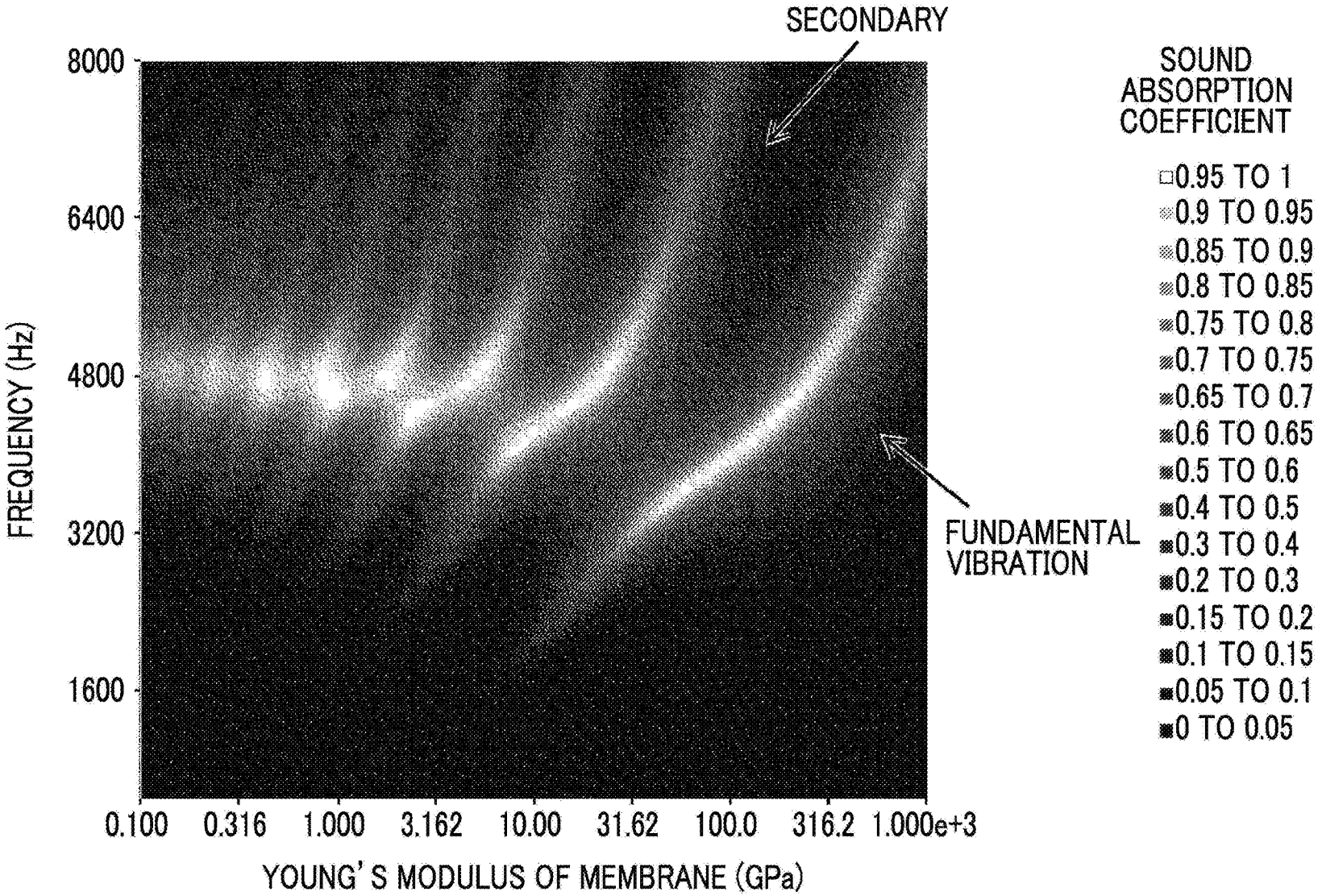
FIG. 34 is a graph showing a relationship between a Young's modulus of a membrane, a frequency, and a sound absorption coefficient.

Next, by setting the thickness of the membrane-like member as 50 μm, the density as 1.4 g/cm$^3$, the diameter of the opening of the frame as 20 mm, and the rear surface distance as 2 mm, the simulation is performed respectively by changing the Young's modulus of the membrane-like member from 100 MPa to 1000 GPa, and sound absorption coefficients are obtained. The calculation is performed by increasing an index from $10^8$ Pa to $10^{12}$ Pa in 0.05 steps. The results thereof are shown in FIG. 34. FIG. 34 is a graph showing a relationship between a Young's modulus of the membrane-like member, a frequency, and a sound absorption coefficient. This condition can be converted so that the same hardness is obtained for different thicknesses, depending on the result of the above simulation.

In the graph shown in FIG. 34, a band-like region on the rightmost side in the graph, that is, on a side where the Young's modulus is high and the sound absorption coefficient is high, is a region where the sound absorption caused by the fundamental vibration mode occurs. The fundamental vibration mode means that a low-order mode does not appear any more, and the fundamental vibration mode can be confirmed by visualizing membrane vibration in the simulation. The fundamental vibration mode can also be confirmed experimentally by measuring the membrane vibration.

A band-like region on the left side, that is, on a side where the Young's modulus of the membrane-like member is small and the sound absorption coefficient is high, is a region where the sound absorption caused by the secondary vibration mode occurs. In addition, a band-like region on the left side thereof where the sound absorption coefficient is high is a region where the sound absorption caused by the tertiary vibration mode occurs. Further, the sound absorption due to a high-order vibration mode occurs, towards the left side, that is, as the membrane-like member becomes softer.

It is found from FIG. 34 that in a case where the Young's modulus of the membrane-like member is high, that is, the membrane-like member is hard, sound absorption in the fundamental vibration mode becomes dominant, and as the membrane-like member becomes softer, sound absorption in the high-order vibration mode becomes more dominant.

Figure 35:
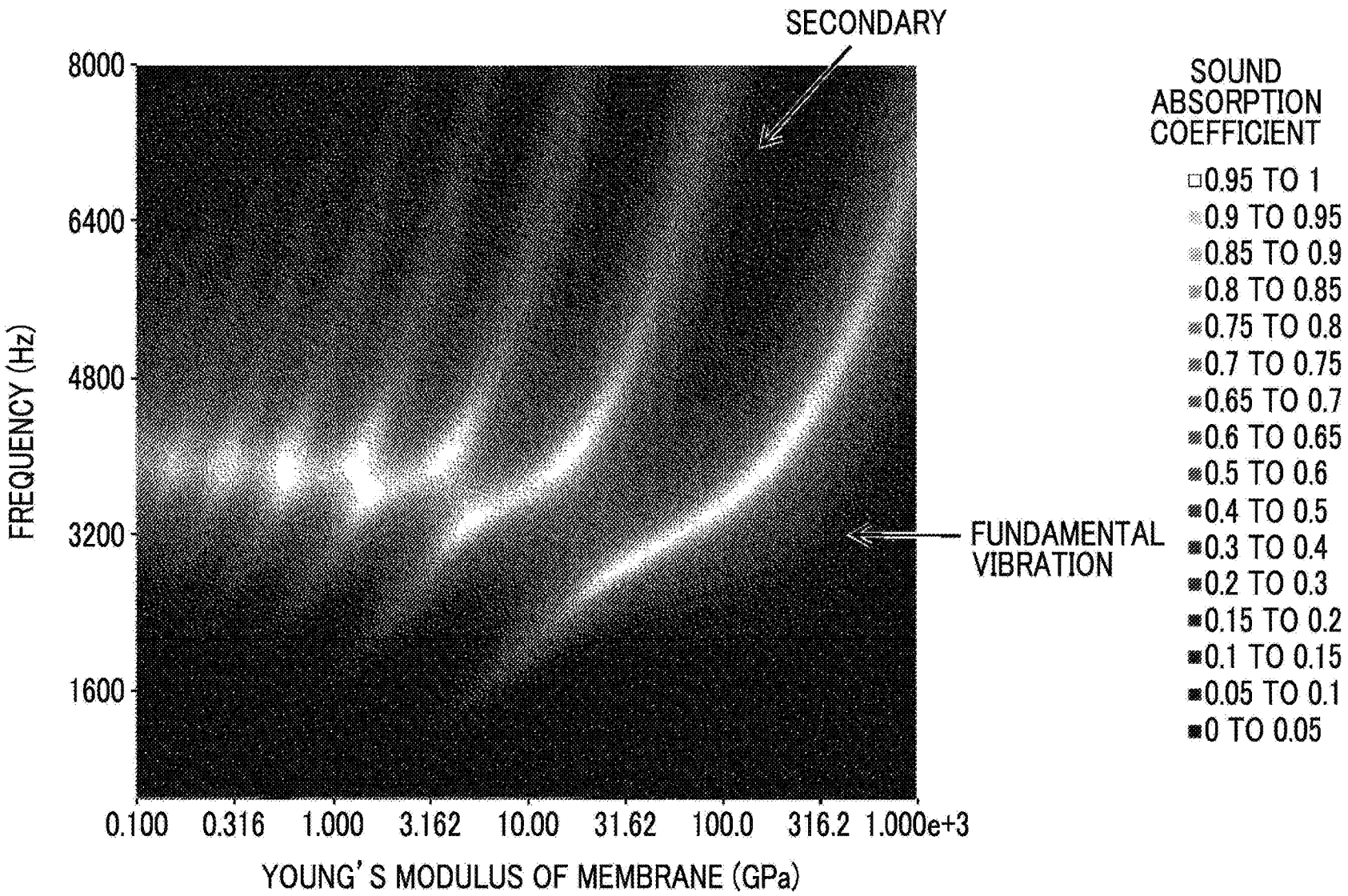
FIG. 35 is a graph showing a relationship between a Young's modulus of a membrane, a frequency, and a sound absorption coefficient.
Figure 36:
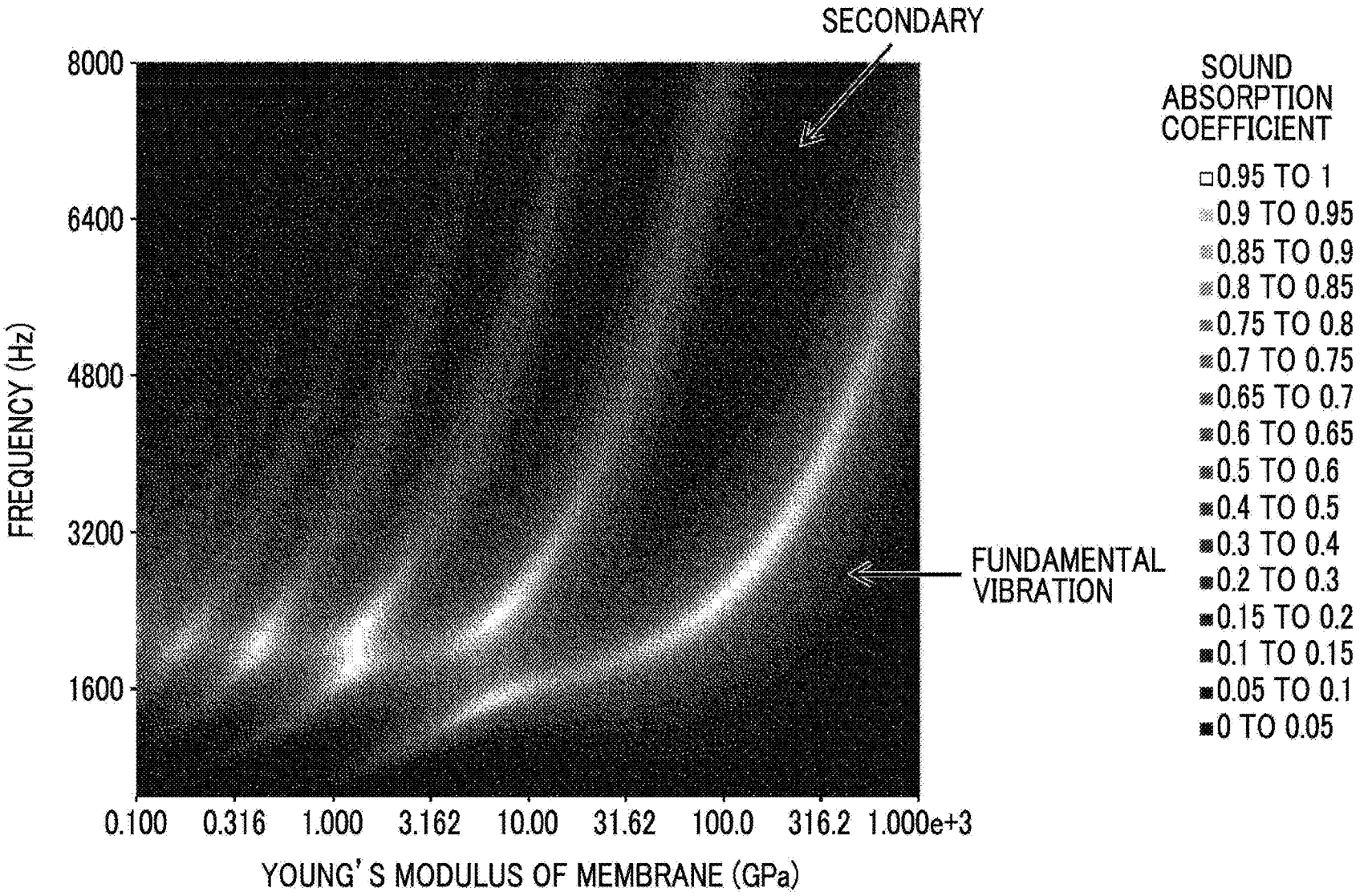
FIG. 36 is a graph showing a relationship between a Young's modulus of a membrane, a frequency, and a sound absorption coefficient.

FIGS. 35 and 36 show results in which sound absorption coefficients are obtained by performing the simulations by changing the Young's modulus of the membrane-like member in various ways in the same manner as described above except that the rear surface distance is set to 3 mm and 10 mm.

From FIGS. 35 and 36, it is also found that in a case where the membrane-like member is hard, sound absorption in the fundamental vibration mode becomes dominant, and as the membrane-like member becomes softer, sound absorption in the high-order vibration mode becomes more dominant.

It is found from FIGS. 34 to 36 that in a case of sound absorption in the fundamental vibration mode, the frequency (peak frequency) at which the sound absorption coefficient becomes highest with respect to a change in the Young's modulus of the membrane-like member easily changes. In addition, it is found that the higher the order, the smaller the change in the peak frequency even in a case where the Young's modulus of the membrane-like member changes.

Further, on the side where the hardness of the membrane-like member is small (in the range of 100 MPa to 5 GPa), even in a case where the hardness of the membrane-like member changes, the sound absorption frequency hardly changes, and the vibration mode switches to a different order vibration mode. Therefore, even in a case where the softness of the membrane greatly changes due to an environmental change or the like, it can be used without substantially changing the sound absorption frequency.

In addition, it is found that the peak sound absorption coefficient is small in the region where the membrane-like member is soft. This is because the sound absorption due to the bending of the membrane-like member becomes small, and only the mass (weight) of the membrane-like member becomes important.

In addition, it is found from the comparison in FIGS. 34 to 36 that the peak frequency decreases as the rear surface distance increases. That is, it is found that the peak frequency can be adjusted by the rear surface distance.

Here, from FIG. 34, the Young's modulus at which the sound absorption coefficient in the higher-order (secondary) vibration mode is higher than the sound absorption coefficient in the fundamental vibration mode (hereinafter, also referred to as "high-order vibration Young's modulus") is 31.6 GPa. In the same manner, from FIGS. 35 and 36, the Young's modulus at which the sound absorption coefficient in the higher-order (secondary) vibration mode is higher than the sound absorption coefficient in the fundamental vibration mode are respectively 22.4 GPa and 4.5 GPa.

In addition, in cases of the rear surface distances of 4 mm, 5 mm, 6 mm, 8 mm, and 12 mm, a simulation is performed by variously changing the Young's modulus of the membrane-like member in the same manner as described above to obtain the sound absorption coefficient, and the Young's modulus at which the sound absorption coefficient in the high-order (secondary) vibration mode is higher than the sound absorption coefficient in the fundamental vibration mode is read. The results are shown in FIG. 37 and Table 1.

Figure 37:
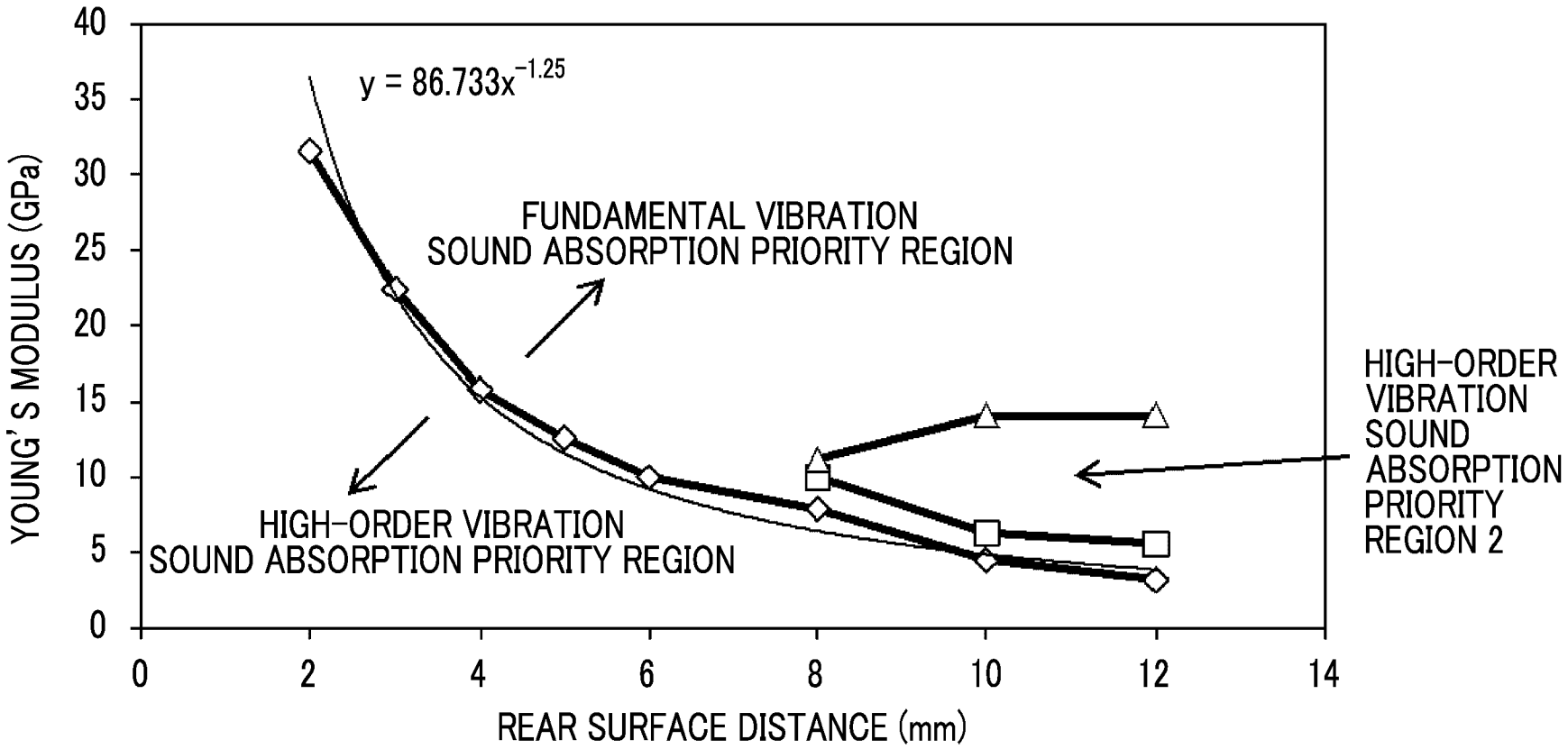
FIG. 37 is a graph showing a condition in which a sound absorption coefficient in a high-order vibration mode is higher than a sound absorption coefficient in a fundamental vibration mode, using a rear surface distance and a Young's modulus as parameters.

FIG. 37 is a graph in which the values of the rear surface distance and the Young's modulus where the sound absorption coefficient in the high-order vibration mode is higher than the sound absorption coefficient in the fundamental vibration mode are plotted. In a case where the rear surface distance is 8 mm, 10 mm, or 12 mm, the sound absorption coefficient in the fundamental vibration mode decreases as the Young's modulus of the membrane-like member decreases, but there is a region where the sound absorption coefficient once increases in a case where the sound absorption coefficient further decreases. Therefore, in a region where the Young's modulus of the membrane-like member is low, there is a region where the sound absorption coefficient in the high-order vibration mode and the sound absorption coefficient in the fundamental vibration mode are reversed again.

TABLE 1

| Rear surface distance mm | High-order vibration Young's modulus GPa | Re-inversion lower limit Young's modulus GPa | Re-inversion lower limit Young's modulus GPa |
|---|---|---|---|
| 2 | 31.6 | — | — |
| 3 | 22.4 | — | — |
| 4 | 15.8 | — | — |
| 5 | 12.6 | — | — |
| 6 | 10 | — | — |
| 8 | 7.9 | 10 | 11.2 |
| 10 | 4.5 | 6.3 | 14.1 |
| 12 | 3.2 | 5.6 | 14.1 |

In FIG. 37, a region on the lower left side of a line connecting the plotted points is a region where sound absorption in the high-order vibration mode is higher (high-order vibration sound absorption priority region), and a region on the upper right side is a region where sound absorption in the fundamental vibration mode is higher (fundamental vibration sound absorption priority region).

A boundary line between the high-order vibration sound absorption priority region and the fundamental vibration sound absorption priority region is represented by an approximate expression, $y=86.733\times x^{-1.25}$.

Figure 38:
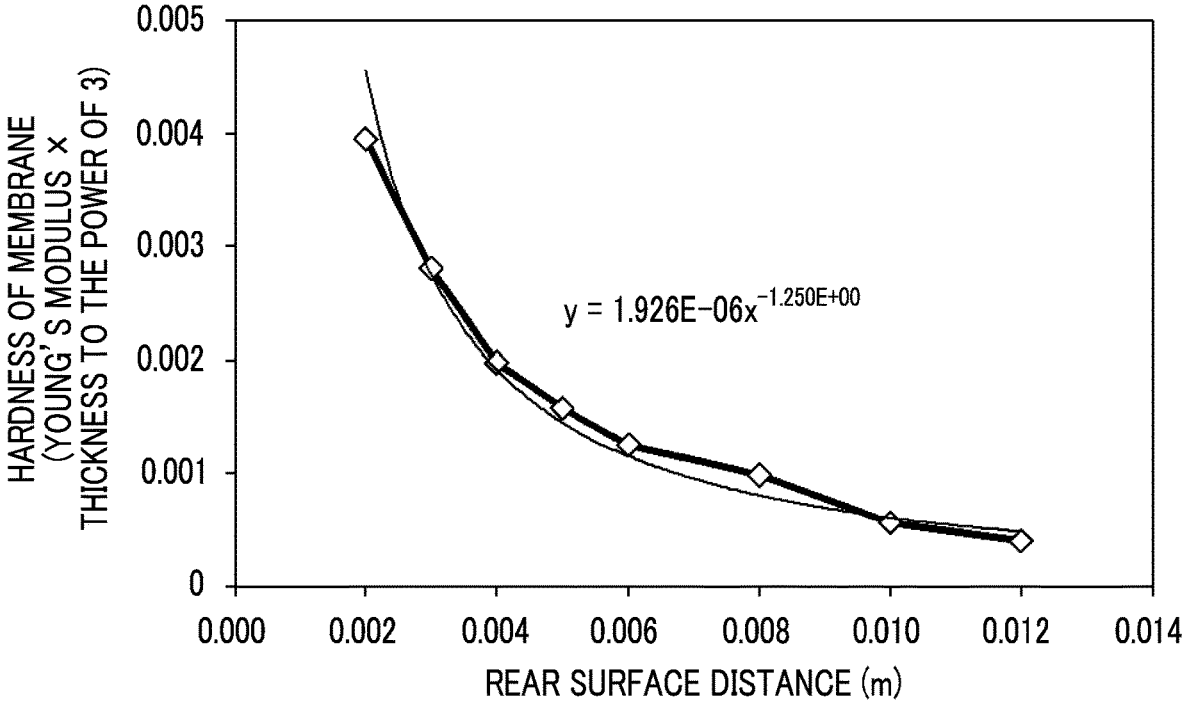
FIG. 38 is a graph showing a condition in which a sound absorption coefficient in a high-order vibration mode is higher than a sound absorption coefficient in a fundamental vibration mode, using a rear surface distance and a hardness of a membrane as parameters.

In addition, FIG. 38 shows a result of converting the graph shown in FIG. 37 into a relationship between the hardness ((Young's modulus)×(thickness)$^3$ (Pa·m$^3$)) of the membrane-like member and the rear surface distance (m). From FIG. 38, a boundary line between the high-order vibration sound absorption priority region and the fundamental vibration sound absorption priority region is represented by an approximate expression, $y=1.926\times10^{-6}\times x^{-1.25}$. That is, in order to have a configuration in which the sound absorption coefficient at the frequency in the high-order vibration mode is higher than the sound absorption coefficient at the frequency in the fundamental vibration mode, it is necessary to satisfy $y\leq1.926\times10^{-6}\times x^{-1.25}$.

In a case where the Young's modulus of the membrane-like member is denoted by E (Pa), the thickness of the membrane-like member is denoted by t (m), and the thickness of the rear surface space (rear surface distance) is denoted by d (m), the above equation is expressed as $E\times t^3$ (Pa·m$^3$)$\leq1.926\times10^{-6}\times d^{-1.25}$.

Next, the influence of the diameter of the opening of the frame (hereinafter, also referred to as the frame diameter) is examined.

In cases where the rear surface distance is 3 mm and the diameters of the opening of the frame are set as 15 mm, 20 mm, 25 mm, and 30 mm, the simulation is performed by variously changing the Young's modulus of the membrane-like member in the same manner as described above, and the sound absorption coefficient is calculated, and a graph as shown in FIG. 34 is obtained. From the obtained graph, the Young's modulus at which the sound absorption coefficient in the high-order vibration mode is higher than the sound absorption coefficient in the fundamental vibration mode is read.

Figure 39:
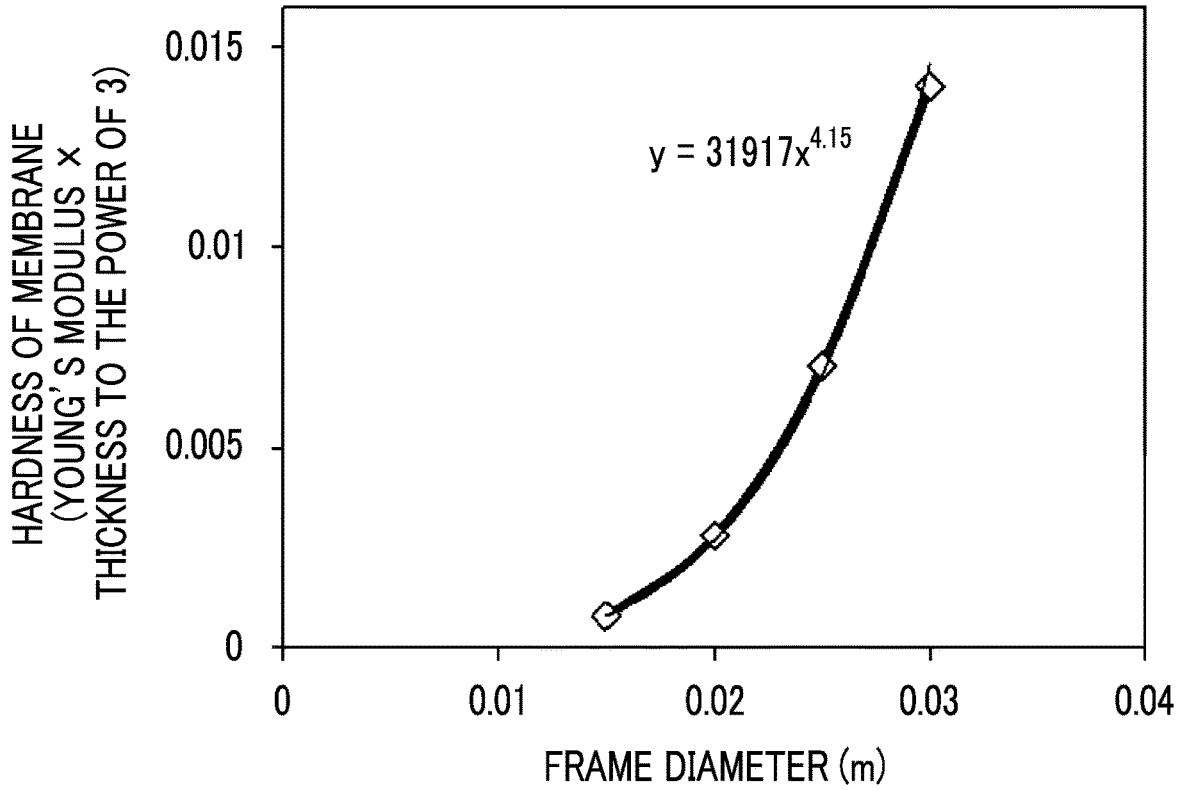
FIG. 39 is a graph showing a condition in which a sound absorption coefficient in a high-order vibration mode is higher than a sound absorption coefficient in a fundamental vibration mode, using a frame diameter and a hardness of a membrane as parameters.

The Young's modulus is converted into the hardness (Pa·m$^3$) of the membrane-like member, and the graph of the frame diameter (m) and the hardness of the membrane-like member shows points plotted where sound absorption coefficient in the high-order vibration mode is higher than the sound absorption coefficient in the fundamental vibration mode. The results thereof are shown in FIG. 39. In FIG. 39, a line connecting the plotted points is represented by an approximate expression, $y=31917\times x^{4.15}$.

Figure 40:
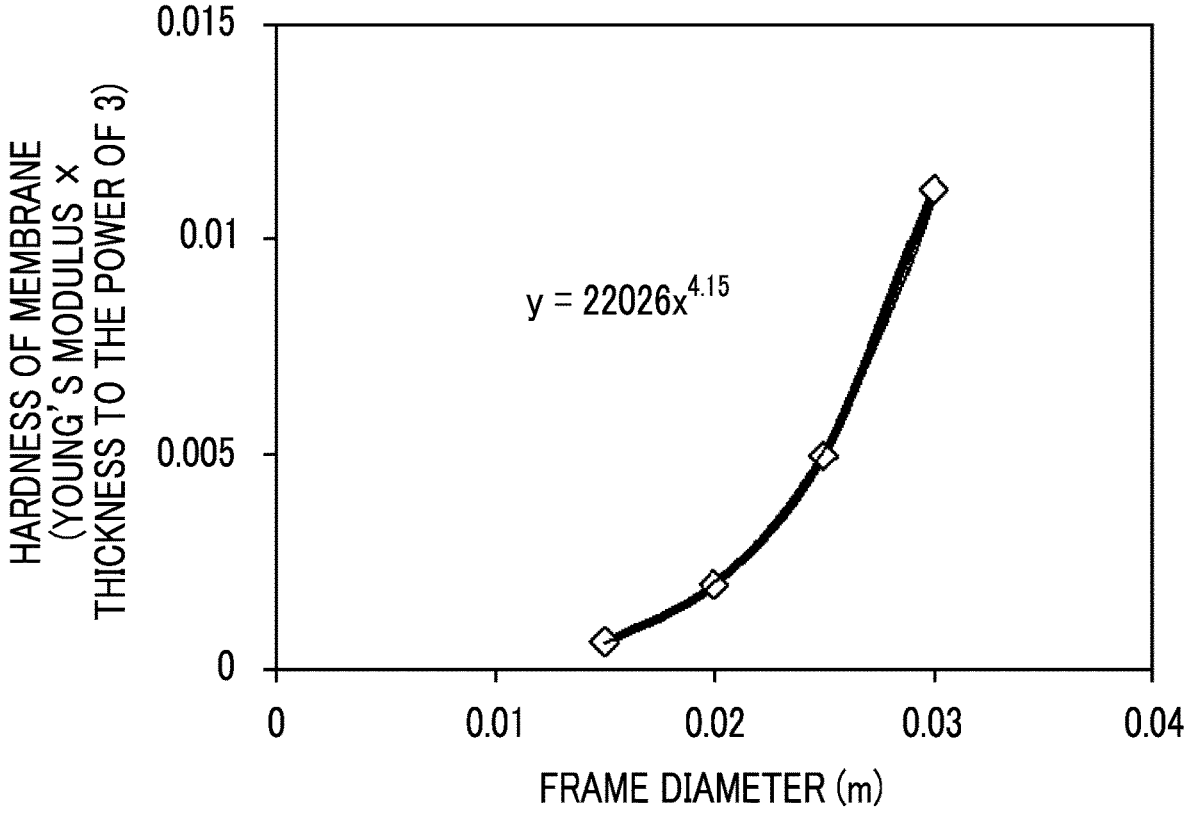
FIG. 40 is a graph showing a condition in which a sound absorption coefficient in a high-order vibration mode is higher than a sound absorption coefficient in a fundamental vibration mode, using a frame diameter and a hardness of a membrane as parameters.

The simulation is performed in the same manner for the case where the rear surface distance is 4 mm, and a graph plotting points where the sound absorption coefficient in the high-order vibration mode is higher than the sound absorption coefficient in the fundamental vibration mode is obtained. The results thereof are shown in FIG. 40. In FIG. 40, a line connecting the plotted points is represented by an approximate expression, $y=22026\times x^{4.15}$.

The same simulations are performed for other rear surface distances to obtain an approximate equation representing the boundary line between the high-order vibration sound absorption priority region and the fundamental vibration sound absorption priority region. In this case, the coefficients are different, but the index applied to the variable x is constant as 4.15.

The relational expression $E\times t^3$(Pa·m$^3$)$\leq1.926\times10^{-6}\times d^{-1.25}$ between the hardness (Pa·m$^3$) of the membrane-like member and the rear surface distance (m) obtained above is obtained in a case where the frame diameter is 20 mm, and accordingly, in a case where the frame diameter Φ(m) is incorporated as a variable in this equation using the frame diameter of 20 mm as a reference, $E\times t^3$ (Pa·m$^3$)$\leq1.926\times10^{-6}\times d^{-1.25}\times(\Phi/0.02)^{4.15}$ is obtained. Summarizing this, $E\times t^3$ (Pa·m$^3$)$\leq21.6\times d^{-1.25}\times\Phi^{4.15}$.

That is, by setting the hardness $E\times t^3$ (Pa·m$^3$) of the membrane-like member to be $21.6\times d^{-1.25}\times\Phi^{4.15}$ or less, the sound absorption coefficient in the high-order vibration mode can be higher than the sound absorption coefficient in the fundamental vibration mode.

The frame diameter Φ is a diameter of the opening of the frame, that is, a diameter of the region where the membrane-like member vibrates. In a case where the shape of the opening is other than a circle, the equivalent circle diameter may be used as Φ.

Here, the equivalent circle diameter can be obtained by calculating the area of the membrane vibrating portion region and calculating a diameter of a circle having the same area as the area.

From the above results, in a case where the high-order vibration mode of the membrane-like member is used, a resonance frequency (sound absorption peak frequency) thereof is substantially determined by the size and rear surface distance of the membrane-like member, and it is found that even in a case where the hardness (Young's modulus) of the membrane changes due to a change in the surrounding environment, a change width of the resonance frequency is small, and the robustness against the environmental change is high.

Next, the density of the membrane-like member is examined.

By setting the density of the membrane-like member as 2.8 g/cm$^3$, thickness of the membrane-like member as 50 μm, the diameter of the opening of the frame as 20 mm, and the rear surface distance as 2 mm, the simulation is performed respectively by changing the Young's modulus of the membrane-like member from 100 MPa to 1000 GPa, and sound absorption coefficients are obtained. The results thereof are shown in FIG. 41.

Figure 41:
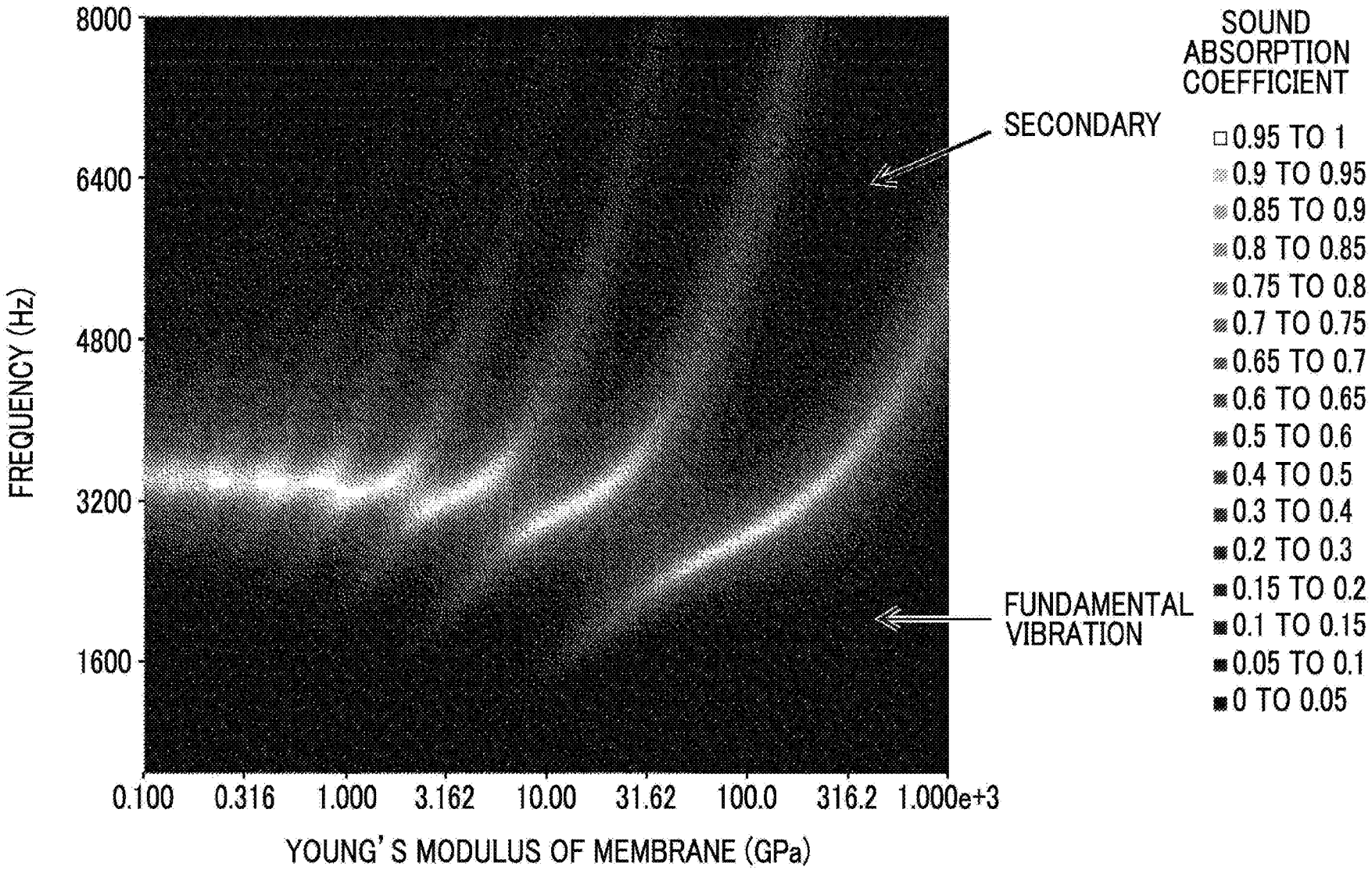
FIG. 41 is a graph showing a relationship between a Young's modulus of a membrane, a frequency, and a sound absorption coefficient.

It is found from FIG. 41 that the sound absorption in the fundamental vibration mode is dominant in a region where the Young's modulus of the membrane-like member is large, and the sound absorption frequency thereof is highly dependent on the hardness of the membrane. In addition, it is found that in the region where the Young's modulus of one of the membrane-like members is small, the sound absorption frequency hardly changes, even in a case where the hardness of the membrane changes.

From the comparison between FIG. 41 and FIG. 34 in which only the density of the membrane-like member is different, it is found that the frequency in the region where the membrane is soft is shifted to the low frequency side, by increasing the density of the membrane-like member, that is, by increasing the mass of the membrane-like member. The frequency of the simulation shown in FIG. 34 is 3.4 kHz, and the frequency of the simulation shown in FIG. 41 is 4.9 kHz.

From FIG. 41, the Young's modulus at which the sound absorption coefficient in the high-order vibration mode is higher than the sound absorption coefficient in the fundamental vibration mode is 31.6 GPa. This value is the same as the result of FIG. 34 in which only the density of the membrane-like member is different. Therefore, it is found that although the frequency changes depending on the mass of the membrane-like member, the hardness of the membrane in which sound absorption in the high-order vibration mode is higher than sound absorption in the fundamental vibration mode does not depend on the mass of the membrane.

The simulation is performed in the same manner as the simulation shown in FIG. 41, except that the rear surface distances are changed to 3 mm, 4 mm, and 5 mm, and the Young's modulus at which the sound absorption coefficient in the high-order vibration mode is higher than the sound absorption coefficient in the fundamental vibration mode is obtained. The results thereof are shown in Table 2.

TABLE 2

| Rear surface distance mm | High-order vibration Young's modulus GPa |
|---|---|
| 2 | 31.6 |
| 3 | 22.4 |
| 4 | 15.8 |
| 5 | 12.6 |

From the comparison between Table 2 and Table 1, it is found that even assuming that the mass of the membrane-like member is different, in a case where the rear surface distance is as small as 2 mm to 5 mm, the high-order vibration Young's modulus does not change without depending on the mass of the membrane-like member.

In addition, by setting the density of the membrane-like member as 4.2 g/cm$^3$, thickness of the membrane-like member as 50 μm, the diameter of the opening of the frame as 20 mm, and the rear surface distance as 2 mm, the simulation is performed respectively by changing the Young's modulus of the membrane-like member from 100 MPa to 1000 GPa, and sound absorption coefficients are obtained. The results thereof are shown in FIG. 42.

Figure 42:
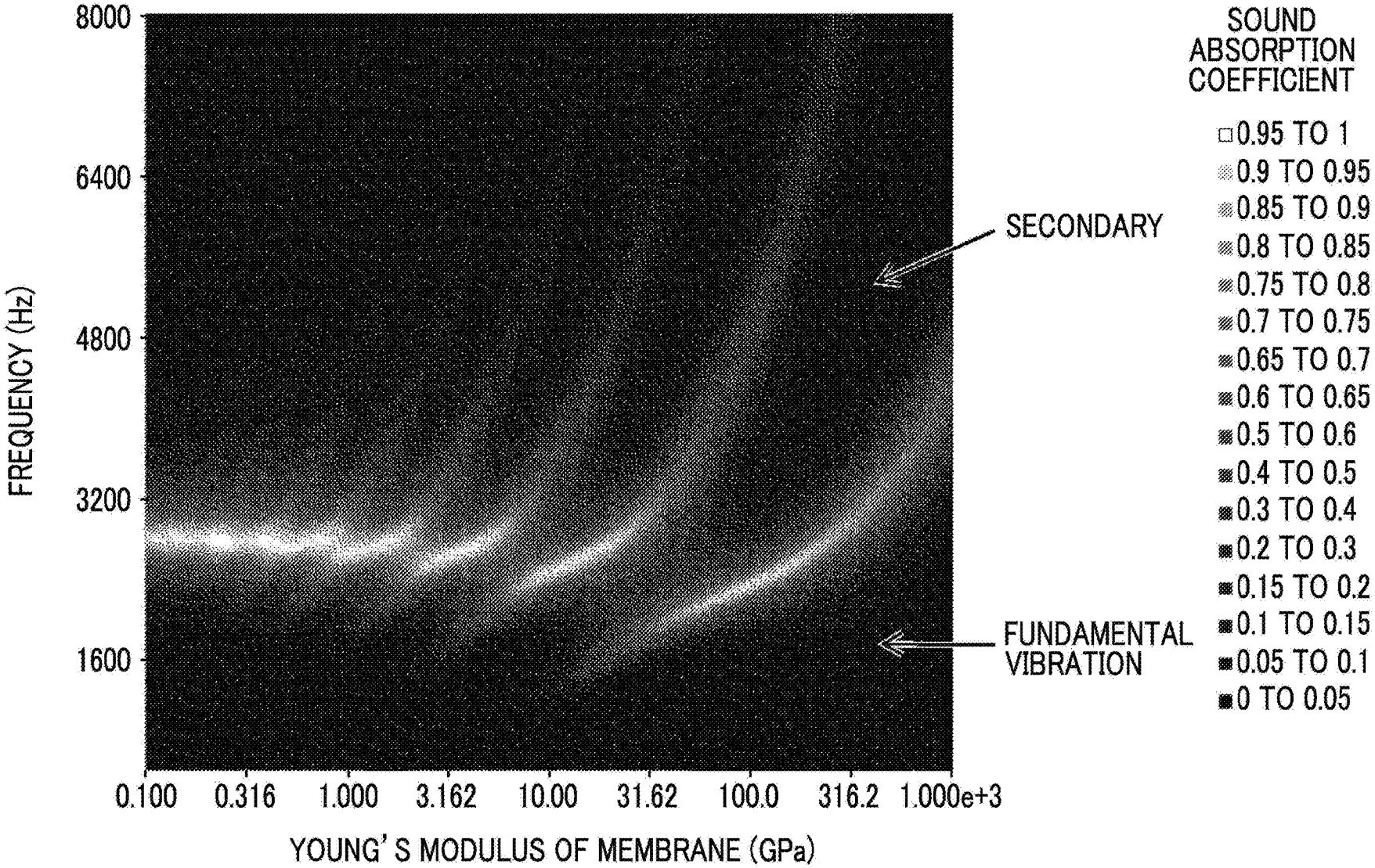
FIG. 42 is a graph showing a relationship between a Young's modulus of a membrane, a frequency, and a sound absorption coefficient.

From FIG. 42, even in a case where the density of the membrane-like member is higher, there is a region where the sound absorption coefficient in the high-order vibration mode is higher than the sound absorption coefficient in the fundamental vibration mode, and the Young's modulus at that time is 31.6 GPa.

Therefore, it is found that although the sound absorption peak frequency depends on the density of the membrane-like member, a relationship between the Young's modulus where the sound absorption coefficient in the high-order vibration mode is higher than the sound absorption coefficient in the fundamental vibration mode, and the rear surface distance does not change.

From the above, it is found that the relational expression $E\times t^3$ (Pa·m$^3$)$\leq 21.6\times d^{-1.25}\times\Phi^{4.15}$ obtained above can be applied, even in a case where the density of the membrane-like member changes.

Figure 46:
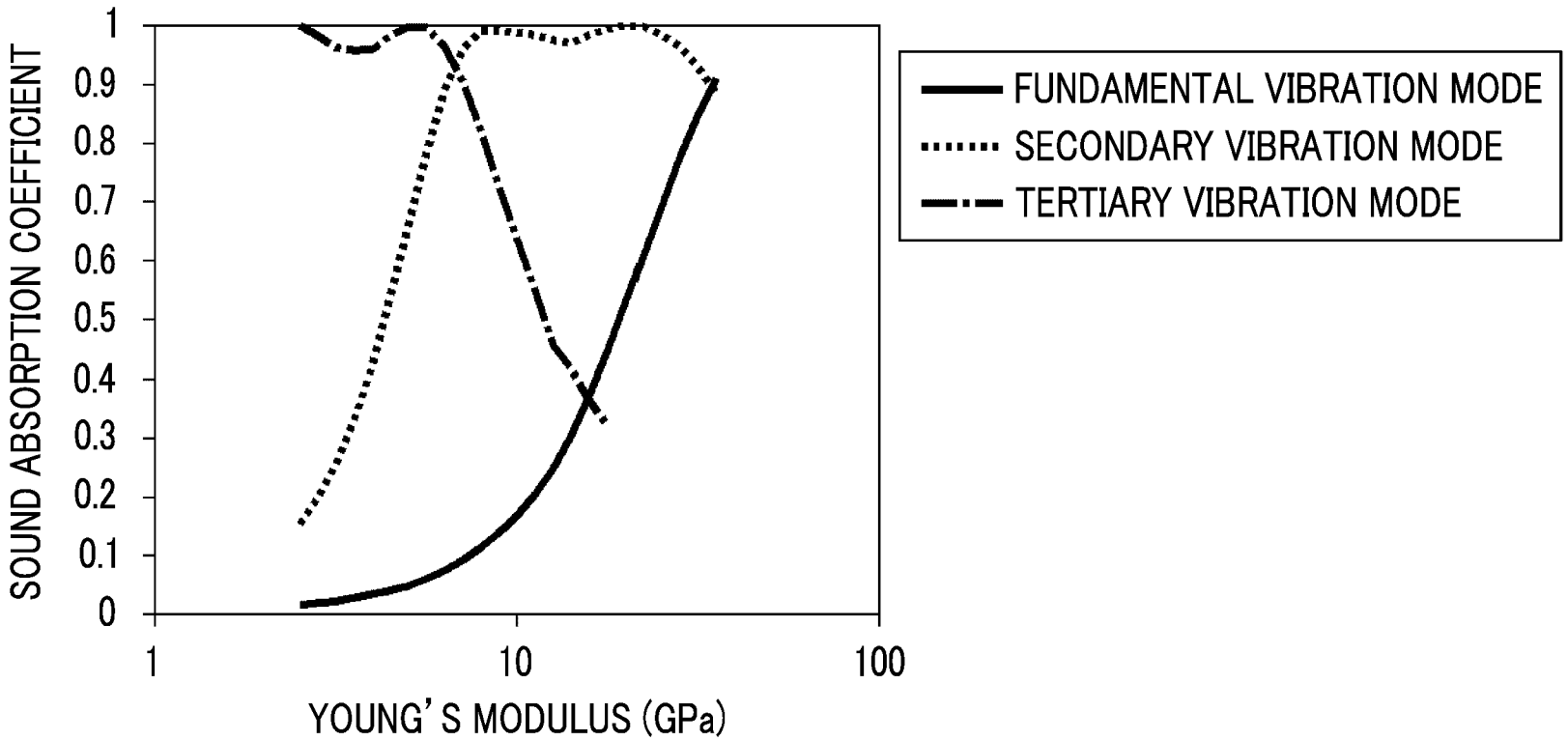
FIG. 46 is a graph showing a relationship between a Young's modulus and a sound absorption coefficient.

Here, in a case where the rear surface distance is 2 mm and the diameter of the opening of the frame is 20 mm, corresponding to FIG. 34, the sound absorption coefficient peaks respectively in the sound absorption in the fundamental vibration mode, the sound absorption in the secondary vibration mode, and the sound absorption in the tertiary vibration mode (sound absorption maximum values in respective modes) are obtained. FIG. 46 shows a relationship between each Young's modulus and the sound absorption coefficient.

It is found from FIG. 46 that the sound absorption coefficient changes in each vibration mode by changing the hardness (Young's modulus) of the membrane. In addition, it is found that the softer the membrane, the higher the sound absorption coefficient in the high-order vibration mode. That is, it is found that in a case where the membrane becomes soft, the sound absorption changes to the sound absorption in a higher-order vibration mode.

Figure 47:
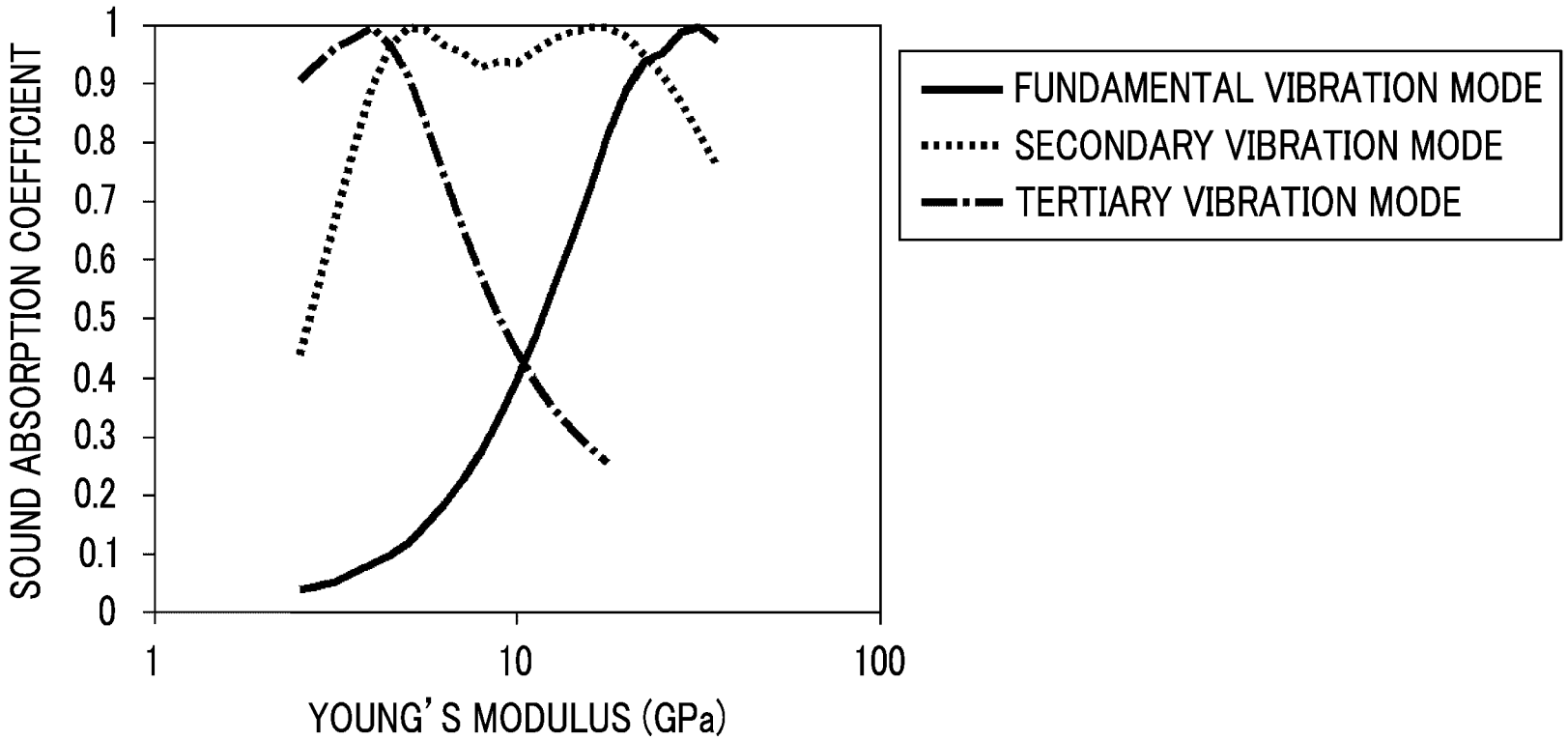
FIG. 47 is a graph showing a relationship between a Young's modulus and a sound absorption coefficient.

In the same manner as described above, in a case where the rear surface distance is 3 mm, corresponding to FIG. 35, the sound absorption coefficient peaks respectively in the sound absorption in the fundamental vibration mode, the sound absorption in the secondary vibration mode, and the sound absorption in the tertiary vibration mode are obtained. FIG. 47 shows a relationship between each Young's modulus and the sound absorption coefficient.

In FIGS. 46 and 47, the hardness of the membrane where the sound absorption coefficient in the fundamental vibration mode and the sound absorption coefficient in the secondary vibration mode are reversed corresponds to $21.6\times d^{-1.25}\times\Phi^{4.15}$.

Here, a relational expression $E\times t^3\leq 21.6\times d^{-1.25}\times\Phi^{4.15}$ is obtained regarding sound absorption coefficient of sound absorption in the fundamental vibration mode and sound absorption in the secondary vibration mode. In the same manner as described above, a coefficient on the right side can be obtained for the hardness of the membrane (Young's modulus×thickness to the power of 3). That is, assuming that the coefficient on the right side is a, from $E\times t^3=a\times d^{-1.25}\times\Phi^{4.15}$, the coefficient a corresponding to the Young's modulus E and the thickness t of the membrane that satisfies certain conditions can be obtained from $a=(E\times t^3)/(D^{-1.25}\times\Phi^{4.15})$.

The relationship between the coefficient a and the Young's modulus is obtained for each of the rear surface distance of 2 mm and the rear surface distance of 3 mm.

From FIGS. 46 and 47, a ratio of the peak sound absorption coefficient in the secondary vibration mode to the peak sound absorption coefficient in the fundamental vibration mode (sound absorption coefficient in the secondary vibration mode/sound absorption coefficient in the fundamental vibration mode, hereinafter, also referred to as sound absorption ratio) is obtained with respect to the Young's modulus.

The relationship between the sound absorption ratio and the Young's modulus is obtained for each of the rear surface distance of 2 mm and the rear surface distance of 3 mm.

Figure 48:
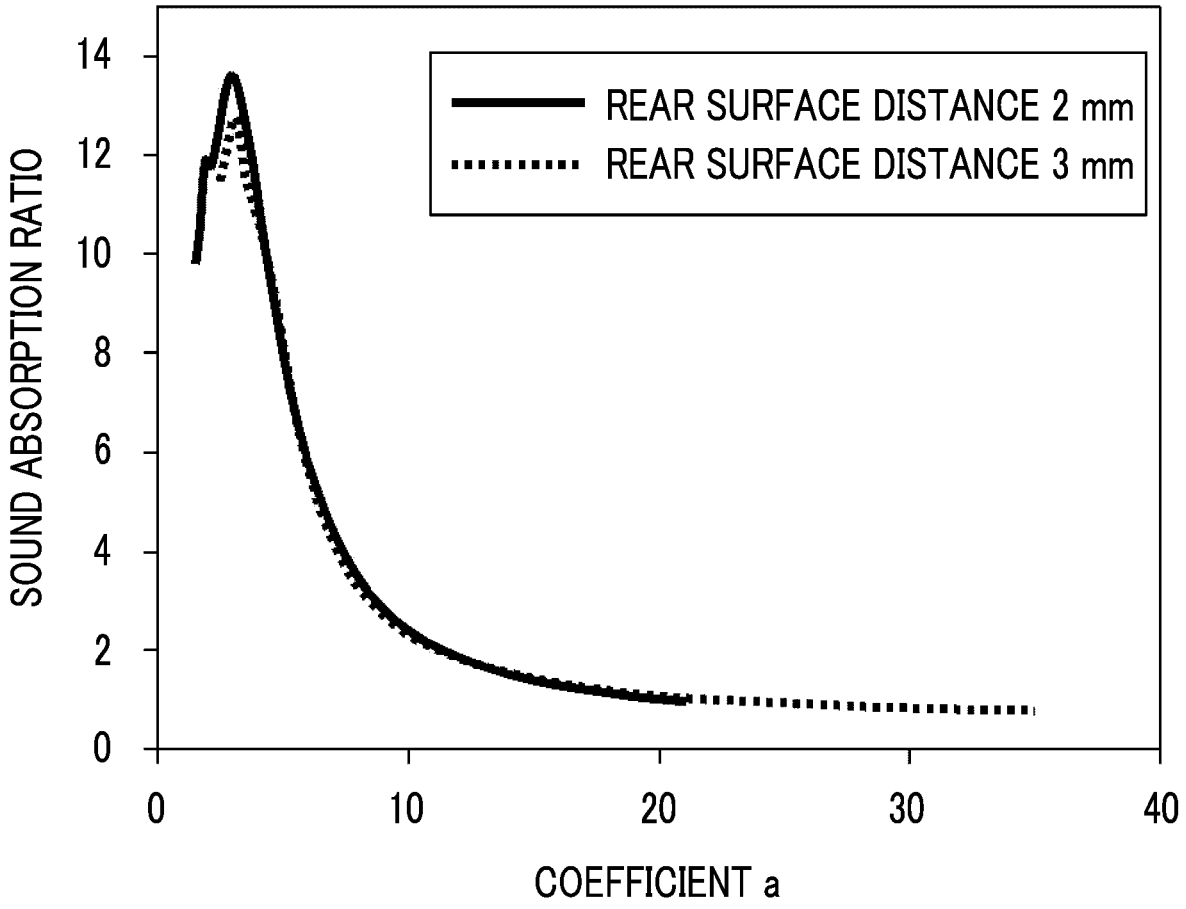
FIG. 48 is a graph showing a relationship between a coefficient a and a sound absorption ratio.

From the relationship between the coefficient a and the Young's modulus and the relationship between the Young's modulus and the sound absorption ratio described above, a relationship between the coefficient a and the sound absorption ratio is obtained for each of the rear surface distance of 2 mm and the rear surface distance of 3 mm. The results thereof are shown in FIG. 48.

The sound absorption coefficient with respect to the Young's modulus is different between the case where the rear surface distance is 2 mm and the case where the rear surface distance is 3 mm, since the hardness of the air spring due to the air in the rear surface of the membrane-like member is different (FIGS. 46 and 47). However, as shown in FIG. 48, in a case where the sound absorption ratio is indicated according to the coefficient a, it is found that the sound absorption ratio is determined regardless of the rear surface distance. Table 3 shows a relationship between the sound absorption ratio and the coefficient a.

TABLE 3

| Coefficient a | Sound absorption ratio |
|---|---|
| 11.1 | 2 |
| 8.4 | 3 |
| 7.4 | 4 |
| 6.3 | 5 |
| 5 | 8 |
| 4.2 | 10 |
| 3.2 | 12 |

It is found from FIG. 48 and Table 3 that the smaller the coefficient a, the larger the sound absorption ratio. In a case where the sound absorption ratio is high, sound absorption in a higher-order vibration mode appears more, and the effect of sound absorption by the compact and high-order vibration modes, which is a feature of the invention, can be significantly exhibited.

Here, as can be seen from Table 3, the coefficient a is preferably 11.1 or less, 8.4 or less, 7.4 or less, 6.3 or less, 5.0 or less, 4.2 or less, or 3.2 or less.

In addition, from another viewpoint, in a case where the coefficient a is 9.3 or less, the tertiary vibration sound absorption is higher than the fundamental vibration sound absorption coefficient. Therefore, it is also preferable that the coefficient a is 9.3 or less.

Next, the sound absorption peak frequency in a region where the Young's modulus is significantly low, that is, a region where the membrane is soft is examined.

Figure 43:
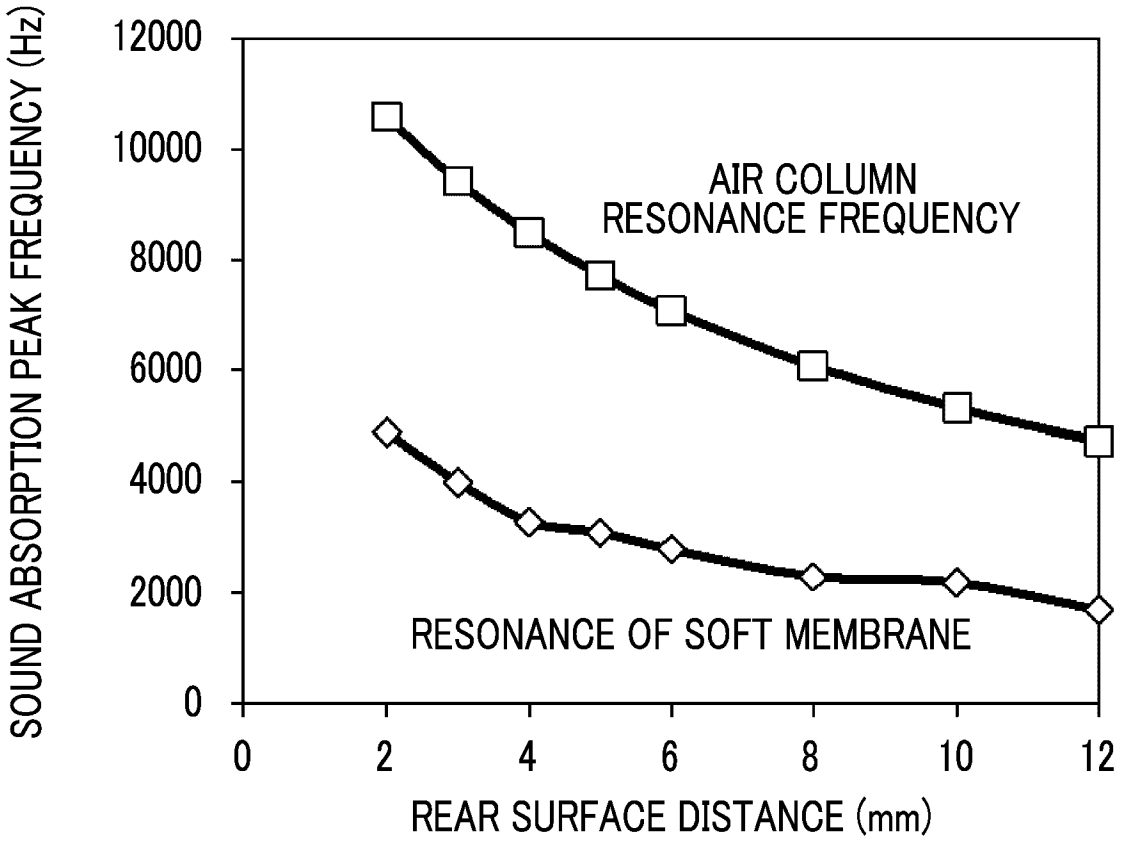
FIG. 43 is a graph showing a relationship between a rear surface distance and a sound absorption peak frequency.

First, the sound absorption peak frequency in a case where the Young's modulus is 100 MPa is read from FIG. 34 and the like, in the simulation results in a case where the density of the membrane-like member is 1.4 g/cm$^3$. The results thereof are shown in FIG. 43. FIG. 43 is a graph showing a relationship between a rear surface distance and a sound absorption peak frequency with a Young's modulus of 100 MPa.

It is found from FIG. 43 that the sound absorption peak frequency is on a low frequency side, as the rear surface distance increases.

Here, a comparison is made with a simple air column resonance tube without a membrane. For example, an anti-fouling structure having a rear surface distance of 2 mm is compared with air column resonance in a case where a length of the air column resonance tube is 2 mm. In a case where the rear surface distance is 2 mm, the resonance frequency in the air column resonance tube is around 10,600 Hz, even in a case where an opening end correction is added. The resonance frequency of the air column resonance is also plotted in FIG. 43.

It is found from FIG. 43 that in the region where the membrane is soft, the sound absorption peak frequency converges to a certain frequency with robustness, but the frequency is not the air column resonance frequency but the sound absorption peak at a lower frequency side. In other words, by attaching a membrane and performing the sound absorption in a high-order vibration mode, a compact sound absorbing structure that has robustness against a change of the membrane-like member and has a smaller rear surface distance compared to the air column resonance tube is realized.

On the other hand, in a case where the membrane is extremely soft, the sound absorption coefficient decreases. This is because the pitch of the antinodes and nodes of the membrane vibration becomes finer as the membrane vibration shifts to a high order, and the bending due to the vibration becomes smaller, so that the sound absorbing effect is reduced.

In the same manner as described above, the sound absorption peak frequency in a case where the Young's modulus is 100 MPa is read from FIG. 41 and the like, in the simulation results in a case where the density of the membrane-like member is 2.8 g/cm$^3$. The results thereof are shown in FIG. 44.

Figure 44:
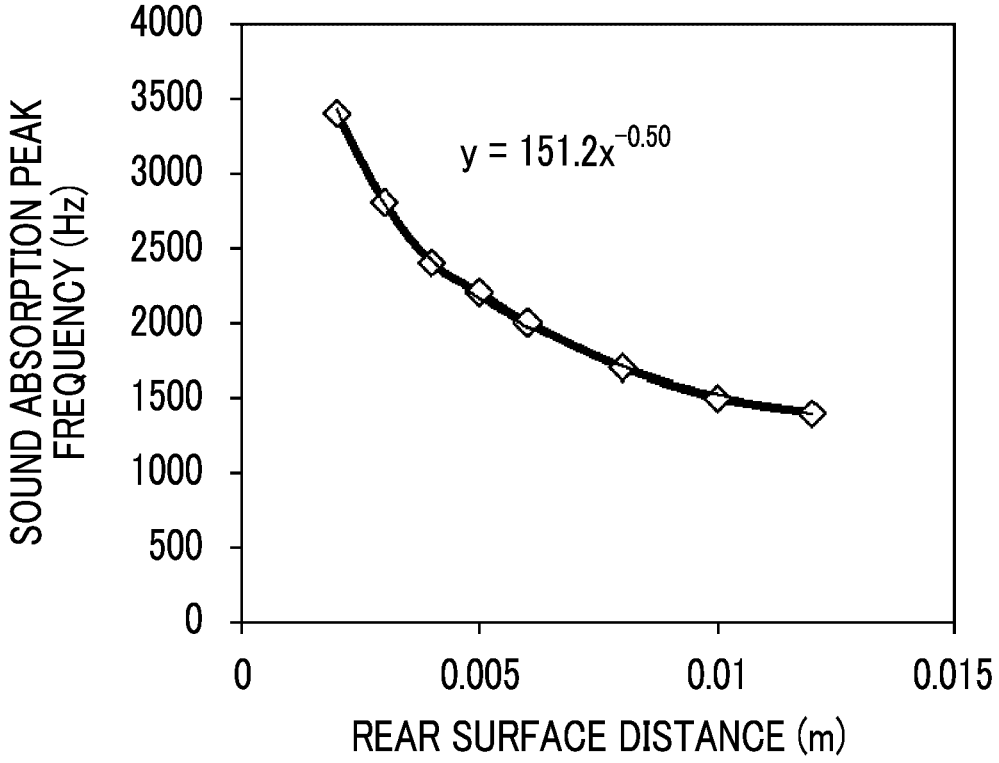
FIG. 44 is a graph showing a relationship between a rear surface distance and a sound absorption peak frequency.

From FIG. 44, since the sound absorption peak frequency is lower than that of the air column resonance tube, a compact sound absorbing structure with a small rear surface distance can be realized.

In addition, summarizing the approximate expression from the graph shown in FIG. 44, it is found that, in a region where the membrane is soft, the sound absorption peak frequency is in proportion to the rear surface distance to the power of 0.5.

Figure 45:
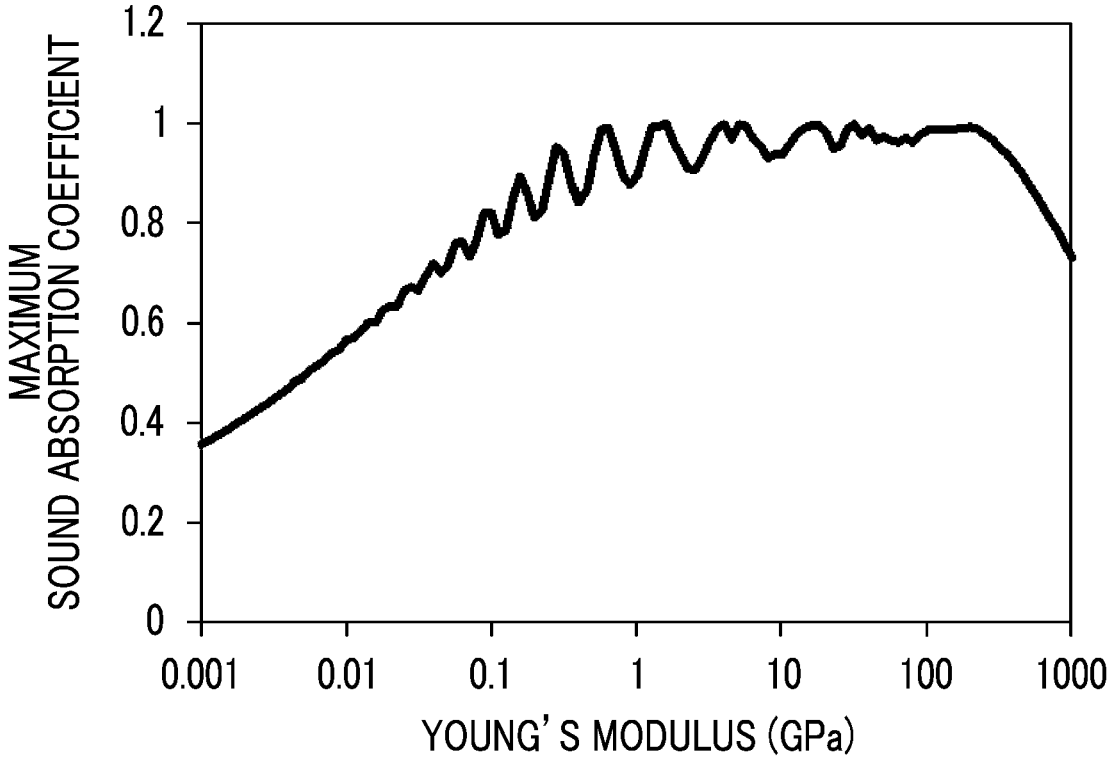
FIG. 45 is a graph showing a relationship between a Young's modulus and a maximum sound absorption coefficient.

Further, in order to examine even a soft membrane, the maximum sound absorption coefficient in a case where the Young's modulus is changed from 1 MPa to 1000 GPa is examined. The calculation is performed with a frame diameter of 20 mm, a thickness of the membrane-like member of 50 μm, and a rear surface distance of 3 mm. FIG. 45 shows the maximum sound absorption coefficient with respect to the Young's modulus. In the graph shown in FIG. 45, a waveform of the maximum sound absorption coefficient vibrates near the hardness at which the vibration mode in which a sound is absorbed is switched. In addition, it is found that the sound absorption coefficient decreases, in a case of the soft membrane in which the thickness of the membrane-like member is 50 μm and the Young's modulus is approximately 100 MPa or less.

Table 4 shows a hardness of the membrane corresponding to the Young's modulus at which the maximum sound absorption coefficient exceeds 40%, 50%, 70%, 80%, and 90%, and a hardness with which the sound absorption coefficient remains to exceed 90%, even in a case where the vibration mode order of the maximum sound absorption of the membrane is shifted.

It is found from Table 4 that the hardness $E \times t^3$ ($Pa \cdot m^3$) of the membrane-like member is preferably $2.49 \times 10^{-7}$ or more, more preferably $7.03 \times 10^{-7}$ or more, even more preferably $4.98 \times 10^{-6}$ or more, still preferably $1.11 \times 10^{-5}$ or more, particularly preferably $3.52 \times 10^{-5}$ or more, and most preferably $1.40 \times 10^{-4}$ or more.

TABLE 4

| Young's modulus MPa | Hardness of membrane $E \times m^3$ | Standard of maximum sound absorption coefficient |
|---|---|---|
| 2 | 2.49E−07 | >40% |
| 5.6 | 7.03E−07 | >50% |
| 39.8 | 4.98E−06 | >70% |

TABLE 4-continued

| Young's modulus MPa | Hardness of membrane E × m³ | Standard of maximum sound absorption coefficient |
|---|---|---|
| 89.1 | 1.11E−05 | >80% |
| 281.3 | 3.52E−05 | >90% |
| 1122 | 1.40E−04 | Without vibration >90% |

Hereinafter, materials constituting each portion of the soundproof structure 10 (that is, the bottom wall 22, the inner frame 18, the inner membrane 14, the outer frame 19, and the outer membrane 15) will be described.

<Frame Material and Wall Material>

Examples of the materials of the inner frame 18 and the outer frame 19 (hereinafter, a frame material) and the material of the bottom wall 22 (hereinafter, a wall material) include a metal material, a resin material, a reinforced plastic material, and a carbon fiber. Examples of the metal material include metal materials such as aluminum, titanium, magnesium, tungsten, iron, steel, chromium, chromium molybdenum, nichrome molybdenum, copper, and alloys thereof. Examples of the resin material include resin materials such as an acrylic resin, polymethyl methacrylate, polycarbonate, polyamideide, polyarylate, polyetherimide, polyacetal, polyetheretherketone, polyhenylenesulfide, polysulfone, polyethylene terephthalate, polybutylene terephthalate, polyimide, an ABS resin (acrylonitrile-butadiene-styrene copolymerized synthetic resin), polypropylene, and triacetyl cellulose. Examples of the reinforced plastic material include carbon fiber reinforced plastics (CFRP) and glass fiber reinforced plastics (GFRP). In addition, examples thereof include natural rubber, chloroprene rubber, butyl rubber, ethylene propylene diene rubber (EPDM), silicone rubber, and the like, and rubbers having a crosslinked structure thereof.

In addition, various honeycomb core materials can be used as the frame material and the wall material. Since the honeycomb core material is used as a lightweight and highly-rigid material, ready-made products are easily available. The honeycomb core material formed of various materials such as an aluminum honeycomb core, an FRP honeycomb core, a paper honeycomb core (manufactured by Shin Nippon Feather Core Co., Ltd. and Showa Aircraft Industry Co., Ltd.), a thermoplastic resin (specifically, a polypropylene (PP), a polyethylene terephthalate (PET), a polyethylene (PE), a polycarbonate (PC), and the like), and a honeycomb core (TECCELL manufactured by Gifu Plastics Industry Co., Ltd.) can be used as the frame material and the wall material.

In addition, a structure containing air, that is, a foamed material, a hollow material, a porous material, or the like can also be used as the frame material. In order to prevent the air flow between cells in a case of using a large number of membrane type soundproof structures, a frame can be formed using, for example, a closed-cell foamed material. For example, various materials such as closed-cell polyurethane, closed-cell polystyrene, closed-cell polypropylene, closed-cell polyethylene, and closed-cell rubber sponge can be selected. A closed-cell foam body is suitably used as the frame material, since it prevents a flow of sound, water, gas, and the like and has a high structural hardness, compared to an open-cell foam body. In addition, in a case where the above-described porous sound absorbing body has sufficient supporting properties, the frame may be formed only of the porous sound absorbing body, or the materials described as the materials of the porous sound absorbing body and the frame may be combined by, for example, mixing, kneading, or the like. As described above, the weight of the device can be reduced by using a material system containing air inside. In addition, heat insulation can be provided.

The frame material and the wall material are preferably materials having higher heat resistance than a flame-retardant material since the soundproof structure 10 can be arranged in a place where the temperature becomes high. The heat resistance can be defined, for example, by a time to satisfy Article 108-2 of the Building Standard Law Enforcement Order. In a case where the time to satisfy Article 108-2 of the Building Standard Law Enforcement Order is 5 minutes or longer and shorter than 10 minutes, it is defined as a flame-retardant material, in a case where the time is 10 minutes or longer and shorter than 20 minutes, it is defined as a quasi-noncombustible material, and in a case where the time is 20 minutes or longer, it is defined as a noncombustible material. However, the heat resistance is often defined for each application field. Therefore, in accordance with the field in which the soundproof structure is used, the frame material and the wall material may consist of a material having heat resistance equivalent to or higher than flame retardance defined in the field.

Additionally, as for the frame material, since the inner frame 18 and the outer frame 19 are rigid bodies that do not vibrate (resonate) together with the inner membrane 14 and the outer membrane 15, a shape of the frame material may be a shape that can exhibit properties as a rigid body. More specifically, as for the inner frame 18 and the outer frame 19, it is preferable that each edge portion of the inner membrane 14 and the outer membrane 15 is securely fixed and the inner membrane 14 and the outer membrane 15 are supported so as to perform the membrane vibration. As long as such requirements are satisfied, the shape of the frame material is not particularly limited, and may be set to a suitable shape according to a size (diameter) of the membrane portion 12*a* of the inner membrane 14 and the outer membrane 15.

<Membrane Material>

Examples of the material (hereinafter, a membrane material) of the inner membrane 14 and the outer membrane 15 include various metals such as aluminum, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium; and resin materials such as polyethylene terephthalate (PET), triacetyl cellulose (TAC), polyvinylidene chloride (PVDC), polyethylene (PE), polyvinyl chloride (PVC), polymethylpentene (PMP), a cycloolefin polymer (COP), ZEONOR, polycarbonate, polyethylene naphthalate (PEN), polypropylene (PP), polystyrene (PS), polyarylate (PAR), aramid, polyphenylene (PPS), polyethersulfone (PES), nylon, polyester (PEs), a cyclic and olefin copolymer (COC), diacetylcellulose, nitrocellulose, cellulose derivatives, polyamide, polyamideimide, polyoxymethylene (POM), polyether imide (PEI), polyrotaxane (such as a slide ring material), and polyimide. In addition, a glass material such as thin membrane glass, and a fiber reinforced plastic material such as carbon fiber reinforced plastic (CFRP) and glass fiber reinforced plastic (GFRP) can also be used. In addition, natural rubber, chloroprene rubber, butyl rubber, ethylene propylene diene rubber (EPDM), silicone rubber, and the like, and rubbers including a crosslinked structure thereof can be used. Alternatively, a material obtained by combining these may be used as the membrane material.

From a viewpoint of excellent durability against heat, ultraviolet rays, external vibration, and the like, it is preferable to use a metal material as the membrane material in applications requiring durability. In a case of using a metal material, the surface may be plated with metal from a viewpoint of suppressing rust and the like.

The method of fixing the membrane to the frame is not particularly limited, and a method using a double-sided tape or an adhesive, a mechanical fixing method such as screwing, or pressure bonding can be appropriately used. Here, similarly to the frame material and the membrane material, it is preferable to select a fixing unit from the viewpoint of heat resistance, durability, and water resistance. For example, in the case of fixing using an adhesive, "Super X" series manufactured by Cemedine Co., Ltd., "3700 series (heat resistant)" manufactured by Three Bond Co., Ltd., and heat-resistant epoxy adhesive "Duralco series" manufactured by Taiyo Wire Cloth Co., may be selected as the fixing unit. In a case of fixing using a double-sided tape, a high heat resistant double-sided adhesive tape 9077 made by 3M may be selected as the fixing unit. As described above, various fixing unit can be selected according to the required properties.

In addition, by selecting a transparent member such as a resin material for both the inner frame 18 and outer frame 19 and the membrane-like member inner membrane 14 and outer membrane 15, the soundproof structure 10 itself can be made transparent. For example, a transparent resin such as PET, acryl, or polycarbonate may be selected. Since a general porous sound absorbing material may not prevent scattering of visible light, it is specificity that a transparent soundproof structure can be realized.

In addition, an antireflection coat or an antireflection structure may be provided on the inner frame 18 and outer frame 19 and/or the membrane-like member inner membrane 14 and outer membrane 15. For example, an antireflection coat using optical interference by a dielectric multilayer membrane can be used. By preventing the reflection of visible light, the visibility of the inner frame 18 and outer frame 19 and/or the membrane-like member inner membrane 14 and outer membrane 15 can be further reduced and made inconspicuous.

In this way, the transparent soundproof structure can be attached to, for example, a window member or used as a substitute.

In addition, the inner frame 18 and outer frame 19 or the membrane-like member inner membrane 14 and outer membrane 15 may have a heat shielding function. Generally, a metal material reflects both near-infrared rays and far-infrared rays, and accordingly, radiant heat conduction can be suppressed. In addition, even in a case of a transparent resin material or the like, it is possible to reflect only the near-infrared rays while keeping it transparent by providing a heat shielding structure on a surface thereof. For example, the near-infrared rays can be selectively reflected while transmitting visible light by a dielectric multilayer structure. Specifically, a multi-layer Nano series such as Nano90s manufactured by 3M reflects near-infrared rays with a layer configuration of more than 200 layers. Accordingly, such a structure can be bonded to a transparent resin material and used as the frame or the membrane-like member, or this member itself may be used as the inner membrane 14 and the outer membrane 15. In this case, the soundproof structure can be a structure having sound absorbing properties and heat shielding properties as a substitute for the window member, for example.

In addition, in a system in which an environmental temperature changes, it is desirable that both the material of the frame 19 and the membrane-like member 14 and 15 have a small change in physical properties with respect to the environmental temperature. For example, in a case of using a resin material, it is desirable to use a material having a point at which a significant change in physical properties is caused (glass transition temperature, melting point, or the like) that is beyond the environmental temperature range.

In addition, in a case where different members are used for the frame and the membrane-like member, it is desirable that thermal expansion coefficiency (linear thermal expansion coefficiency) at the environmental temperature is substantially the same. In a case where the thermal expansion coefficiency is greatly different between the frame and the membrane-like member, an amount of displacement between the frame and the membrane-like member changes in a case where the environmental temperature changes, and accordingly, a distortion easily occurs on the membrane. Since a distortion and a tension change affect the resonance frequency of the membrane, a sound reduction frequency easily changes according to a temperature change, and even in a case where the temperature returns to the original temperature, the sound reduction frequency may remain as changed, without relaxing the distortion.

In contrast, in a case where the thermal expansion coefficiency is substantially the same, the frame and the membrane-like material expand and contract in the same manner with respect to a temperature change, so that the distortion hardly occurs, thereby exhibiting sound reduction properties stable with respect to a temperature change.

A linear expansion factor is known as an index of the thermal expansion coefficiency, and the linear expansion factor can be measured by a known method such as JISK7197. A difference in the coefficient of linear expansion coefficiency between the frame and the membrane-like material is preferably 9 ppm/K or less, more preferably 5 ppm/K or less, and even more preferably 3 ppm/K or less, in an environmental temperature range used. By selecting a member from such a range, it is possible to exhibit a stable sound reduction properties at the environmental temperature used.

Modification Example of Soundproof Structure According to Embodiment of Present Invention Although the configuration of the soundproof structure according to an example of the embodiment of the present invention (that is, the soundproof structure 10) has been described above, the content is only one of the configuration examples of the soundproof structure according to the embodiment of the present invention, and other configurations are also conceivable. Hereinafter, a modification example of the soundproof structure according to the embodiment of the present invention will be described.

In the configuration of the soundproof structure 10 described above, the support 16 that supports the inner membrane 14 and the outer membrane 15 is configured by a plurality of cylindrical frames. However, the support 16 may be any as long as it supports the inner membrane 14 and the outer membrane 15 so as to perform the membrane vibration, and for example, may be a portion of a housing of various electronic apparatus. In a case of adopting such a configuration, a frame as the support 16 may be integrally formed on the housing in advance. In this way, the inner membrane 14 and the outer membrane 15 can be attached later.

In addition, the support 16 is not limited to the cylindrical frame, and may consist of a flat plate (base plate). In a case of adopting such a configuration, assuming that at least one of the inner membrane 14 or the outer membrane 15 is curved and the end portion thereof is fixed to the support 16, the curved membrane-like member can be supported so as to perform the membrane vibration.

Further, the frame constituting the support 16 is not limited to a cylindrical shape, and may have various shapes as long as the frame can support the inner membrane 14 and the outer membrane 15 so as to vibrate. For example, a frame having a rectangular tube shape (a shape in which the opening 20 is formed in a rectangular parallelepiped outer shape) may be used.

In addition, it may have a configuration that after at least one edge portion of the inner membrane 14 or the outer membrane 15 is fixed to the member with an adhesive or the like, pressure is applied from the rear surface side (inner side in the thickness direction) to expand the membrane portion 12*a*, and then the rear surface side is covered with a plate or the like. Alternatively, it may have a configuration that after the outer membrane 15 is curved, the edge portion is fixed to the inner membrane 14. In a case where any of the above two configurations is adopted, the inner membrane 14 and the outer membrane 15 can be supported so as to perform the membrane vibration without using a frame.

In addition, in the configuration of the soundproof structure 10 described above, the bottom wall 22 is attached to the inner end of the inner frame 18 to cover the opening 20, but the present invention is not limited to thereto. The inner end of the support 16 may be closed in a case where the inner membrane 14 and the outer membrane 15 vibrate. For example, the inner end of the inner frame 18 is an opening end, and the inner end of the support 16 may be closed by pressing the inner end face of the inner frame 18 against the wall of the room while the soundproof structure 10 absorbs a sound. Even in such a configuration, in a case where there is no large gap between the inner end of the support 16 and the wall of the room, the same sound absorbing effect as in a case where the bottom wall 22 is attached to the inner end of the inner frame 18 to cover the opening 20 can be obtained.

In addition, in the configuration of the soundproof structure 10 described above, only one inter-membrane space 26 is formed inside the support 16. However, the present invention is not limited thereto, and it may have a configuration that one or more third membrane-like members are disposed between the inner membrane 14 and the outer membrane 15, and a plurality of inter-membrane spaces 26 (strictly, a number one less than the number of membranes) are formed inside the support 16.

In addition, in the configuration of the soundproof structure 10 described above, the rear surface space 24 and the inter-membrane space 26 are a closed space, and strictly, the spaces are partitioned and completely blocked from the surrounding space. However, the present invention is not limited to thereto, and the rear surface space 24 and the inter-membrane space 26 need only be partitioned such that the flow of air into the inside is obstructed, and need not necessarily be a completely closed space. That is, holes or slits may be formed in a portion of the inner membrane 14, the outer membrane 15, the inner frame 18, or the outer frame 19. Such a state having an opening in a portion is preferable from a viewpoint of preventing a change in sound absorbing properties by changing the hardness of the membrane-like member by applying tension to the membrane-like member 14 and 15 by expanding or contracting the air in the rear surface space 24 and the inter-membrane space 26 due to temperature change or a pressure change. From this viewpoint, since both the rear surface space 24 and the inter-membrane space 26 are ventilated to the outside by providing small through holes or openings in both the inner frame 18 or a bottom wall 22 and the outer frame 19, the above-described advantages function for both the membrane-like member 14 and 15.

Further, with the above-described configuration, particularly in a case where an opening is provided in the membrane-like member, the sound absorption peak frequency in the soundproof structure 10 can be changed.

Figure 15:
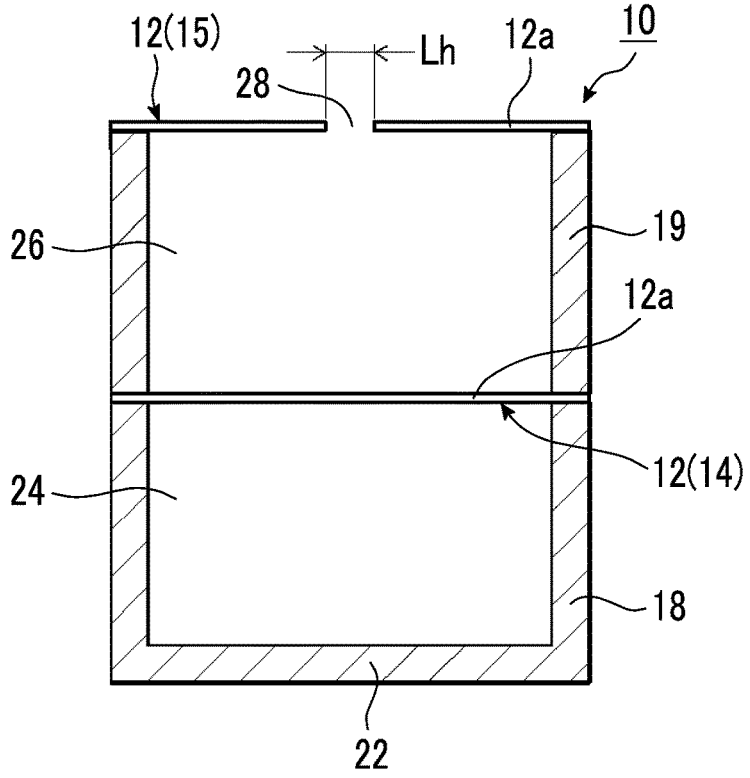
FIG. 15 is a cross-sectional view schematically showing a first modification example of the soundproof structure of the invention.
Figure 16:
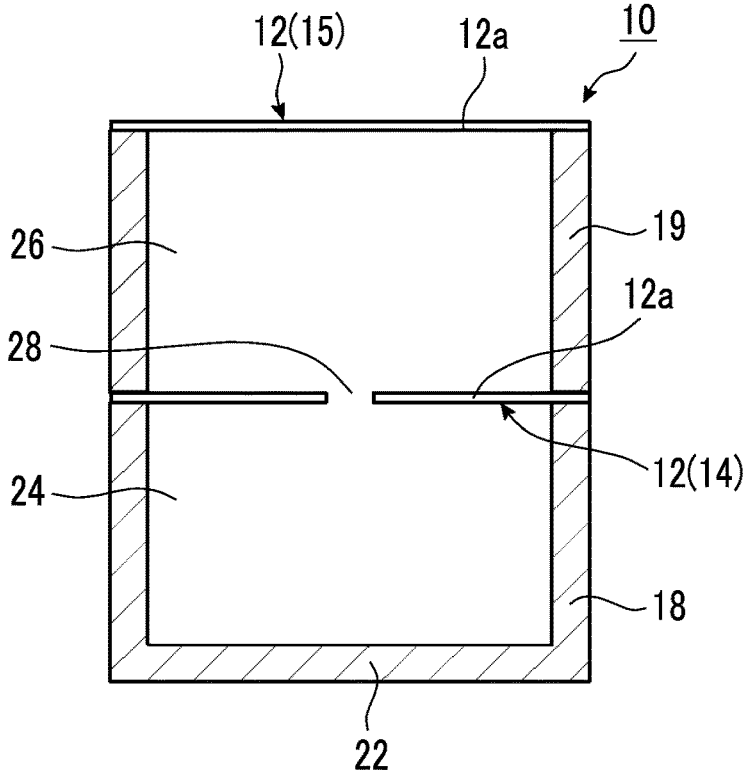
FIG. 16 is a cross-sectional view schematically showing a second modification example of the soundproof structure of the invention.

More specifically, in a case where a through hole 28 is provided in the inner membrane 14 or the outer membrane 15 as in the configuration of the soundproof structure 10 shown in FIGS. 15 and 16, a peak frequency can be adjusted. More specifically, in a case where the through hole 28 is formed in the membrane portion 12*a* of the inner membrane 14 or the outer membrane 15, an acoustic impedance of the membrane portion 12*a* changes. In addition, the mass of the membrane-like member is reduced due to the through hole 28. It is considered that the resonance frequency of the membrane-like member changes due to these facts, and as a result, the peak frequency changes.

FIGS. 15 and 16 are views showing modification examples of the soundproof structure 10 according to the embodiment of the present invention, and are schematic views showing a cross section at the same position as the cross section shown in FIG. 3.

The peak frequency after the formation of the through hole 28 can be controlled by adjusting a size of the through hole 28 (Lh in FIG. 15). The size of the through hole 28 is not particularly limited as long as it is a size that the flow of air is obstructed. However, the size is set to smaller than the size of the membrane portion 12*a* (the size of the vibrating region), and specifically, the equivalent circle diameter is preferably 0.1 mm to 10 mm, more preferably 0.5 mm to 7 mm, and even more preferably 1 mm to 5 mm.

In addition, the ratio of an area of the through hole 28 is preferably 50% or less, more preferably 30% or less, even more preferably 10% or less with respect to an area of the membrane portion 12*a*.

The through hole 28 may be formed in at least one of the plurality of membrane-like members 12 disposed in the soundproof structure 10, but from the viewpoint of further increasing the sound absorption coefficient at the second sound absorption peak, it is preferable that the through hole 28 is formed in the outer membrane 15 farthest from the rear surface space 24 as shown in FIG. 15.

The configuration shown in FIG. 15 will be described. The through hole 28 is formed only in the outer membrane 15. Therefore, the average areal density of the membrane portion 12*a* differs between the inner membrane 14 and the outer membrane 15. Specifically, in the outer membrane 15, the average areal density of the membrane portion 12*a* is smaller than that of the inner membrane 14 since the through hole 28 is formed. Here, the average areal density of the membrane portion 12*a* is calculated by dividing the mass of the membrane portion 12*a* by the area surrounded by the outer edge thereof.

As described above, in the soundproof structure 10 shown in FIG. 15, the inner membrane 14 in which the average areal density of the membrane portion 12*a* is higher is disposed in the soundproof structure 10 at a position near an end (one end) close to the rear surface space 24. On the other hand, the outer membrane 15 having the smaller average areal density of the membrane portion 12*a* is arranged at a position near an end (the other end) close to the inter-membrane space 26 in the soundproof structure 10.

In the above-described configuration, since the average areal density of the membrane portion 12*a* is further smaller, an airborne sound is more likely to pass through the outer membrane 15, and since the through hole 28 is formed, the sound is more likely to pass therethrough. On the other hand, the sound is harder to pass through the inner membrane 14 than the outer membrane 15. That is, in the configuration shown in FIG. 15, the airborne sound is more likely to enter the inter-membrane space 26, but is less likely to pass through the inner membrane 14 and go out of the inter-membrane space 26. As a result, the sound confined in the inter-membrane space 26 increases, and as a result, the sound absorbing effect in s sound field mode in which the sound is confined between the membranes is promoted. As a result, the sound absorbing effect due to an interaction between the inter-membrane space 26 and the membrane vibration is enhanced, and a high sound absorption coefficient can be obtained at the sound absorption peak on the high frequency side.

Note that a plurality of through holes 28 may be formed, and in that case, the size of each through hole 28 can be adjusted in the same manner as described above.

Figure 17:
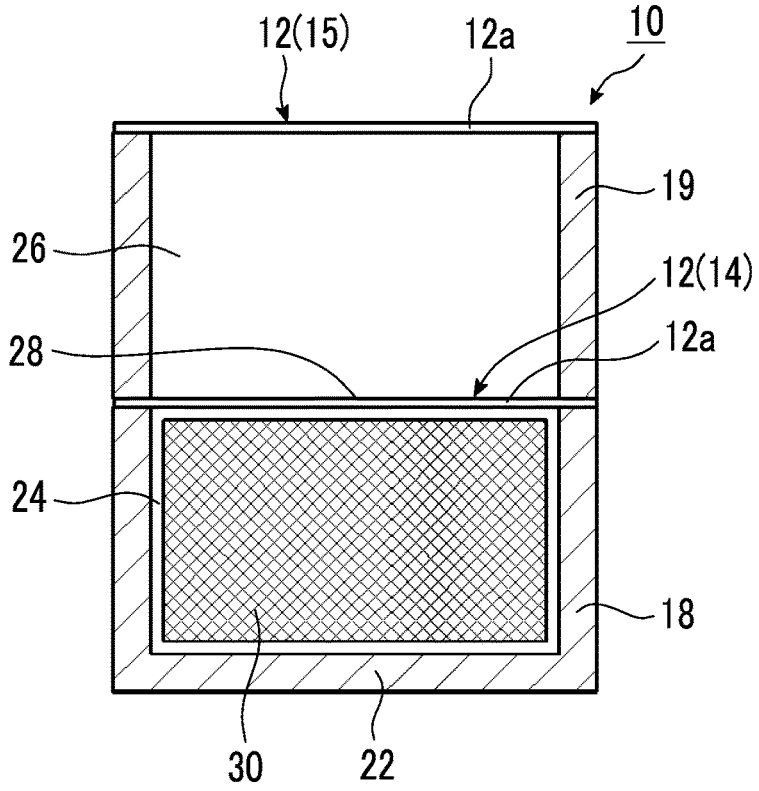
FIG. 17 is a cross-sectional view schematically showing a third modification example of the soundproof structure of the invention.

In addition, in the configuration of the soundproof structure 10 described above, only air exists inside the rear surface space 24 which is a closed space, but it may have a configuration that a porous sound absorbing body 30 is arranged in the rear surface space 24 as shown in FIG. 17.

It is possible to widen the band to a lower frequency side instead of reducing the sound absorption coefficient at the sound absorption peak by disposing the porous sound absorbing body 30 in the rear surface space 24.

A space in which the porous sound absorbing body 30 is arranged is not limited to the rear surface space 24, and may be arranged in the inter-membrane space 26. That is, the porous sound absorbing body 30 may be disposed in at least a portion of at least one of the rear surface space 24 or the inter-membrane space 26.

The porous sound absorbing body 30 is not particularly limited, and a well-known porous sound absorbing body can be suitably used. Examples thereof include various well-known porous sound absorbing bodies such as a foamed material such as urethane foam, soft urethane foam, wood, a ceramic particle sintered material, or phenol foam, and a material containing minute air; a fiber such as glass wool, rock wool, microfiber (such as THINSULATE manufactured by 3M), a floor mat, a carpet, a melt blown nonwoven, a metal nonwoven fabric, a polyester nonwoven, metal wool, felts, an insulation board, and glass nonwoven, and nonwoven materials, a wood wool cement board, a nanofiber material such as a silica nanofiber, and a gypsum board.

In addition, a flow resistance $\sigma 1$ of the porous sound absorbing body 30 is not particularly limited, and is preferably 1,000 to 100,000 ($Pa \cdot s/m^2$), more preferably 5,000 to 80,000 ($Pa \cdot s/m^2$), and even more preferably 10,000 to 50,000 ($Pa \cdot s/m^2$).

The flow resistance of the porous sound absorbing body 30 can be evaluated by measuring the normal incidence sound absorption coefficient of a porous sound absorbing body 30 having a thickness of 1 cm and fitting the Miki model (J. Acoustic. Soc. Jpn., 11(1) pp. 19-24 (1990). Alternatively, the evaluation may be performed according to "ISO 9053".

EXAMPLES

Hereinafter, the invention will be described in more detail on the basis of Examples.

The materials, amounts used, ratios, processing details, processing procedures, and the like shown in the following Examples can be suitably changed without departing from the gist of the invention. Therefore, the scope of the invention should not be construed as being limited by the following Examples.

In the following Examples, the configuration and effect of the soundproof structure according to the embodiment of the present invention having a multi-layer membrane structure will be described, but prior to the description, the configuration and the like of the soundproof structure having a single-layer membrane structure will be described as Reference Example.

Reference Example 1

<Production of Soundproof Structure Having Single-Layer Membrane Structure>

A PET film having a thickness of 50 μm (Lumirror manufactured by Toray Industries, Inc.) is cut to have a circular shape having an outer diameter of 40 mm as the membrane-like member.

The frame constituting the support is produced as follows.

An acrylic plate (manufactured by Hikari Co., Ltd.) having a thickness of 2 mm is prepared, and one donut-shaped (ring-shaped) plate having an inner diameter of 20 mm and an outer diameter of 40 mm is produced using a laser cutter.

A PET film (membrane-like member) is bonded to one opening surface of a produced donut-shaped plate (frame) with a double-sided tape (GENBA NO CHIKARA manufactured by ASKUL Corporation) in a state where an outer edge of the donut-shaped plate and an outer edge of the PET film coincided with each other.

According to the above procedure, the soundproof structure in which the thickness of the PET film (membrane-like member) is 50 μm, the opening of the donut-shaped plate (frame) is a circle having a diameter of 20 mm, and the thickness of the rear surface space is 2 mm is produced. In the soundproof structure according to Reference Example 1, the rear surface space is a closed space.

<Evaluation of Soundproof Structure>

In order to evaluate the produced soundproof structure, an acoustic tube measurement is performed using the soundproof structure. Specifically, the evaluation is performed by producing a measurement system for the normal incidence sound absorption coefficient based on JIS A 1405-2. The same measurement can be performed using WinZacMTX manufactured by Japan Acoustic Engineering. The internal diameter of the acoustic tube is set to 2 cm, and the soundproof structure is disposed at the end portion of the acoustic tube such that the membrane-like member faces the sound incident surface side, and then the normal incidence sound absorption coefficient is evaluated. At this time, in accordance with the method for measuring the normal incidence sound absorption coefficient, the normal incidence sound absorption coefficient is measured in a state where a rigid body consisting of an aluminum plate having a thickness of 100 mm is pressed against the rear surface (inner end in the thickness direction) of the soundproof structure. The normal incidence sound absorption coefficient is measured for the soundproof structure having the closed rear surface space.

A measurement result (a relationship between the measured frequency and the sound absorption coefficient) in Reference Example 1 is as shown in FIG. 12.

In addition, instead of the structure in which the rigid body consisting of the aluminum plate having the thickness of 100 mm is pressed against the rear surface of the soundproof structure, the normal incidence sound absorption coefficient is similarly measured using the following configuration.

Using a laser cutter, one circular plate having an outer diameter of 40 mm is produced, and in a state where the outer edge of the above-described donut-shaped plate and the outer edge of the circular plate have the same outer diameter, the circular plate is bonded to the surface of the donut-shaped plate on the side opposite to the membrane-like member using a double-sided tape (GENBA NO CHIKARA manufactured by ASKUL Corporation) to produce a frame.

Also in the above configuration, the same measurement result as in the structure in which the rigid body consisting of the aluminum plate having the thickness of 100 mm is pressed against the rear surface of the soundproof structure is obtained.

Reference Example 2

The soundproof structure having a single-layer membrane structure is produced in the same manner as in Reference Example 1 except that the thickness of the rear surface space is set to 4 mm, and the normal incidence sound absorption coefficient is measured. The thickness of the rear surface space is changed by overlapping a plurality of donut-shaped plates.

The measurement result (the relationship between the measured frequency and the sound absorption coefficient) in Reference Example 2 is as shown in FIG. 13.

As can be seen from FIGS. 12 and 13, the soundproof structure having the single-layer membrane structure according to Reference Example 1 and Reference Example 2 has a structure in which a plurality of sound absorption peaks exist around 3 kHz to 5 kHz and sound absorption in the high-order vibration mode is performed at the frequency of each peak, and thus a large sound absorption coefficient is obtained. On the other hand, the sound absorption coefficient is less than 50% at the sound absorption peak existing around 8 kHz. This indicates that in the case of the soundproof structure having the single-layer membrane structure, a relatively high sound absorption coefficient is obtained by the membrane vibration of the fundamental vibration mode and the high-order vibration mode in a certain frequency band, but the sound absorption coefficient is low at a sound absorption peak of a higher frequency band.

Example 1

In accordance with the production procedure of the soundproof structure in Reference Example 1, two donut-shaped plates (frames) and two PET films (membrane-like members) are produced. Each donut-shaped plate has a cylindrical shape with an inner diameter of 20 mm, an outer diameter of 40 mm, and a thickness of 2 mm. In addition, each PET film has a circular shape with a thickness of 50 μm and a diameter of 40 mm. In addition, one circular plate having an outer diameter of 40 mm is produced using a laser cutter.

Then, the PET film, the donut-shaped plate, the PET film, the donut-shaped plate, and the circular plate are overlapped in order from the outside in the thickness direction so that the outer edges thereof coincided with each other, and then the adjacent members are bonded to each other with a double-sided tape.

By the above procedure, the soundproof structure is produced in which the thickness of each of the outer membrane and the inner membrane is 50 μm, the diameter of each membrane portion (vibrating region) is 20 mm, the outer diameter of each of the outer frame and the inner frame is 40 mm, the thickness of the rear surface space is 2 mm, and the thickness of the inter-membrane space is 2 mm. That is, the soundproof structure of Example 1 is the soundproof structure having a double-layer membrane structure, and has a structure in which two soundproof structures of Reference Example 1 are overlapped.

In addition, the normal incidence sound absorption coefficient of the soundproof structure of Example 1 is measured.

The measurement result (the relationship between the measured frequency and the sound absorption coefficient) in Example 1 is as shown in FIG. 14.

As can be seen from FIG. 14, the soundproof structure according to Example 1 shows a high sound absorption coefficient at each of a plurality of sound absorption peaks appearing in a frequency band of 3 kHz to 5 kHz, and shows a sound absorption coefficient of 70% or more even at a sound absorption peak appearing around 8.5 kHz.

As described above, the soundproof structure according to the embodiment of the present invention has a double-layer membrane structure, so that relatively high frequency sound can be absorbed in a plurality of frequency bands at the same time. As a result, a large sound absorbing effect can be obtained over a wide band, despite being a resonance-type soundproof structure using the membrane vibration.

Example 2

A soundproof structure is produced in the same manner as in Example 1, except that the thickness of the inter-membrane space is set to 4 mm, and the normal incidence sound absorption coefficient is measured.

The thickness of the donut-shaped plate used as the outer frame is not 2 mm but 4 mm.

Figure 18:
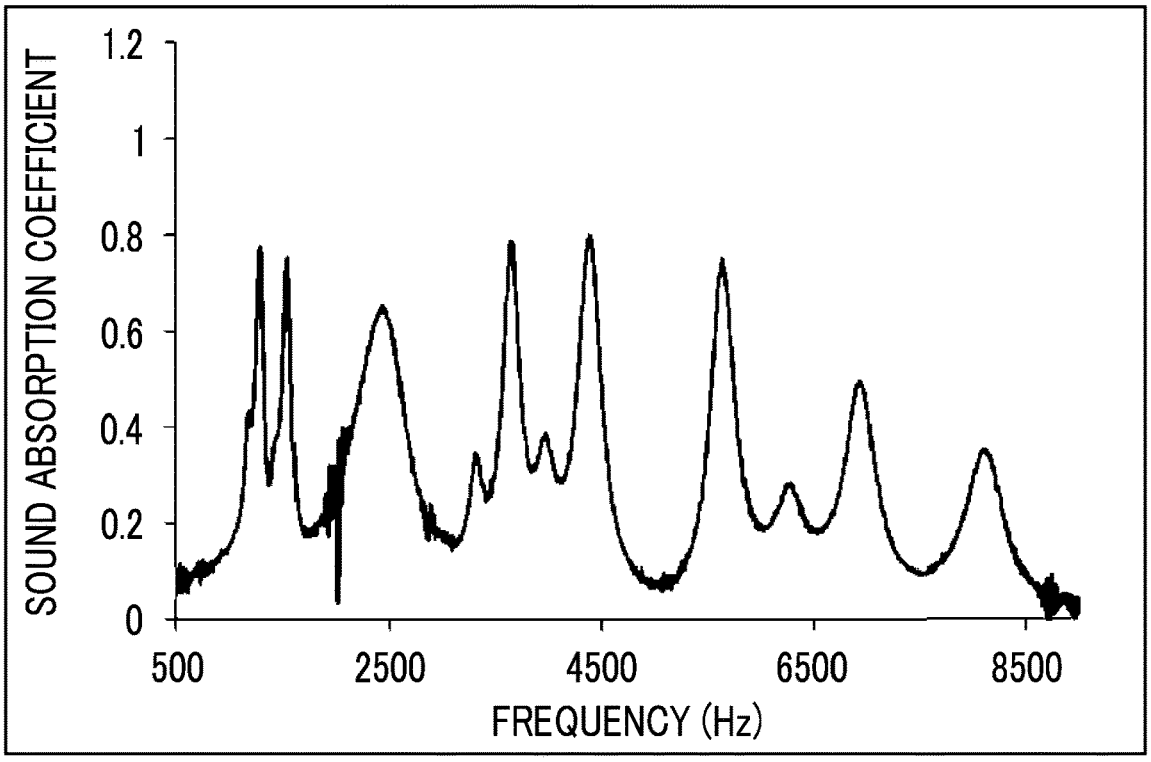
FIG. 18 is a graph showing a relationship between a frequency and a sound absorption coefficient in a case where a distance between membranes is changed.

FIG. 18 is a graph showing the measurement result (the relationship between the measured frequency and the sound absorption coefficient) in Example 2.

As shown in FIG. 18, in Example 2, the first sound absorption peak frequency is not much different from the sound absorption peak frequency in Example 1. On the other hand, the sound absorption peak frequency appearing in the band of 5 kHz or more is shifted to a lower frequency in Example 2 than in Example 1. From the above, it is considered that the first sound absorption peak frequency is mainly determined by the inner membrane and an air layer in the rear surface space. On the other hand, it is considered that the second sound absorption peak frequency is mainly determined by the inner membrane and outer membranes and the inter-membrane space.

Example 3

The soundproof structure is produced in the same manner as in Example 1 except that a through hole having a diameter of 4 mm is provided in the outer membrane, and the normal incidence sound absorption coefficient is measured.

In addition, the through hole is formed in a radial direction center portion of the membrane-like member located outside by a punch.

Figure 19:
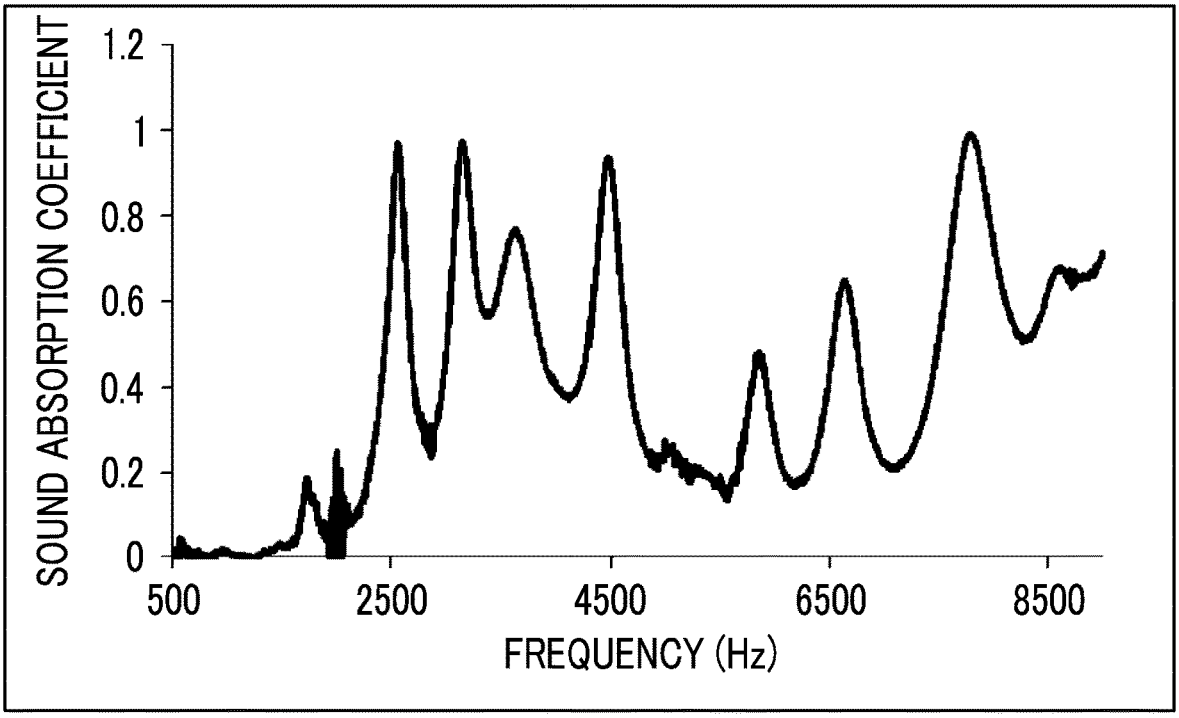
FIG. 19 is a graph showing a relationship between a frequency and a sound absorption coefficient in a case where a through hole is provided in an outer membrane.

FIG. 19 is a graph showing the measurement result (the relationship between the measured frequency and the sound absorption coefficient) in Example 3.

As shown in FIG. 19, in the soundproof structure of Example 3, as in Example 1, a large sound absorption coefficient is obtained at the sound absorption peak appearing around 3 kHz to 5 kHz. On the other hand, it is found that the sound absorption coefficient at the sound absorption peak appearing in the frequency band on the higher frequency side is higher than that in Example 1, and particularly, the sound absorption coefficient at the peak appearing at 7. 8 kHz is approximately 100%.

By providing the through hole in the outer membrane in this way, it becomes possible for an airborne sound to pass directly through the through hole, and the acoustic impedance of the membrane portion of the outer membrane changes significantly. As a result, without changing the material and thickness of the outer membrane and the size of the support, it is possible to change the properties of the outer membrane involved in the sound absorption only by forming a through hole in the outer membrane.

Example 4

The soundproof structure is produced in the same manner as in Example 3 except that the thickness of the inter-membrane space is set to 4 mm, and the normal incidence sound absorption coefficient is measured.

The thickness of the donut-shaped plate used as the outer frame is not 2 mm but 4 mm.

Figure 20:
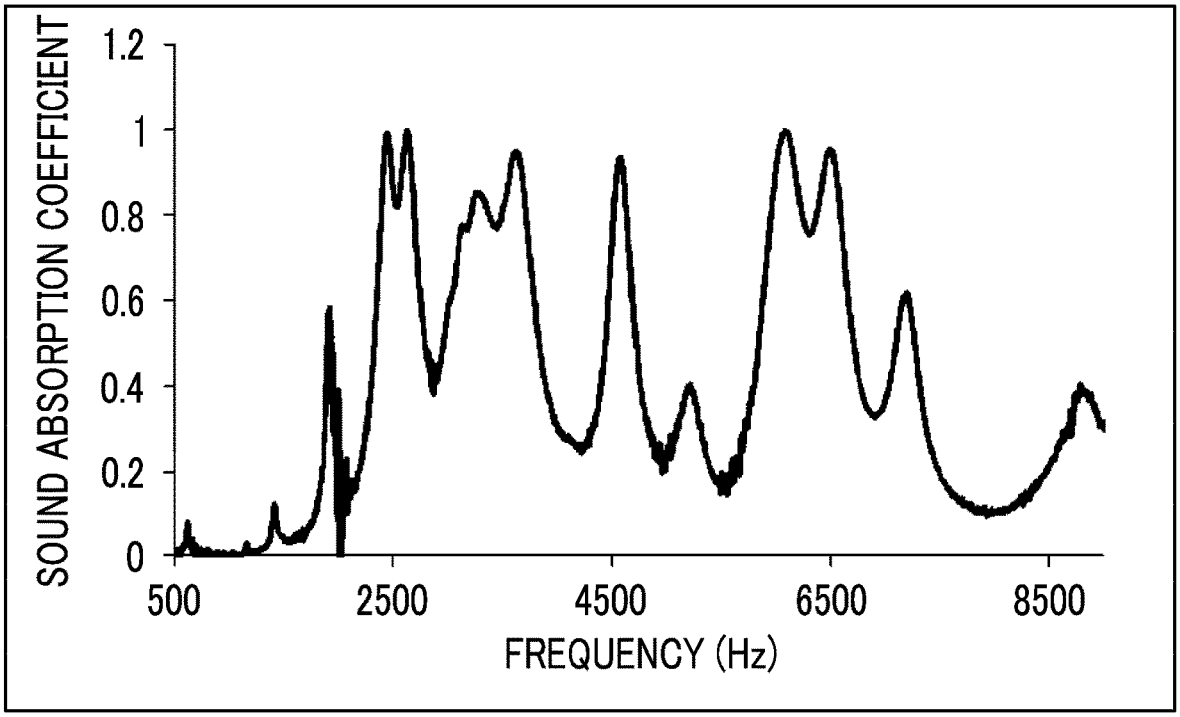
FIG. 20 is a graph showing a relationship between a frequency and a sound absorption coefficient in a case where a through hole is provided in an outer membrane and a thickness of an inter-membrane space is changed.

FIG. 20 is a graph showing the measurement result (the relationship between the measured frequency and the sound absorption coefficient) in Example 4.

As shown in FIG. 20, in the soundproof structure of Example 4, the first sound absorption peak appears in a frequency band of 5 kHz or less, as in Example 1 and Example 2. There is no significant difference between Example 3 and Example 4 in the frequency of the first sound absorption peak. On the other hand, the second sound absorption peak frequency is shifted to a lower frequency in Example 4 than in Example 3. Therefore, it is considered that the second sound absorption peak frequency is mainly determined by the inner membrane and outer membrane and the inter-membrane space.

Example 5

The soundproof structure is produced in the same manner as in Example 3 except that the thickness of the rear surface space is set to 4 mm, and the normal incidence sound absorption coefficient is measured.

The thickness of the donut-shaped plate used as the inner frame is not 2 mm but 4 mm.

Figure 21:
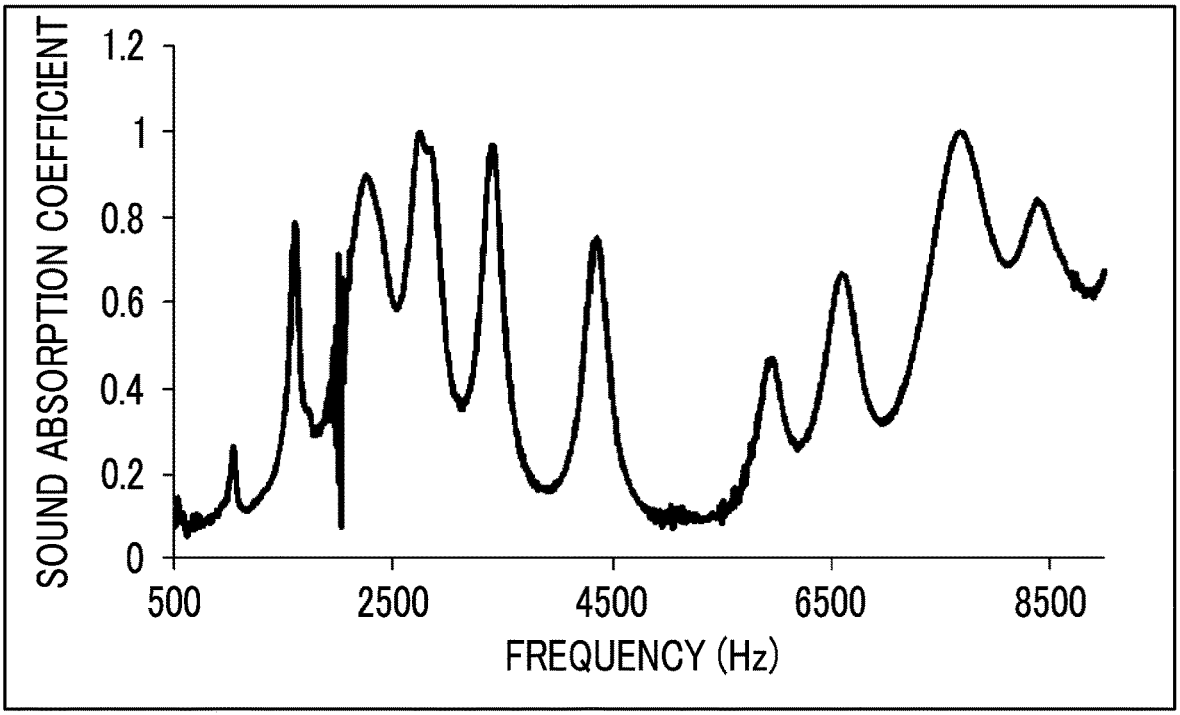
FIG. 21 is a graph showing a relationship between a frequency and a sound absorption coefficient in a case where a through hole is provided in an outer membrane and a thickness of a rear surface space is changed.

FIG. 21 is a graph showing the measurement result (the relationship between the measured frequency and the sound absorption coefficient) in Example 5.

As shown in FIG. 21, in the soundproof structure of Example 5, the second sound absorption peak frequency is not almost changed as compared with Example 3. On the other hand, the first sound absorption peak frequency is shifted to a lower frequency in Example 5 than in Example 3. Therefore, it is considered that the first sound absorption peak frequency is mainly determined by the inner membrane and the air layer in the rear surface space.

Example 6

The soundproof structure is produced in the same manner as in Example 5, except that the through hole is provided in the inner membrane instead of the outer membrane, and the normal incidence sound absorption coefficient is measured.

Figure 22:
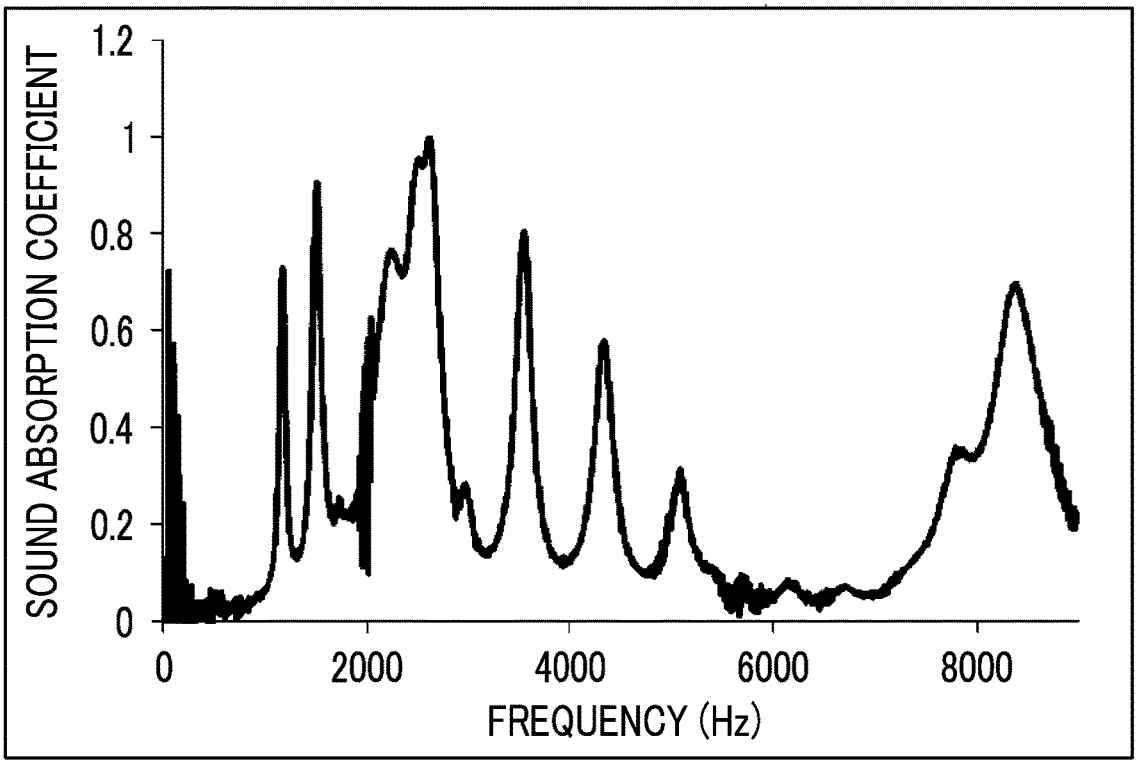
FIG. 22 is a graph showing a relationship between a frequency and a sound absorption coefficient in a case where a through hole is provided in an inner membrane.

FIG. 22 is a graph showing the measurement result (the relationship between the measured frequency and the sound absorption coefficient) in Example 6.

As shown in FIG. 22, in the soundproof structure of Example 6, the sound absorption coefficient at the first sound absorption peak is a value close to that of Example 5. On the other hand, the sound absorption coefficient at the second sound absorption peak is higher in Example 5. In the soundproof structure of Example 5, since the through hole is provided in the outer membrane, the average areal density of the membrane portion is smaller in the outer membrane than in the inner membrane. Therefore, it is considered that the airborne sound easily passes through the outer membrane. In addition, in the soundproof structure of Example 5, it is considered that the sound is more likely to pass through the outer membrane since the through hole is provided in the outer membrane. Accordingly, in the case where the multi-layer membrane structure is adopted, by making the outer membrane have a structure through which a sound easily passes and making the inner membrane have a structure through which a sound hardly passes as in Example 5, the sound reaches the inside of the soundproof structure, and as a result, the sound absorbing effect (particularly, the sound absorbing effect in the second sound absorption frequency band) is further increased.

On the other hand, in the soundproof structure of Example 6, since the sound is harder to pass through the outer membrane than the inner membrane, the reflectivity of the sound on the outer membrane is increased, and as a result, the sound absorbing effect in the soundproof structure becomes smaller.

Table 5 shows the configurations of Examples 1 to 6, Reference Example 1 and Reference Example 2, collectively.

TABLE 5

| | Structure | Thickness of membrane μm | Inner diameter of frame mm | Thickness of inter-membrane space mm | Thickness of rear surface space mm | Through hole |
|---|---|---|---|---|---|---|
| Example 1 | Double-layer membrane structure | (Inner membrane) 50 (outer membrane) 50 | 20 | 2 | 2 | None |
| Example 2 | Double-layer membrane structure | (Inner membrane) 50 (outer membrane) 50 | 20 | 4 | 2 | None |

TABLE 5-continued

| | Structure | Thickness of membrane μm | Inner diameter of frame mm | Thickness of inter-membrane space mm | Thickness of rear surface space mm | Through hole |
|---|---|---|---|---|---|---|
| Example 3 | Double-layer membrane structure | (Inner membrane) 50 (outer membrane) 50 | 20 | 2 | 2 | Hole of 4 mm in outer membrane |
| Example 4 | Double-layer membrane structure | (Inner membrane) 50 (outer membrane) 50 | 20 | 4 | 2 | Hole of 4 mm in outer membrane |
| Example 5 | Double-layer membrane structure | (Inner membrane) 50 (outer membrane) 50 | 20 | 2 | 4 | Hole of 4 mm in outer membrane |
| Example 6 | Double-layer membrane structure | (Inner membrane) 50 (outer membrane) 50 | 20 | 2 | 4 | Hole of 4 mm in inner membrane |
| Reference Example 1 | Single-layer membrane structure | 50 | 20 | — | 2 | None |
| Reference Example 2 | Single-layer membrane structure | 50 | 20 | — | 4 | None |

[Simulation 1]

The following simulation is performed on the structure of the soundproof structure of Example 1 described above.

In the simulation, an acoustic module of the finite element method calculation software COMSOL ver.5.3 (COMSOL Inc.) is used, and various designs are performed in the simulation. Specifically, the simulation is performed on the sound absorbing effect (specifically, the sound absorption coefficient) of a drum-shaped soundproof structure in which the circular membrane-like member is attached and the rear surface space is a closed space.

Figure 23:
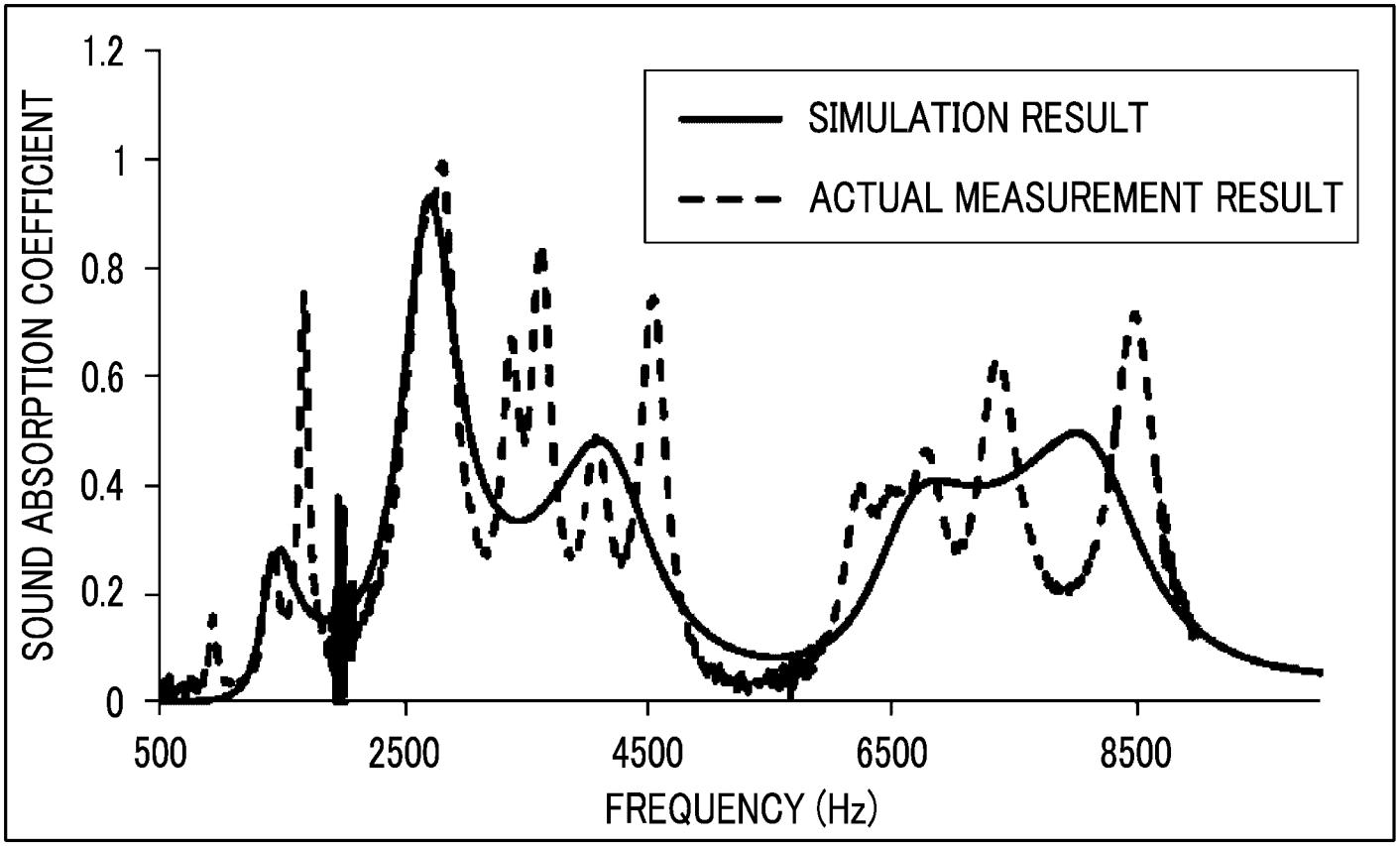
FIG. 23 is a graph showing a simulation result of a relationship between a frequency and a sound absorption coefficient.

More specifically, simulations are performed by performing the coupled calculation of sound and structure, performing the structural mechanics calculation on the membrane structure, and calculating the airborne sound in the rear surface space. At this time, numerical calculation is performed using the hardness (strictly, Young's modulus) and thickness of the membrane-like member, the thickness of the rear surface space, the thickness of the inter-membrane space, and the diameter of the opening formed in the inner frame and the outer frame (in other words, the size of the membrane portion of each of the inner membrane and the outer membrane) as parameters. The values of each parameter are set according to Example 1, the Young's modulus of the inner membrane and the outer membrane is set to 4.5 GPa which is the Young's modulus of the PET film, the thickness of the inner membrane and the outer membrane is set to 50 μm, the size of the membrane portion is set to φ 20 mm, and the thickness of each of the rear surface space and the inter-membrane space is set to 2 mm. In addition, regarding an arrangement of the soundproof structure, an arrangement in the normal incidence sound absorption coefficient measurement is implemented by simulation, and the sound absorption coefficient is calculated. The calculation model is a two-dimensional axially symmetric structure calculation model. FIG. 23 shows the result of the above simulation (the relationship between the calculated frequency and the sound absorption coefficient). In FIG. 23, the simulation result is indicated by a solid line, and an actual measurement result (the measurement result of the normal incidence sound absorption coefficient in Example 1) is indicated by a dotted line as comparison information.

As shown in FIG. 23, in the actual measurement result, the number of sound absorption peaks is larger than that in the simulation result, and the degree of change in the sound absorption coefficient at each peak is larger, but the overall tendency substantially coincides between the actual measurement result and the simulation result. That is, even in both the actual measurement result and the simulation result, a sound absorption peak exists around 3 kHz, and a sound absorption peak also exists around 8 kHz. That is, as a result of the simulation, it is found that, similarly to the actual measurement result, the sound absorption occurs in the sound absorption frequency band broadly divided into two in the soundproof structure (that is, the multi-layer membrane structure) of Example 1 in a case of roughly being divided.

[Simulation 2]

The same simulation (simulation 2) as the simulation 1 is performed for each of a case where the frames (support bodies) of the inner membrane and the outer membrane consist of a rigid body and a case where the frames consist of an elastic body (specifically, silicone rubber). Specifically, in each of the above two cases, the sound absorption coefficient is calculated in a case where a sound in the first sound absorption frequency band (for example, 2 kHz to 4.5 kHz) and a sound in the second sound absorption frequency band (for example, 6 kHz to 9 kHz) are incident.

Table 6 shows the sound absorption coefficient in each of the first sound absorption frequency band and the second sound absorption frequency band in a case where the simulation is performed by changing the material of the frame.

TABLE 6

| | Frame of rigid body | Frame of silicone rubber |
|---|---|---|
| First sound absorption frequency band | 48% | 23% |
| Second sound absorption frequency band | 33% | 8% |

As can be seen from Table 6, in the case where the frame consists of an elastic body, the sound absorption coefficient at the peak frequency is smaller in both the first sound absorption frequency band and the second sound absorption frequency band than in a case where the frame consists of a rigid body. In the case where the frame consists of an elastic body, the sound absorption frequency band itself becomes narrower, and an average sound absorption coefficient becomes smaller. Particularly, in the case where the frame consists of an elastic body, the sound absorption coefficient at the sound absorption peak in the second sound absorption frequency band is as low as 8%, and is lower than 10%. Such a low sound absorption coefficient is attributable to the fact that the frame itself, which is an elastic body, vibrates in a case where the membrane is vibrated, so that the entire soundproof structure vibrates.

As described above, in the configuration in which a vibration body is supported by an elastic body as in the sound absorbing device described in JP1987-098398A (JP-S62-098398A), a sufficient sound absorption coefficient cannot be obtained in a high frequency band (particularly, in the range of 6 kHz to 9 kHz which is the second sound absorption frequency band). On the other hand, it is found that a sufficient sound absorption coefficient even in a high frequency band can be obtained in the soundproof structure according to the embodiment of the present invention in which a rigid body forms the frame (the support).

[Simulation 3]

The same simulation (simulation 3) as the simulation 1 is performed while changing the thickness of each of the rear surface space and the inter-membrane space.

Figure 24:
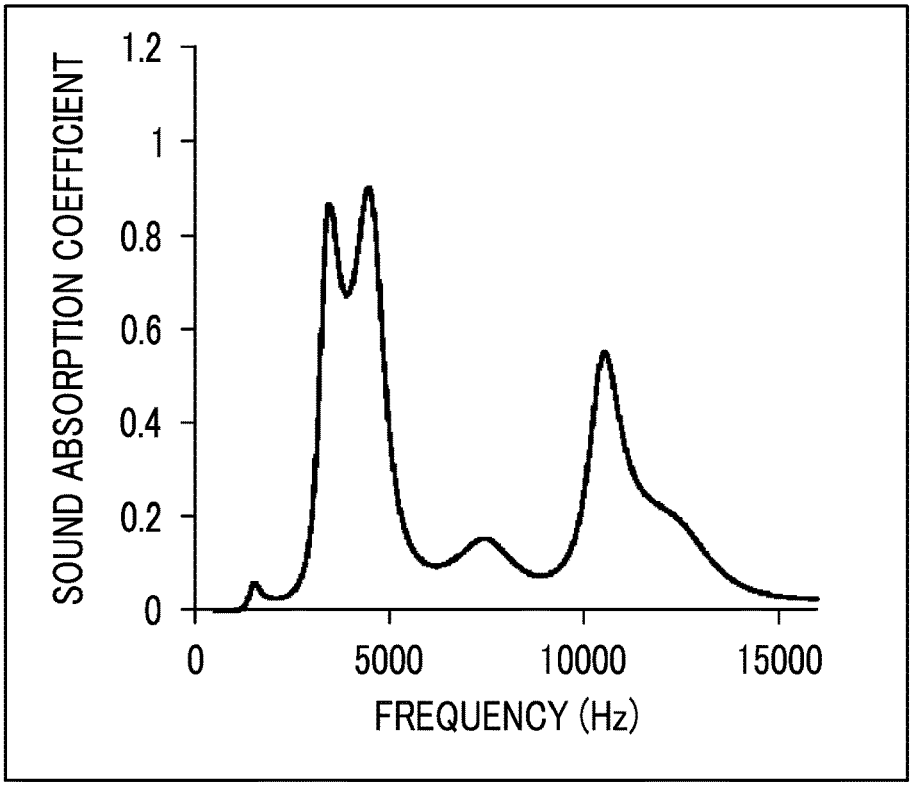
FIG. 24 is a graph showing a relationship between a frequency and a sound absorption coefficient simulated by changing a total thickness of a rear surface space and an inter-membrane space (1).
Figure 25:
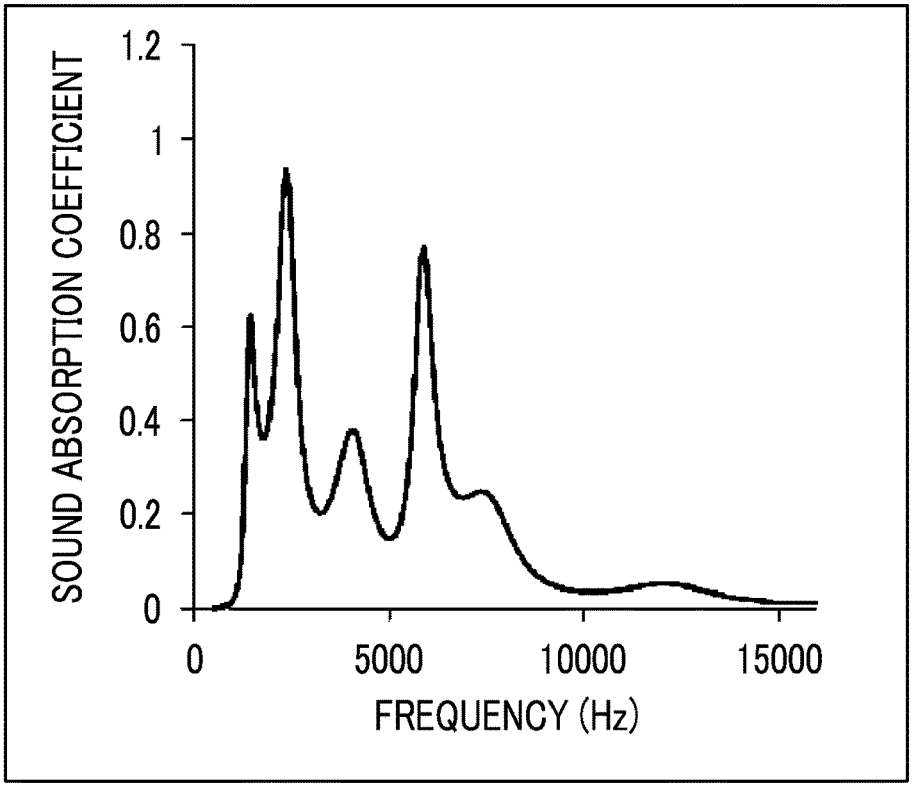
FIG. 25 is a graph showing a relationship between a frequency and a sound absorption coefficient simulated by changing a total thickness of a rear surface space and an inter-membrane space (2).

FIG. 24 shows a simulation result in a case where the thickness of each of the rear surface space and the inter-membrane space is 1 mm, and FIG. 25 shows a simulation result in a case where each thickness of the rear surface space and the inter-membrane space is 3 mm.

As can be seen from FIGS. 24 and 25, it is found that even in a case where the thickness of each of the rear surface space and the inter-membrane space is changed, similarly to the structure of Example 1, the sound absorption occurs in the sound absorption frequency band broadly divided into two in the soundproof structure having the double-layer membrane structure. In addition, it is found that as the thickness of each of the rear surface space and the inter-membrane space become smaller, the sound absorption peak frequency in each frequency band shifts to a higher frequency.

Further, in a case where the simulation is performed by changing a total (hereinafter, total thickness) of the thickness of the rear surface space and the inter-membrane space in the range of 1 mm to 30 mm, Table 7 shows each frequency of the first sound absorption peak and the second sound absorption peak, and the sound absorption coefficient at each peak.

In each simulation, the soundproof structure is set to a double-layer membrane structure, and the membrane surface of the inner membrane (the surface of the inner membrane facing outside) is set to be disposed at the center position of the soundproof structure in the thickness direction. For example, Example 1 corresponds to a case where the total thickness is 4 mm.

TABLE 7

| Total thickness mm | First sound absorption peak Hz | Second sound absorption peak Hz | Absorption coefficient in first sound absorption peak | Absorption coefficient in second sound absorption peak |
|---|---|---|---|---|
| 1 | 5700 | 15600 | 0.99 | 0.65 |
| 2 | 4500 | 10500 | 0.90 | 0.55 |
| 3 | 3000 | 8900 | 0.98 | 0.66 |
| 4 | 2700 | 8000 | 0.93 | 0.50 |
| 5 | 2500 | 6300 | 0.92 | 0.64 |
| 6 | 2300 | 5900 | 0.93 | 0.77 |
| 7 | 2200 | 5500 | 0.96 | 0.82 |
| 8 | 2100 | 5300 | 0.98 | 0.81 |
| 9 | 2100 | 5000 | 0.98 | 0.81 |
| 10 | 2000 | 4800 | 1.00 | 0.77 |
| 20 | 1800 | 4100 | 0.89 | 0.47 |
| 30 | 1800 | 4000 | 0.79 | 0.36 |

As shown in Table 7, as the total thickness becomes smaller, the first sound absorption peak frequency and the second sound absorption peak frequency shift to a high frequency. On the other hand, as the total thickness becomes larger, both the sound absorption coefficient at the first sound absorption peak and the sound absorption at the second sound absorption peak decrease. In addition, as the total thickness becomes larger, a shift amount of the sound absorption peak frequency decreases, and in a case where the total thickness exceeds 10 mm, the sound absorption peak frequency hardly changes. Further, the larger the total thickness becomes, the larger the soundproof structure becomes naturally.

From the above, the total thickness is preferably 10 mm or less, more preferably 7 mm or less, and even more preferably 5 mm or less.

Figure 26:
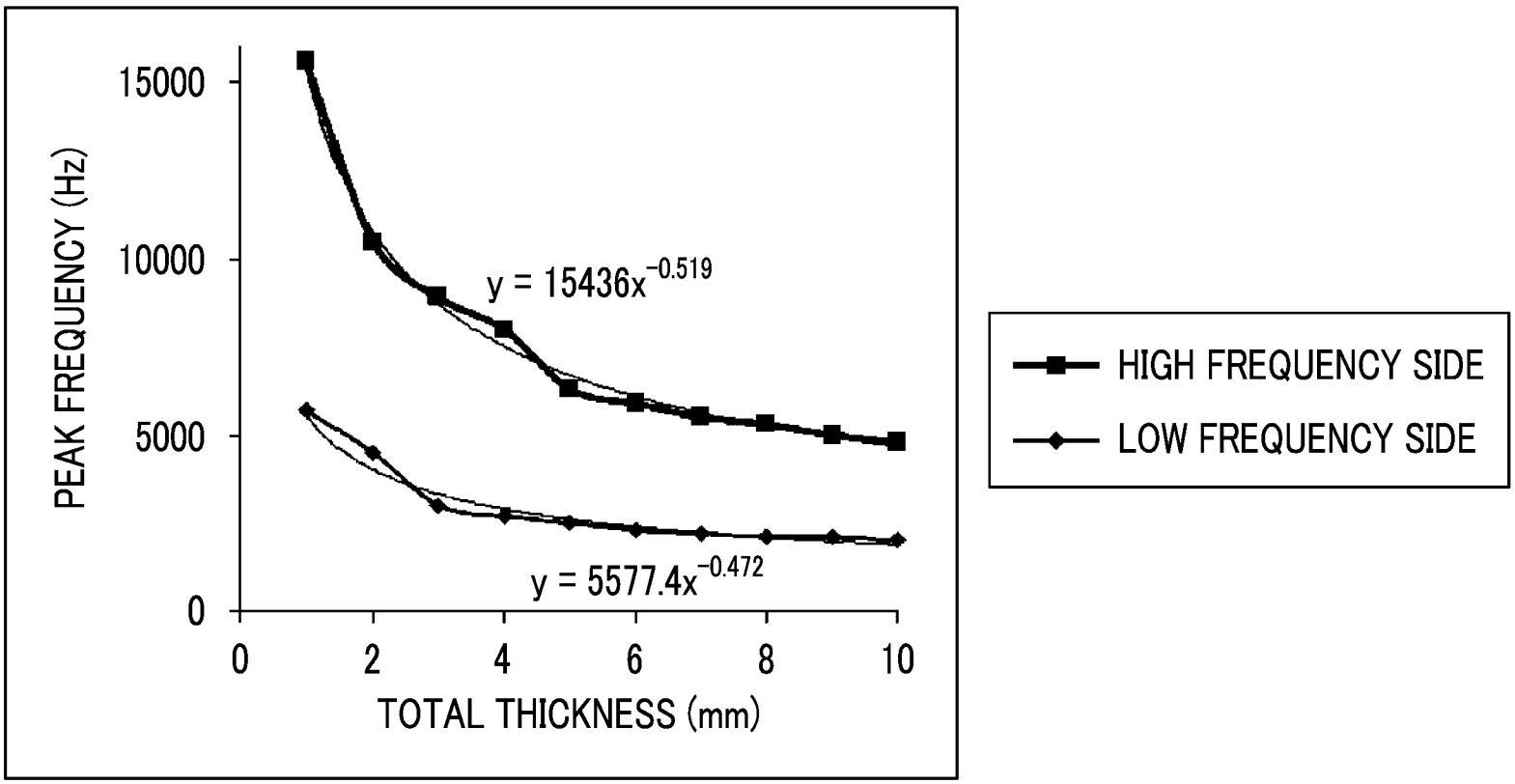
FIG. 26 is a graph showing a relationship between a total thickness and a sound absorption peak frequency.

FIG. 26 is a graph plotting a correspondence relationship between the total thickness and the sound absorption peak frequency shown in Table 7.

As shown in FIG. 26, the sound absorption peak frequency changes according to the total thickness, and in a case where the total thickness is denoted by x, the first sound absorption peak frequency is denoted by $y_1$, and the second sound absorption peak frequency is denoted by $y_2$, the correspondence relationship between the total thickness and each sound absorption peak frequency can be approximated by the following equations (2) and (3).

$$y_1=5577.4*x^{-0.472} \quad (2)$$

$$y_2=15436*x^{-0519} \quad (3)$$

Equation (2) approximates the correspondence relationship between the total thickness and the first sound absorption peak frequency, and Equation (3) approximates the correspondence relationship between the total thickness and the second sound absorption peak frequency.

[Simulation 4]

With respect to the structure of the soundproof structure of Example 3 described above, the same simulation (Simulation 4) as Simulation 1 is performed. Since the through hole has a relatively small hole diameter, a thermo-viscous acoustic calculation in an acoustic module of COMSOL is applied to perform a more accurate simulation including a sound absorbing effect due to thermo-viscous friction inside the through hole.

Figure 27:
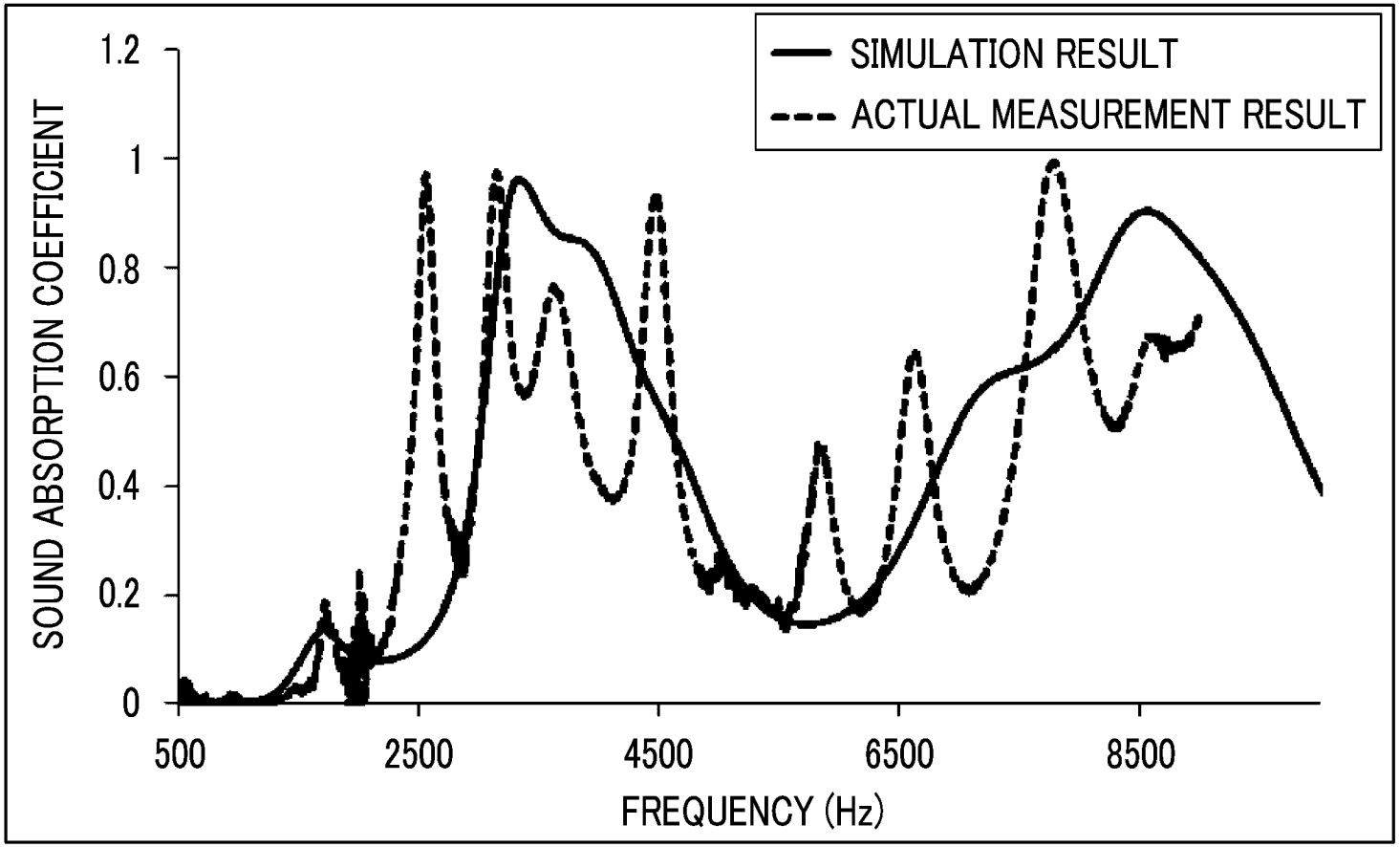
FIG. 27 is a diagram showing a simulation result of a relationship between a frequency and a sound absorption coefficient in a case where a through hole is provided in an outer membrane.

FIG. 27 shows the result of the above simulation (the relationship between the calculated frequency and the sound absorption coefficient). In FIG. 27, the simulation result is indicated by a solid line, and an actual measurement result (the measurement result of the normal incidence sound absorption coefficient in Example 3) is indicated by a dotted line as comparison information.

As shown in FIG. 27, in the simulation 4, as in the simulation 1, the number of sound absorption peaks is larger in the actual measurement result than in the simulation result, and the degree of change in the sound absorption coefficient at each peak is larger. Nevertheless, in Simulation 4, the overall tendency substantially coincides between the actual measurement result and the simulation result. That is, even in both of the simulation result and the actual measurement result, the sound absorption frequency band is largely divided into two frequency bands, and each frequency band substantially coincides between the simulation result and the actual measurement result.

Figure 28:
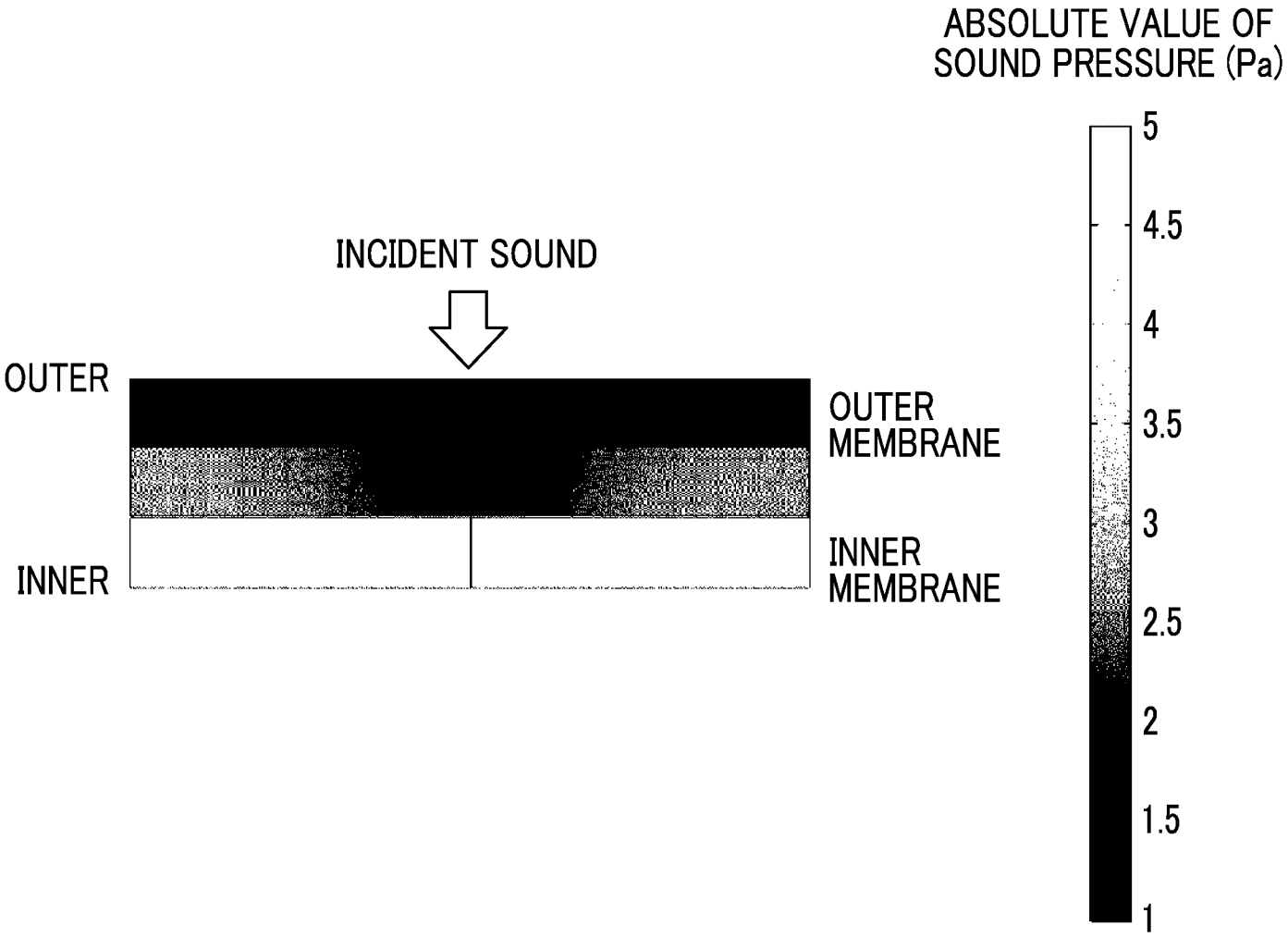
FIG. 28 is a diagram showing a size of sound pressure inside the soundproof structure according to an example of the present invention (1).
Figure 29:
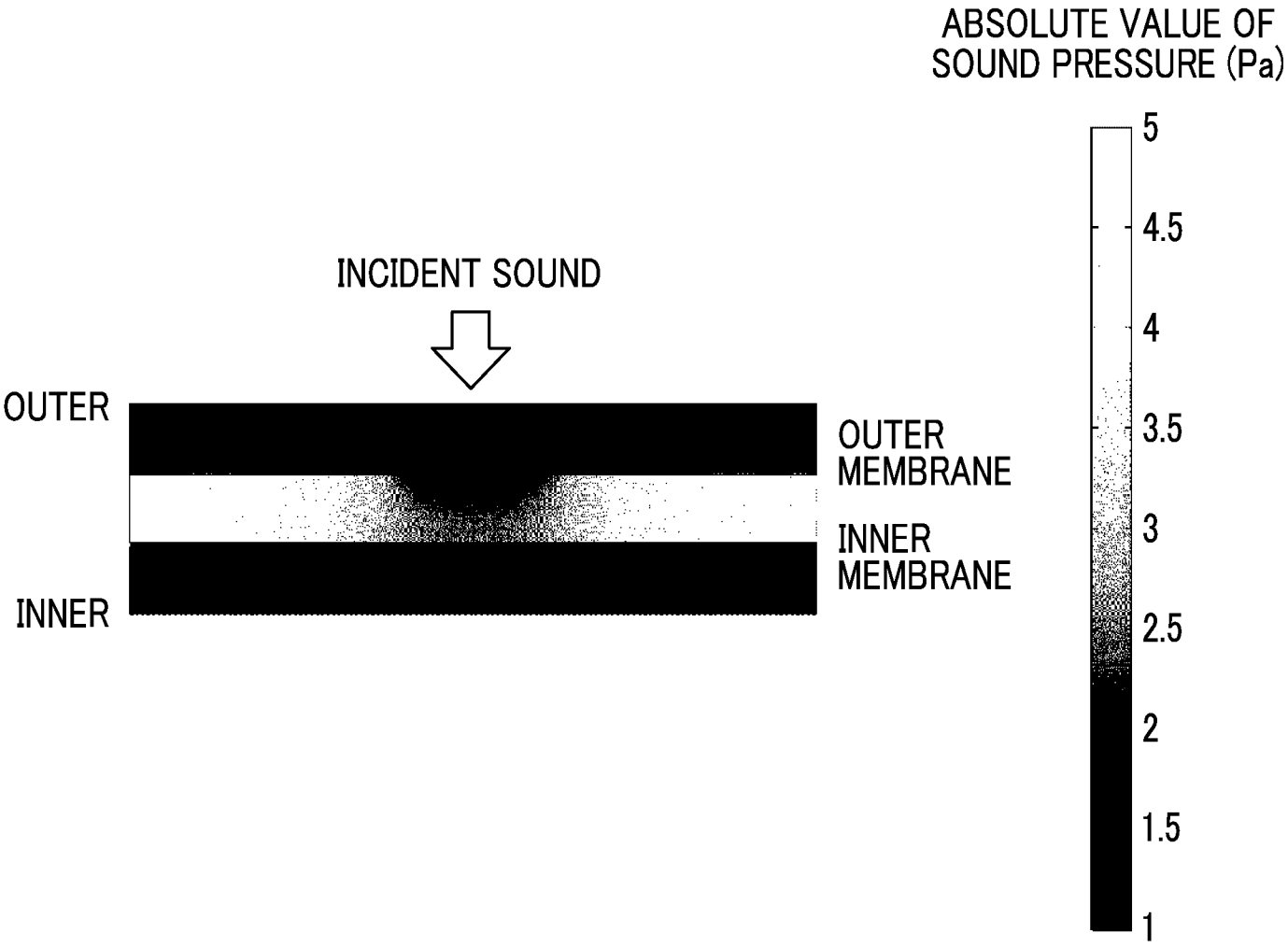
FIG. 29 is a diagram showing a size of sound pressure inside the soundproof structure according to an example of the present invention (2).

In addition, according to the simulation 4, the size of sound pressure inside the soundproof structure in a case where a sound corresponding to the sound absorption peak frequency is incident is calculated. Here, the size of the sound pressure inside the soundproof structure in which a sound corresponding to the first sound absorption peak frequency (for example, sound near 3.3 kHz) is incident is visualized and shown in FIG. 28. Further, the size of the sound pressure inside the soundproof structure in which a sound corresponding to the second sound absorption peak frequency (for example, a sound around 8.8 kHz) is incident is visualized and shown in FIG. 29. In FIGS. 28 and 29, as in FIGS. 9 and 10, the size of the sound pressure at each position in the soundproof structure in a case where a plane wave having sound pressure of 1 Pa is incident from the upper side of the drawing is indicated by black and white gradation.

As shown in FIG. 28, in a case where a sound is absorbed at the first sound absorption peak frequency, the sound pressure on the rear surface of the inner membrane, that is, on the rear surface space, increases. This reflects that the sound absorption in the first frequency band is mainly due to the sound absorbing structure (membrane type sound absorbing structure) composed of the inner membrane and the rear surface space.

On the other hand, as shown in FIG. 29, in a case where a sound is absorbed at the second sound absorption peak frequency, the sound pressure in the inter-membrane space increases. This reflects that sound absorption in the second frequency band is mainly due to the sound absorbing structure composed of the inner membrane and outer membrane and the inter-membrane space.

As described above, by visualizing the size of the sound pressure inside the soundproof structure in a case where each sound absorption peak frequency is incident by simulation, it is possible to clarify which structure (mechanism) in the soundproof structure mainly contributes to the sound absorption at each sound absorption peak frequency.

[Simulation 5]

The same simulation (simulation 5) as simulation 4 is performed while changing the size (diameter) of the through hole in the range of 1 mm to 10 mm.

Figure 30:
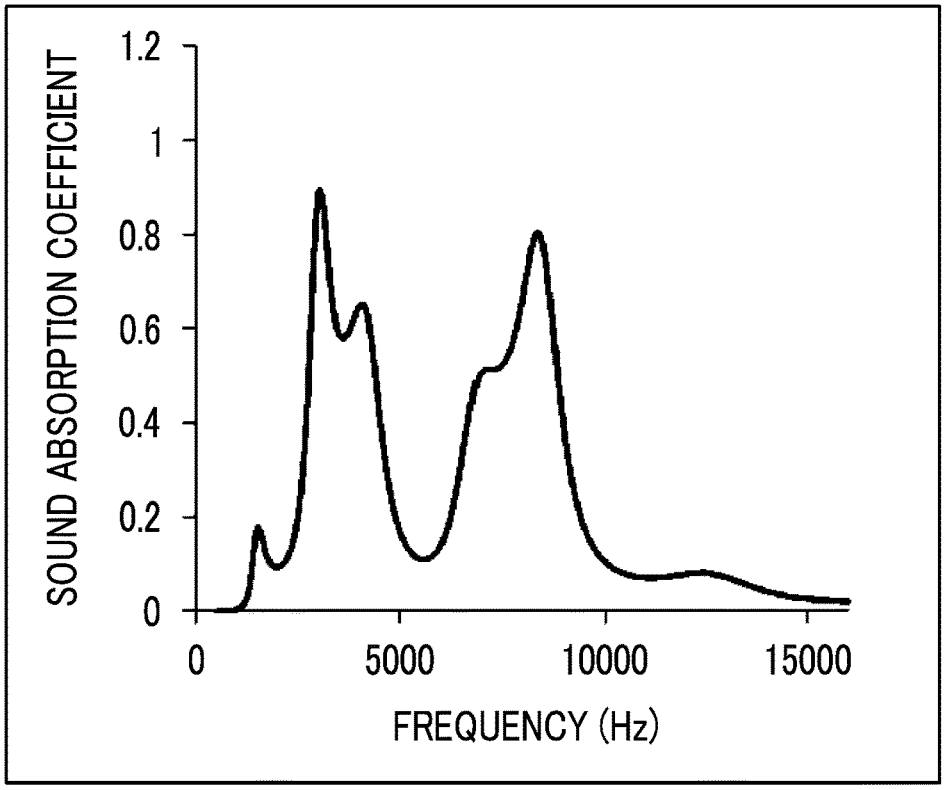
FIG. 30 is a diagram showing a relationship between a frequency and a sound absorption coefficient simulated by changing a size of a through hole of a membrane (1).
Figure 31:
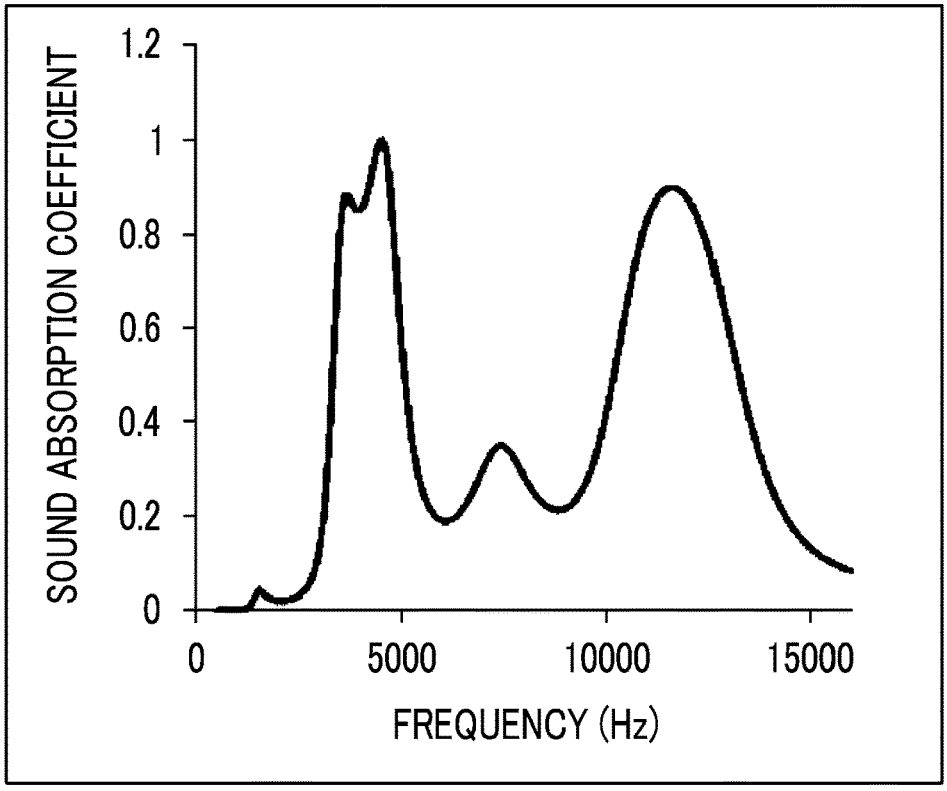
FIG. 31 is a diagram showing a relationship between a frequency and a sound absorption coefficient simulated by changing a size of a through hole of a membrane (2).

FIG. 30 shows a simulation result in a case where the size of the through hole is 2 mm, and FIG. 31 shows a simulation result in a case where the size of the through hole is 10 mm.

Further, Table 8 shows each frequency of the first sound absorption peak and the second sound absorption peak in a case where the simulation is performed while changing the size of the through hole.

TABLE 8

| Size of through hole mm | First sound absorption peak Hz | Second sound absorption peak Hz |
|---|---|---|
| 1 | 2900 | 8100 |
| 2 | 3000 | 8400 |
| 3 | 3200 | 8500 |
| 4 | 3300 | 8600 |
| 5 | 3500 | 8800 |
| 6 | 3500 | 9100 |
| 7 | 4200 | 9600 |
| 8 | 4300 | 10200 |
| 9 | 4400 | 10900 |
| 10 | 4500 | 11600 |

As can be seen from FIGS. 30 and 31, and Table 8, it is found that as the size of the through hole increases, the sound absorption peak frequency shifts to a higher frequency, and particularly, the second sound absorption peak frequency shifts more.

EXPLANATION OF REFERENCES

10: soundproof structure
12: plurality of membrane-like members
12*a*: membrane portion
14: inner membrane
15: outer membrane
16: support
18: inner frame
19: outer frame (tubular frame)
20: opening
21: opening surface
22: bottom wall
24: rear surface space
26: inter-membrane space
28: through hole
30: porous sound absorbing body

What is claimed is:

1. A soundproof structure comprising:

a plurality of membrane-like members that are overlapped to be spaced from each other;

a support that is made of a rigid body and supports each of the plurality of membrane-like members so as to perform membrane vibration;

an inter-membrane space that is sandwiched between two adjacent membrane-like members among the plurality of membrane-like members; and a rear surface space that is formed between one membrane-like member at one end of the support in the support among the plurality of membrane-like members and the one end of the support, wherein each of the plurality of membrane-like members absorbs a sound by performing the membrane vibration in a state where the one end of the support is closed, and wherein a sound absorption coefficient of the vibration of the one membrane-like member at a frequency in at least one high-order vibration mode existing at frequencies of 1 kHz or more is higher than a sound absorption coefficient at a frequency in a fundamental vibration mode.

2. The soundproof structure according to claim 1, wherein, in a case where a Young's modulus of the one membrane-like member is denoted by E, a thickness of the one membrane-like member is denoted by t, a thickness of the rear surface space is denoted by d, and an equivalent circle diameter of a region where the one membrane-like member vibrates is denoted by Φ, a hardness $E \times t^3$ of the one membrane-like member is $21.6 \times D^{-1.25} \times \Phi^{4.15}$ or less.

3. The soundproof structure according to claim 2, wherein the hardness $E \times t^2$ of the one membrane-like member is $2.49 \times 10^{-7}$ or more.

4. The soundproof structure according to claim 1, wherein the support comprises an inner frame having an opening, wherein the one membrane-like member is fixed to an opening surface surrounding the opening at an end position of the inner frame, and wherein the rear surface space is surrounded by the one membrane-like member and the inner frame.

5. The soundproof structure according to claim 1, wherein there are a plurality of frequency bands where the soundproof structure is capable of absorbing the sound, and wherein, the plurality of frequency bands where the soundproof structure is capable of absorbing the sound include a first sound absorption frequency band in a case where the one membrane-like member performs the membrane vibration in a high-order vibration mode and a second sound absorption frequency band in a case where the two adjacent membrane-like members are in opposite phases to each other while sandwiching the inter-membrane space and perform the membrane vibration.

6. The soundproof structure according to claim 4, wherein the support has a bottom wall that covers the opening of the inner frame on a side opposite to the opening surface in which the one membrane-like member is fixed.

7. The soundproof structure according to claim 1, wherein the rear surface space is a closed space.

8. The soundproof structure according to claim 7, wherein a through hole is provided in at least one of the support or the bottom wall.

9. The soundproof structure according to claim 1, wherein a thickness of each of the inter-membrane space and the rear surface space is 10 mm or less.

10. The soundproof structure according to claim 1, wherein a total length of the soundproof structure in the direction in which the membrane-like member are arranged is 10 ram or less.

11. The soundproof structure according to claim 1, wherein a thickness of the membrane-like member is 100 urn or less.

12. The soundproof structure according to claim 1, wherein a total thickness of the rear surface space and the inter-membrane space is 10 mm or less.

13. The soundproof structure according to claim 1, wherein average areal densities of membrane portions are different from each other between at least two or more membrane-like members among the plurality of membrane-like members, and wherein the membrane-like member having a larger average areal density of the membrane portion is disposed on one end side of the support close to the rear surface space, and the membrane-like member having a smaller average areal density of the membrane portion is disposed on the other end side of the support farther from the rear surface space.

14. The soundproof structure according to claim 1, wherein a through hole is formed in at least one of the plurality of membrane-like members.

15. The soundproof structure according to claim 14, wherein the through hole is formed in the membrane-like member at a position farthest from one end of the support close to the rear surface space among the plurality of membrane-like members.

16. The soundproof structure according to claim 1, further comprising:

a porous sound absorbing body disposed in at least a portion of at least one space of the rear surface space or the inter-membrane space.

17. The soundproof structure according to claim 1, wherein the membrane-like member at a position farthest from one end of the support close to the rear surface space among the plurality of membrane-like members forms an end farther from the rear surface space of the soundproof structure.

18. The soundproof structure according to claim 1, wherein the support comprises a tubular outer frame, and wherein the two adjacent membrane-like members face each other via the outer frame.

* * * * *